US006223730B1

(12) United States Patent
Hasegawa et al.

(10) Patent No.: US 6,223,730 B1
(45) Date of Patent: May 1, 2001

(54) FUEL INJECTION CONTROL SYSTEM OF INTERNAL COMBUSTION ENGINE

(75) Inventors: Jun Hasegawa; Yukihiro Yamashita, both of Kariya; Daiji Isobe, Toyohashi; Wakichi Kondo, Kariya, all of (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/179,203

(22) Filed: Oct. 27, 1998

(30) Foreign Application Priority Data

| | | |
|---|---|---|
| Nov. 27, 1997 | (JP) | 9-325605 |
| Dec. 10, 1997 | (JP) | 9-340190 |
| Dec. 17, 1997 | (JP) | 9-347493 |
| Jan. 26, 1998 | (JP) | 10-012657 |
| Mar. 25, 1998 | (JP) | 10-077556 |

(51) Int. Cl.[7] ..... F02M 51/00
(52) U.S. Cl. ..... 123/491; 123/590
(58) Field of Search ..... 123/491, 590, 123/305

(56) References Cited

U.S. PATENT DOCUMENTS

| | | | | |
|---|---|---|---|---|
| 5,465,701 | * | 11/1995 | Hunt | 123/491 |
| 5,482,023 | * | 1/1996 | Hunt et al. | 123/491 |
| 5,542,394 | * | 8/1996 | Tomisawa | 123/491 |
| 5,743,236 | * | 4/1998 | Kawakami | 123/491 |
| 5,954,025 | * | 9/1999 | Kanamaru et al. | 123/491 |
| 5,979,400 | * | 11/1999 | Nishide | 123/305 |
| 5,992,374 | * | 11/1999 | Morikawa | 123/305 |

FOREIGN PATENT DOCUMENTS

| | | |
|---|---|---|
| 1-21156 | 6/1989 | (JP) . |
| 2-46043 | 3/1990 | (JP) . |
| 5-45762 | 11/1993 | (JP) . |
| 2685963 | 8/1997 | (JP) . |

* cited by examiner

*Primary Examiner*—John Kwon
(74) *Attorney, Agent, or Firm*—Nixon & Vanderhye PC

(57) ABSTRACT

In a fuel injection control system for an internal combustion engine, a fuel atomization device is provided to atomize fuel injected at the time of engine starting. The fuel atomization device may be a type which increases fuel pressure to a higher value at the time of engine starting than after the engine starting. Alternatively, the fuel atomization device may be a type which supplies assist air to the injected fuel. An intake valve is opened for a longer period at the time of engine starting than after the engine starting, so that more fuel may be supplied to an engine cylinder. A fuel leakage which may occur during engine stop is estimated, and the amount of fuel to be injected at the time of next engine starting after the engine stop is corrected by the estimated amount of fuel leakage. Fuel injection timing at the time of engine starting is retarded relative to that of post-engine starting. The amount of injected fuel adhered to an intake port and not supplied into an engine cylinder after the closing of the intake valve is estimated, and the amount of fuel to be injected next is corrected thereby.

33 Claims, 46 Drawing Sheets

| | NE | | | |
|---|---|---|---|---|
| PM | - - - | - - - | - - - | - - - |
| | - - - | - - - | KTP | - - - |
| | - - - | - - - | - - - | - - - |
| | - - - | - - - | - - - | - - - |

| | | PM (mmHg) | | | | | |
|---|---|---|---|---|---|---|---|
| | | 750 | 700 | 650 | 600 | 550 | 500 |
| NE (rpm) | 0 | 400 | 400 | 400 | | | |
| | 200 | 600 | 600 | 600 | | | |
| | 400 | 700 | 700 | 600 | 550 | | |
| | 600 | 800 | 800 | 750 | 750 | 700 | |
| | 800 | | | 900 | 900 | 900 | 850 |

FUEL INJECTION CONTROL SYSTEM OF INTERNAL COMBUSTION ENGINE

BACKGROUND OF THE INVENTION

1. Field of the Invention

The present invention relates to a fuel injection control system for an internal combustion engine and more particularly to a control system for improving the starting performance of an internal combustion engine.

2. Description of Related Art

Conventionally, it is known to inject a relatively large amount of fuel at a timing which is not synchronous with a suction stroke, as a fuel injection control carried out when an internal combustion engine is started. Fuel evaporated before the suction stroke is sucked into cylinders and is burned, thereby starting the internal combustion engine. By increasing the fuel injection amount, the fuel (fuel evaporated and sucked into the cylinders) necessary for the start-up is assured.

It is also known, because the evaporation amount of fuel changes depending on the engine temperature (cooling water temperature), to correct the fuel injection amount at the time of starting in accordance with the cooling water temperature.

Further, Japanese Examined utility Model Publication No. 1-21156 proposes it is known to improve the starting performance of an internal combustion engine, to learn the relation between the fuel injection amount at the time of engine starting and a time actually required for start-up, and to increase or decrease the fuel injection amount at the time of the next engine starting, on the basis of the learned result, so as to reduce the starting.

At the time of so-called cold engine starting which is a start-up when the engine temperature is low, however, an evaporation amount of fuel is small and even if the fuel injection amount is increased, and a misfire occurs. There is consequently a problem that exhaust emission gets worse.

SUMMARY OF THE INVENTION

It is a first object of the invention to provide a fuel injection control system of an internal combustion engine, which can improve the starting performance of the internal combustion engine and can especially improve the starting performance during cold engine starting.

It is a second object of the invention to provide a fuel injection control system of an internal combustion engine, that can shorten the starting time of the internal combustion engine.

According to the present invention, a fuel atomization device is provided to atomize fuel injected at the time of engine starting. The fuel atomization device may be a type that increases fuel pressure to a higher value at the time of engine starting than after the engine starting. Alternatively, the fuel atomization device may be a type that supplies assist air to the injected fuel.

Preferably, an intake valve is opened for a longer period at the time of engine starts than after the engine starting, so that more fuel may be supplied to an engine cylinder.

Preferably, a fuel leakage which may occur during engine stop is estimated, and the amount of fuel to be injected at the time of next engine starting after the engine stop is corrected by the estimated amount of fuel leakage.

Preferably, a change in the cylinder pressure between the compression stroke and the combustion stroke is calculated, and the fuel injection at the time of engine starting is corrected by the cylinder pressure change.

Preferably, fuel injection timing at the time of engine starting is retarded relative to that of post-engine starting.

Preferably, the amount of injected fuel adhered to an intake port and not supplied into an engine cylinder after the closing of an intake valve is estimated, and the amount of fuel to be injected next is corrected thereby.

Preferably, the amount of fuel is divided into two fuel injections at the time of engine starting, in the event that it is too large to be injected at one time relative to the opening period of an intake valve.

Preferably, the amount of intake air supplied for an engine idle speed control is reduced at the time of engine starting, so that air-fuel mixture is enriched in fuel.

DETAILED DESCRIPTION OF THE PREFERRED EMBODIMENTS

First Embodiment

Figure 1:
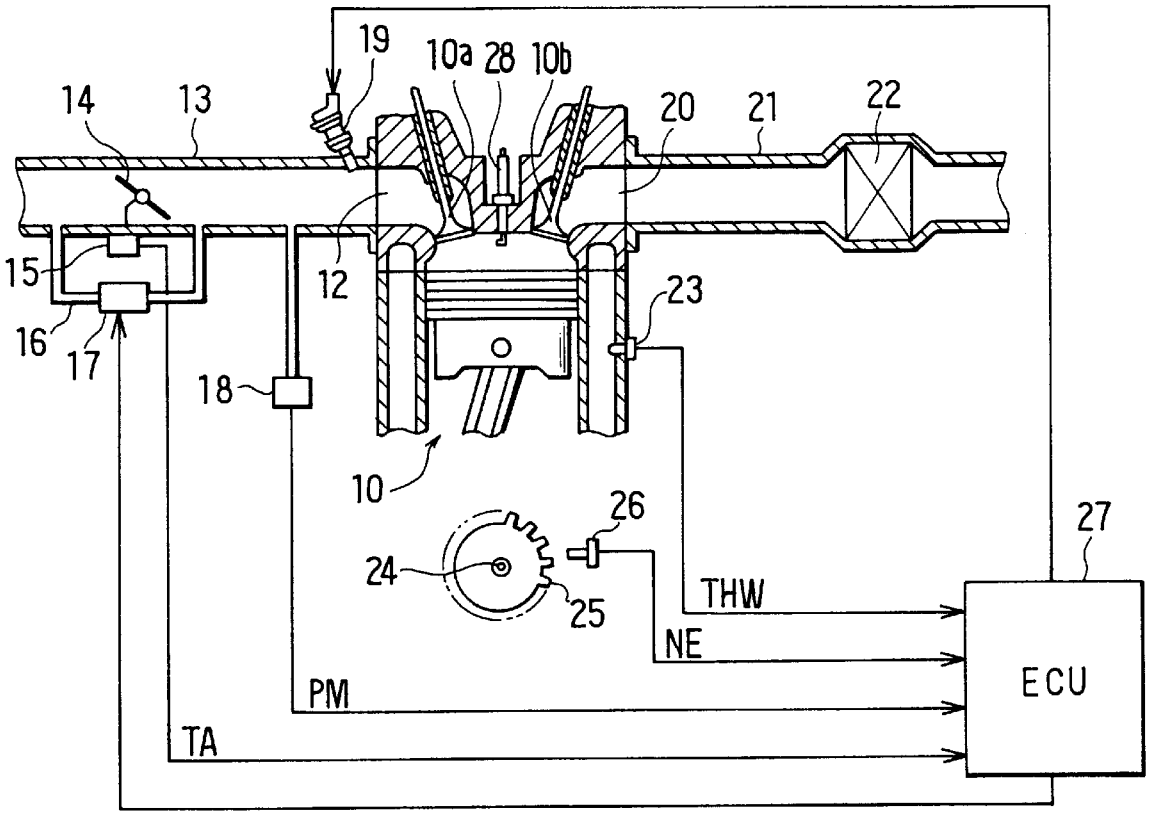
FIG. 1 is a diagram showing a fuel injection control system according to a first embodiment of the present invention.

In FIG. 1 showing a fuel injection control system for an internal combustion engine 10, a throttle valve 14 is provided in an intake pipe 13 connected to an intake port 12 of the engine 10 and the opening angle TA of the throttle valve 14 is sensed by a throttle opening angle sensor 15. The intake pipe 13 is provided with a bypass 16 for bypassing the throttle valve 14 and an idle speed control valve (ISC valve) 17 serving as a bypass air amount regulating device is disposed in the middle of the bypass 16. An intake air pressure sensor 18 for sensing an intake air pressure PM is provided downstream of the throttle valve 14 and a fuel injection valve 19 is attached near the intake port 12 of each cylinder.

An exhaust pipe 21 is connected to an exhaust port 20 of the engine 10, and a catalyst 22 is disposed in the exhaust pipe for purifying the exhaust gas. A cylinder block of the engine 10 is provided with a cooling water temperature sensor 23 for sensing a cooling water temperature THW. A crank angle sensor 26 is arranged facing the outer periphery of a signal rotor 25 fit on a crankshaft 24 of the engine 10 and a pulse signal NE of a frequency proportional to the rotational speed of the signal rotor 25 is generated from the crank angle sensor 26.

Outputs of the various sensors are supplied to an engine control unit 27. The ECU 27 is constructed by a microcomputer as a main component parts to control fuel injection amount (period) and injection timing of the fuel injection valve 19 and an ignition timing and the like of a spark plug 28 on the basis of the engine operating conditions detected by the various sensors.

At the time of engine starting, after discriminating cylinders, an injection pulse is applied to the fuel injection valve 19 in the suction stroke of each cylinder to execute the fuel injection in the suction stroke. Since the engine temperature is generally low at the time of starting, it is necessary to increase the fuel concentration in a mixture (rich air-fuel ratio mixture) so that the amount of fuel is larger than that required after completion of starting. Consequently, there is a case such that a required fuel injection period (the width of an injection pulse) at the time of starting becomes longer than an open period of the intake valve and that the required fuel amount cannot be injected by the fuel injection only in the suction stroke (the intake valve opening period). When the mixture at the time of starting becomes lean and exceeds the combustion limit, a misfire occurs and completion of the starting is delayed. Consequently, the starting performance is lessened and the HC exhaust amount is increased.

According to the first embodiment, therefore, in the starting mode, by increasing the fuel pressure P to be higher than that in a normal control mode, the fuel injection amount per unit time is increased to make the air-fuel ratio of the mixture become a rich mixture. In this case, the fuel injection is executed in the suction stroke.

Figure 2:
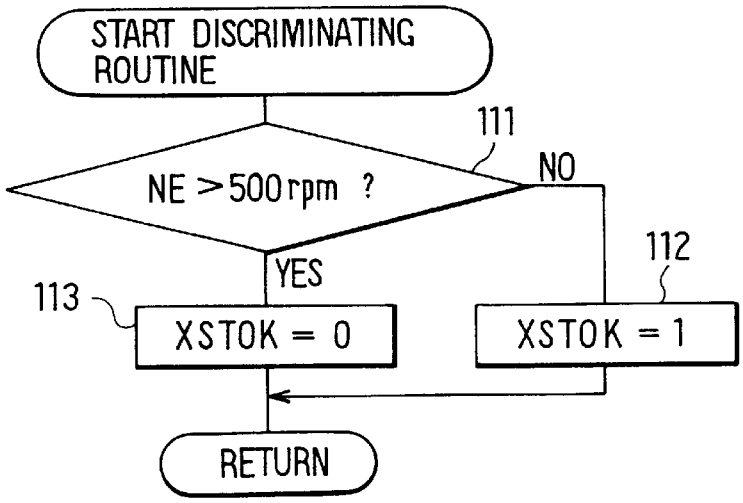
FIG. 2 is a flowchart showing the processing of a start discriminating routine.
Figure 3:
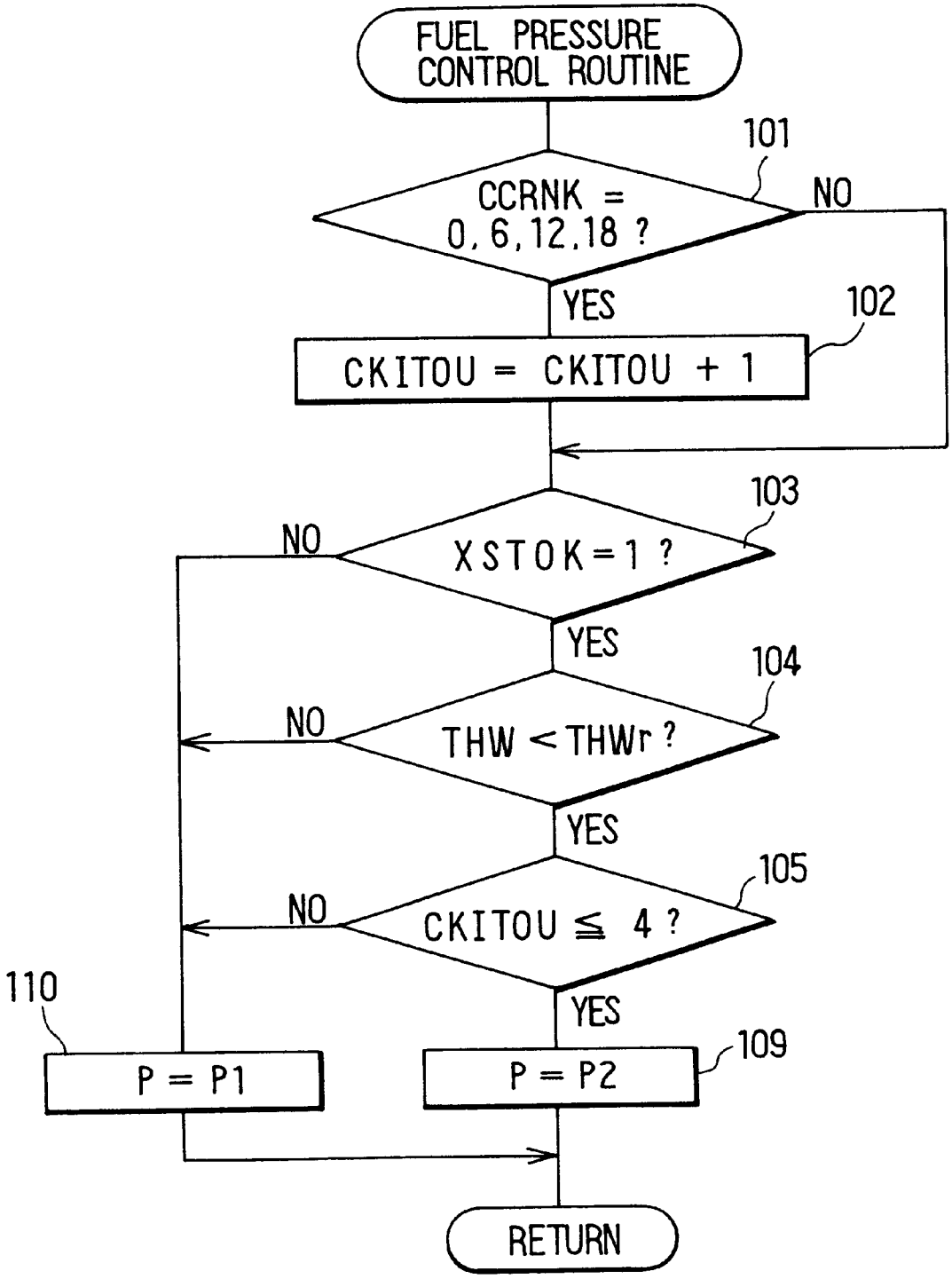
FIG. 3 is a flowchart showing the processing of a fuel pressure control routine.

This control is executed by the ECU 27 in accordance with routines shown in FIGS. 2 and 3. A start discriminating routine of FIG. 2 is repeated every predetermined crank angle (for example, every 30° CA). In step 111, whether the engine speed NE exceeds a predetermined speed (for instance, 500 rpm) or not is discriminated. If the Engine speed NE is equal to or lower than the predetermined speed, it is determined that the engine is being started and "1" is set to XSTOK in step 112. If the engine speed NE exceeds the predetermined speed, it is determined that the starting has been completed and "0" is set to XSTOK in step 113. The start flag XSTOK is set to "1" by an initializing process when an ignition switch (not shown) is turned on. A fuel pressure control routine shown in FIG. 3 is also repeate every predetermined crank angle (for example, every 30° CA). When the routine starts, first in step 101, whether the value of a crank angle counter CCRNK is either 0, 6, 12, or 18, namely, whether the piston position of any cylinder is in suction TDC or not is discriminated. If "Yes", the processing advances to step 102, a cylinder counter CKITOU is increased, and the processing advances to step 103. On the other hand, if "No" in step 101, the processing advances to step 103 without increasing the cylinder counter CKITOU.

In steps 103 to 105 in FIG. 3, whether the following starting mode control execution conditions (1) to (3) are satisfied or not is discriminated:

(1) start flag XSTOK=1 (during starting operation) (step 103);

(2) the cooling water temperature THW is lower than a predetermined water temperature, that is, it is the cold start (step 104); and (3) the value of the cylinder counter CKITOU is equal to or smaller than a predetermined value (for instance, 4), that is, it is within, for instance, one cycle since a starter has been turned on (step 105).

When all of the conditions (1) to (3) are satisfied, the starting mode control execution conditions are satisfied. If even only one condition is not satisfied, the starting mode control execution conditions are not satisfied. The starting mode control execution condition is not satisfied when the cooling water temperature THW at the time of starting is equal to or higher than the predetermined water temperature. This is for the reason that, if the cooling water temperature THW at the time of starting is equal to or higher than the predetermined water temperature, even if the air-fuel ratio of the mixture indicates the mixture leaner than that in case of cold engine start, the air-fuel ratio of the mixture lies within the combustion limit. When the starting mode control conditions are satisfied, the processing advances to step 109 and a fuel pressure P is set to a fuel pressure P2 higher than a fuel pressure P1 at the time of normal control. On the other hand, when the starting mode control conditions are not satisfied, the processing advances to step 110 and the fuel pressure P is set to the fuel pressure P1 at the time of normal control.

Figure 4:
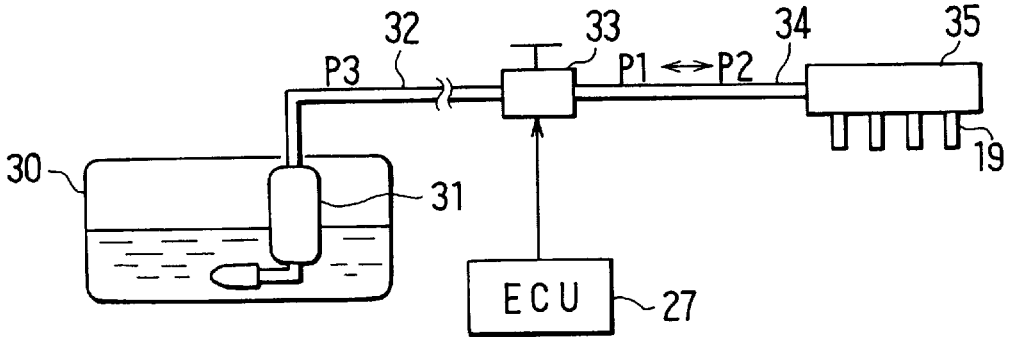
FIG. 4 is a diagram showing a fuel pressure varying system.

In order to make the fuel pressure variable, as shown in FIG. 4, fuel in a fuel tank 30 is pumped by a fuel pump 31 and delivered via a fuel pipe 32 to a pressure regulator 33. While the fuel pressure is being regulated by the pressure regulator 33, the fuel is sent to a delivery pipe 35 via a fuel pipe 34 and is distributed to fuel injection valves 19 of respective cylinders. In this case, the pressure regulator 33 is constructed so as to be switched to one of two kinds of fuel pressures P1 and P2. In accordance with the fuel pressure required by the ECU 27, the fuel pressure of the pressure regulator 33 is switched to P1 or P2. In this system, the relation among a discharge pressure P3 of the fuel pump 31 and the fuel pressures P1 and P2 is set to $P3 \geqq P2 > P1$.

Figure 5:
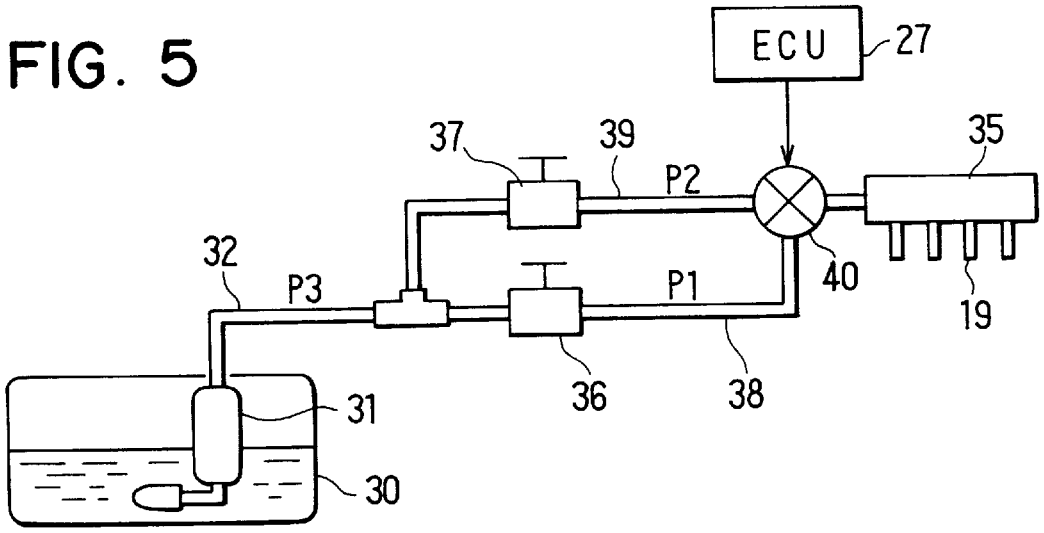
FIG. 5 is a diagram showing a another fuel pressure varying system.

Further, in a fuel pressure varying system shown in FIG. 5, pipes 38 and 39 of two pressure regulators 36 and 37 are connected in parallel to the fuel pipe 32, a passage switching valve 40 is provided at the junction of the pipes 38 and 39 on the downstream side. By switching the passage switching valve 40 in accordance with the requested fuel pressure from the ECU 27, the pressure regulator 36 or 37 for regulating the fuel pressure is switched and the fuel is sent to the delivery pipe 35 via the selected pressure regulator. In this case, the regulated fuel pressure of the pressure regulator 36 is P1 and that of the other pressure regulator 37 is P2. The passage switching valve 40 is switched as follows. When the required fuel pressure is P1, the fuel is allowed to flow via the pipe 38 of the pressure regulator 36. When the required fuel pressure is P2, the fuel is allowed to flow via the pipe 39 of the other pressure regulator 37.

In the fuel pressure varying system of FIG. 5, the passage switching valve 40 can be also provided at the junction on the upstream side of the two pipes 38 and 39. It is also possible that two fuel pumps are provided corresponding to the two pressure regulators 36 and 37 and discharge ports of the fuel pumps are connected to the pressure regulators 36 and 37 via the fuel pipes, respectively.

Figure 6:
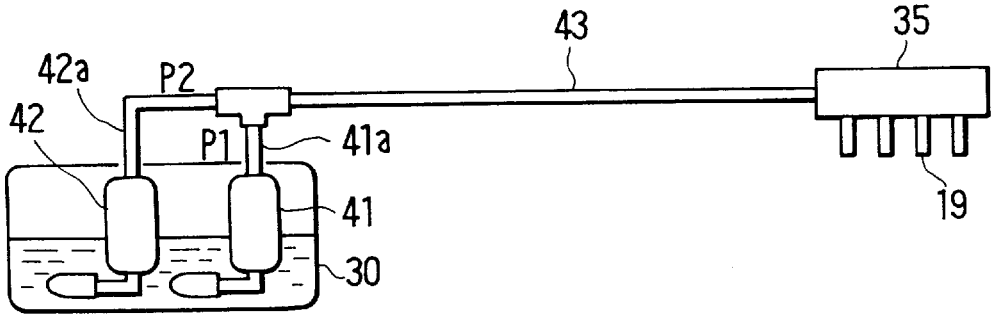
FIG. 6 is a diagram showing a further fuel pressure varying system.

In a fuel pressure varying system shown in FIG. 6, two fuel pumps 41 and 42 serving as fuel pressure regulating devices are provided and discharge pipes 41*a* and 42*a* of the two fuel pumps 41 and 42 are connected to a common fuel pipe 43. In this case, the discharge pressure of the fuel pump 41 is P1 and that of the other fuel pump 42 is P2. When the required fuel pressure is P1, the fuel pump 41 is driven. When the required fuel pressure is P2, the other fuel pump 42 is driven.

When it is constructed so that a discharge pressure (pump rotational speed) is adjusted by regulating an application voltage or a supply current to the fuel pump, a single fuel pump can correspond to a plurality of required fuel pressures.

The processing of a fuel injection period calculating routine will now be described with reference to FIG. 7. This routine is repeated, for example, every 4 m/sec. First in step 121, whether the start flag XSTOK is 0 (completion of starting) or not is discriminated. If XSTOK=0 (completion of starting), the routine advances to step 125 and a map data TAUSTc after completion of starting in FIG. 8 will be retrieved. The fuel injection period TAU is calculated from the map data TAUSTc after completion of starting in accordance with the cooling water temperature THW and the routine is finished.

On the other hancl, if XSTOK=1 (during starting operation), the processing routine advances to step 122 and whether the value of the cylinder counter CKITOU is smaller than a predetermined value (for instance, 4) or not is discriminated. When CKITOU<4, the processing advances to step 124, a map data TAUSTb of the starting mode in FIG. 8 is retrieved to calculate the fuel injection period TAU from the map TAUSTb of the starting mode in accordance with the cooling water temperature THW, and the routine is finished.

Figure 8:
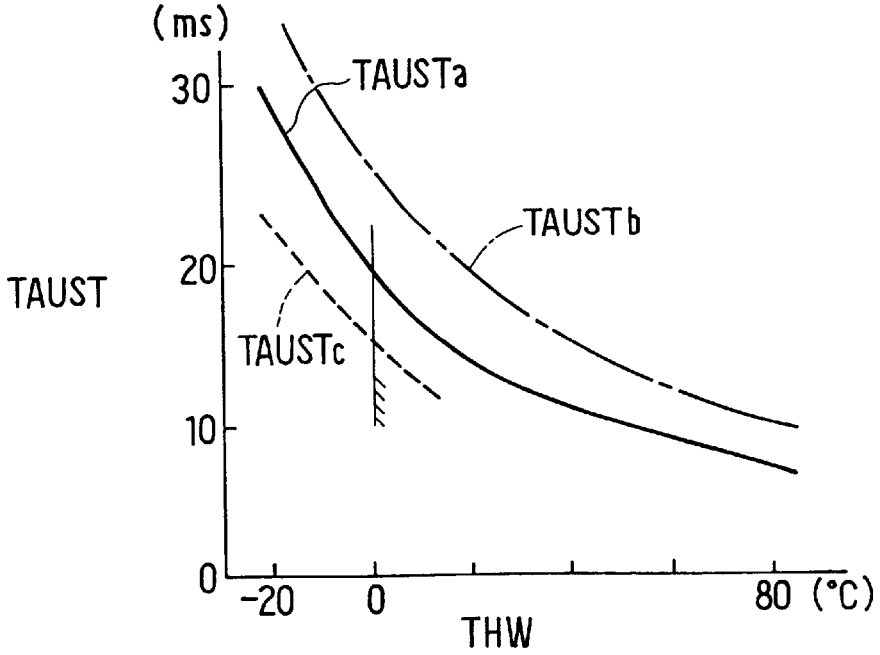
FIG. 8 is a graph showing a map for specifying the relation between cooling water temperature THW and fuel injection period TAUST.
Figure 9:
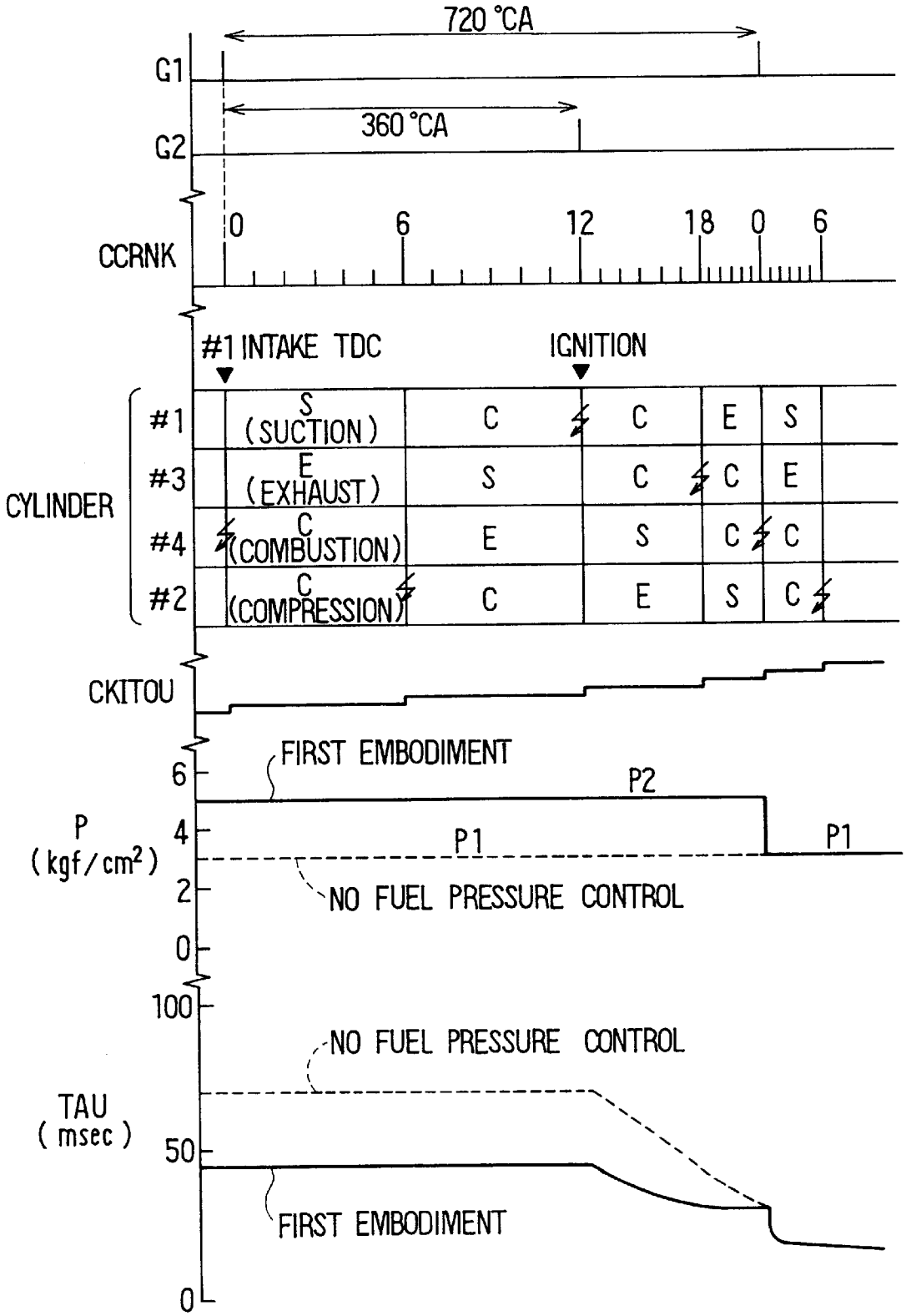
FIG. 9 is a time chart showing the transition of a control at the time of starting.

When CKITOU≧4, the routine advances to step 123, a map data TAUSTa of normal control in FIG. 8 is retrieved to calculate the fuel injection period TAU from the map data TAUSTa of the normal control in accordance with the cooling water temperature THW, and the routine is finished. By such a process, the operation shown in FIG. 9 is achieved and the air-fuel ratio of the mixture at the time of starting can be set within the combustion limit. In FIG. 9, G1 and G2 indicate cylinder discrimination signals.

According to the first embodiment, by increasing the fuel pressure, atomization of the fuel can be also promoted. In order to atomize the fuel, the number of nozzle holes of the fuel injection valve can be increased or the air can be collided with fuel.

Second Embodiment

Figure 10:
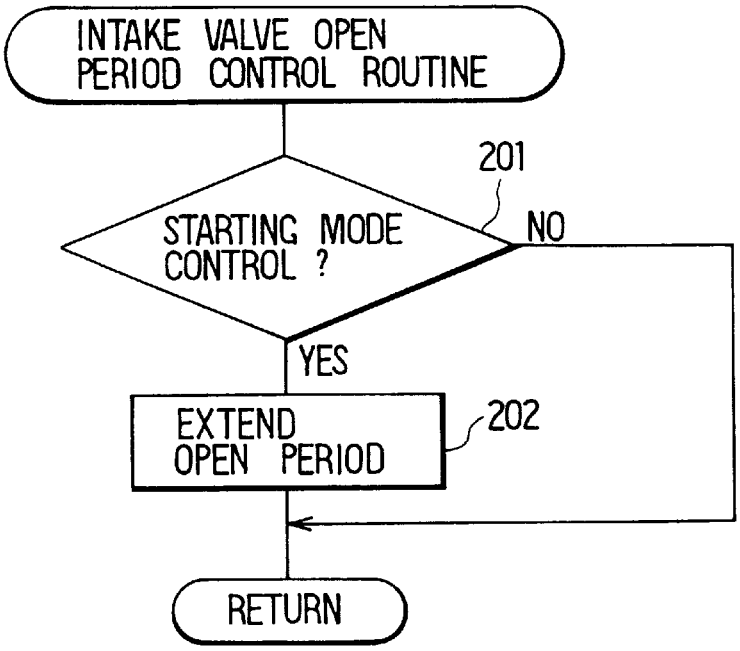
FIG. 10 is a flowchart showing the processing of an intake valve open period control routine according to a second embodiment of the present invention.
Figure 12:
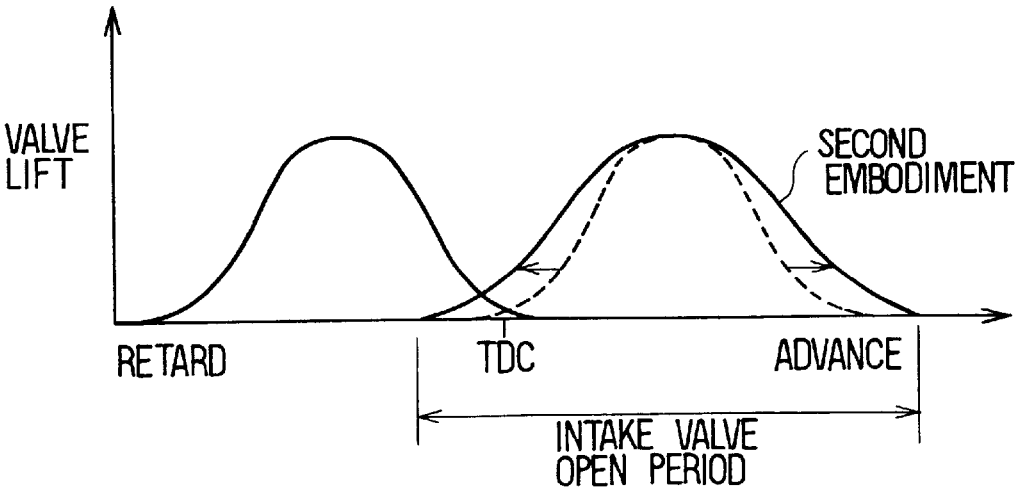
FIG. 12 is a time chart showing opening and closing timings of intake and exhaust valves.
Figure 11:
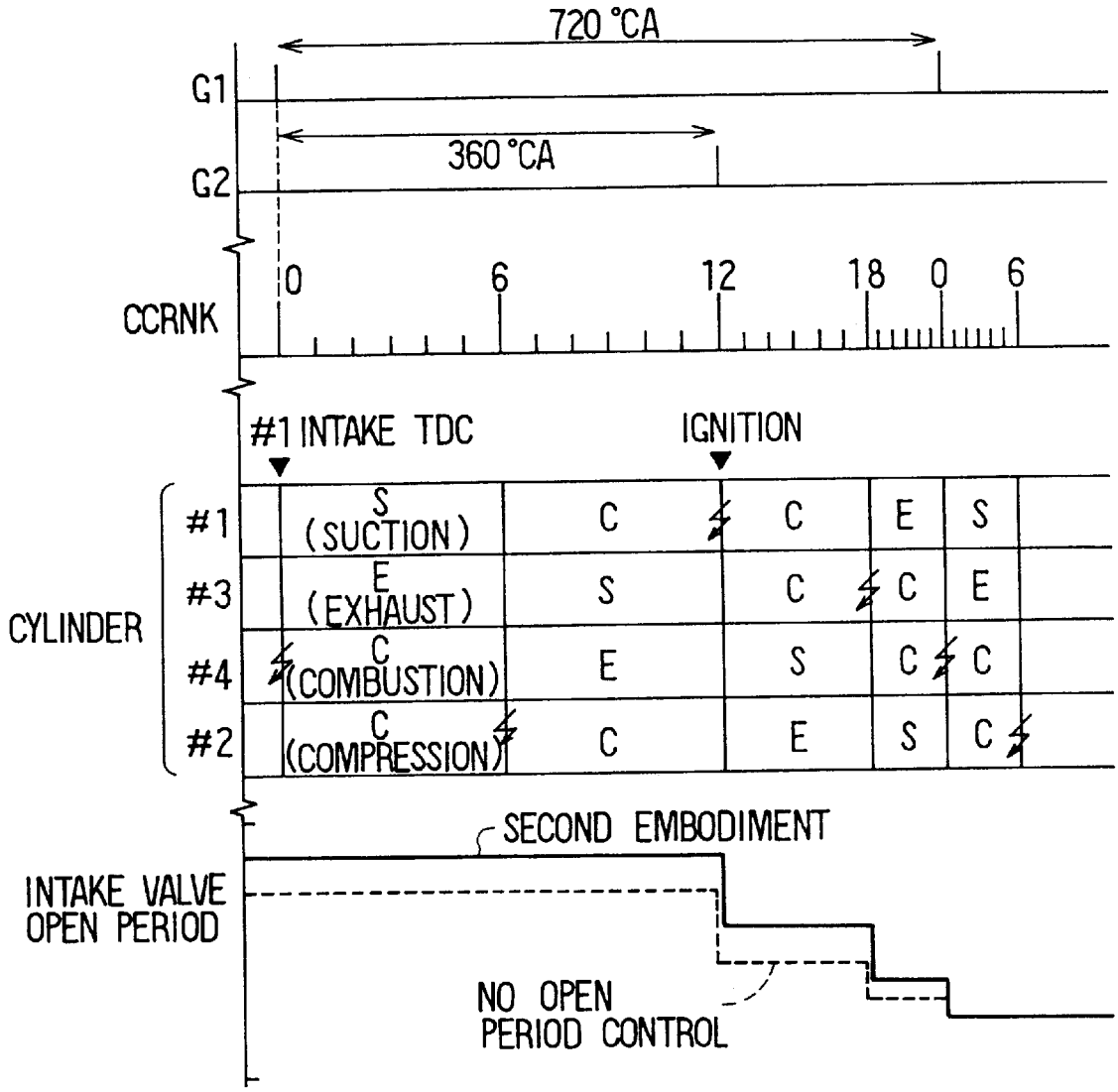
FIG. 11 is a time chart showing the transition of a control at the time of starting.

According to a second embodiment shown in FIGS. 10 to 12, it is so constructed as to regulate the open period of the intake valve 10*a* by an electric actuator. The fuel injection is carried out in the suction stroke at the time of starting. When the starting mode control execution conditions are satisfied in step 201, the open period of the intake valve is extended in step 202. In this manner, when the open period of the intake valve (that is, period of the suction stroke) is extended as shown in FIGS. 11 and 12. The fuel injection period at the time of starting can be accordingly extended, so that a large amount of fuel can be injected. As a result, only by the fuel injection in the suction stroke, sufficiently high fuel concentration mixture can be supplied into the combustion chamber from the beginning of the engine starting. The mixture from the cylinder at the first ignition timing can be burned in the event of starting.

As starting mode control execution conditions determined in step 201 in FIG. 10, the following conditions (1) to (5) can be considered. One of the conditions (1) to (5) can be used or two or more conditions may be also combined and used.

(1) The value of the cylinder counter CKITOU is equal to or smaller than a predetermined value (for example, 4), that is, it is within one cycle (suction, compression, combustion, exhaust) from the turn-on of the starter;

(2) There quested fuel in jection period is longer than the open period of the intake valve (the valve open period is calculated from the engine speed NE);

(3) The start flag XSTOK=1 (during starting);

(4) The value of the cylinder counter CKITOU is 3 or 4 (in the case where the valve open period is extended only for the third and fourth cylinders from the turn-on of the starter); and (5) The cylinder counter CKITOU≧3 and start flag XSTOK=1 (during starting) (when the valve open period is extended from the third cylinder to the completion of starting).

Third Embodiment

Figure 13:
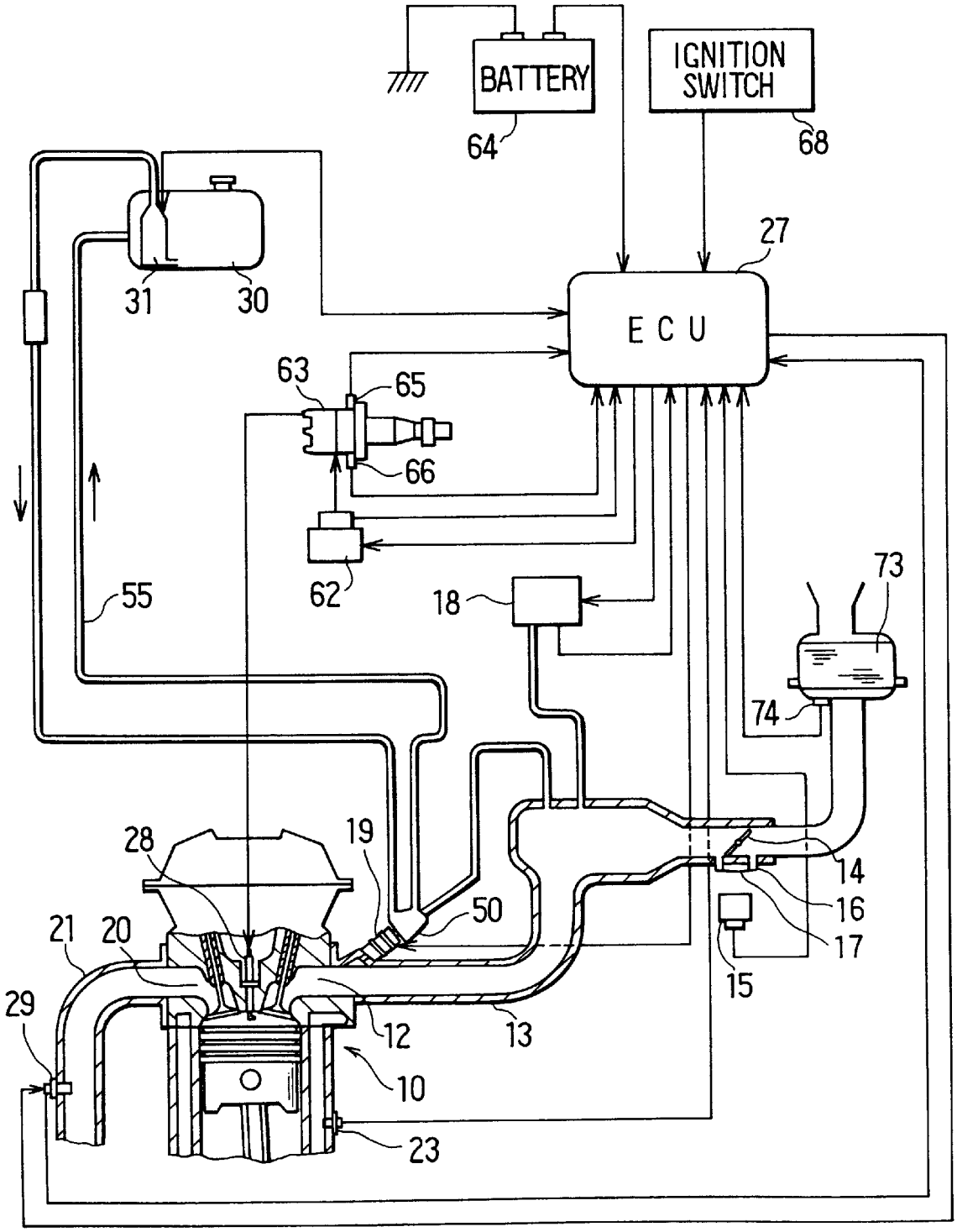
FIG. 13 is a schematic diagram showing a fuel injection control system according to a third embodiment of the present invention.

According to a third embodiment, as shown in FIG. 13, an air cleaner 73 is provided at the uppermost stream part of the intake pipe 13 connected to the intake port 12 of the internal combustion engine 10 and an intake air temperature sensor 74 is provided downstream of the air cleaner 73.

Fuel in the fuel tank 30 is distributed to the fuel injection valve 19 of each cylinder via a route of the fuel pump 31, the fuel filter, and a pressure regulator 50. The fuel pressure is kept to be constant with respect to an intake air pressure by the pressure regulator 50 and a surplus fuel is returned via a return pipe 55 to the fuel tank 30.

A oxygen concentration sensor 29 for sensing the concentration of oxygen in the exhaust gas is attached to the exhaust pipe 21 connected to the exhaust port 20 of the engine 10. A high voltage is applied to the spark plug 28 of each cylinder by an ignition coil 62 with an igniter and a distributor 63 to ignite the spark plug 28.

The distributor 63 has therein a crank angle sensor 65 and a cylinder discriminating sensor 66. The crank angle sensor 65 generates a crank angle signal every predetermined crank angle in response to the rotation of the crankshaft of the engine 10 so that the engine speed is detected from the frequency of the crank angle signal. The cylinder discriminating sensor 66 generates a cylinder discrimination signal (G1, G2) at a crank angle reference position of a specific cylinder (for example, compression TDC of the first #1 cylinder and compression TDC of the fourth #4 cylinder with the rotation of the camshaft of the engine 10. The cylinder discrimination signal is used to discriminate a cylinder.

Output signals oE various sensors such as the crank angle sensor 65, cylinder discriminating sensor 66, and water temperature sensor 23 are supplied to the ECU 27. The ECU 27 is operated by a battery 64 as a power source, drives a starter (not shown) by a turn-on signal of an ignition switch 68, controls the fuel injection amount by regulating the open period of the fuel injection valve 19 of each cylinder (fuel injection amount), and starts the engine 10. The ECU 27 determines a cylinder from other cylinders on the basis of output signals of the crank angle sensor 65 and the cylinder discriminating sensor 66 and controls the fuel injection synchronized with the suction stroke from the first fuel injection at the time of engine starting.

The ECU 27 comprises a microcomputer as a main body and has therein a ROM (storing medium) storing routines for fuel injection control which will be described hereinlater. The processing of the routLnes will be described hereinbelow.

[Starting Time Fuel Injection Control Routine]

Figure 14:
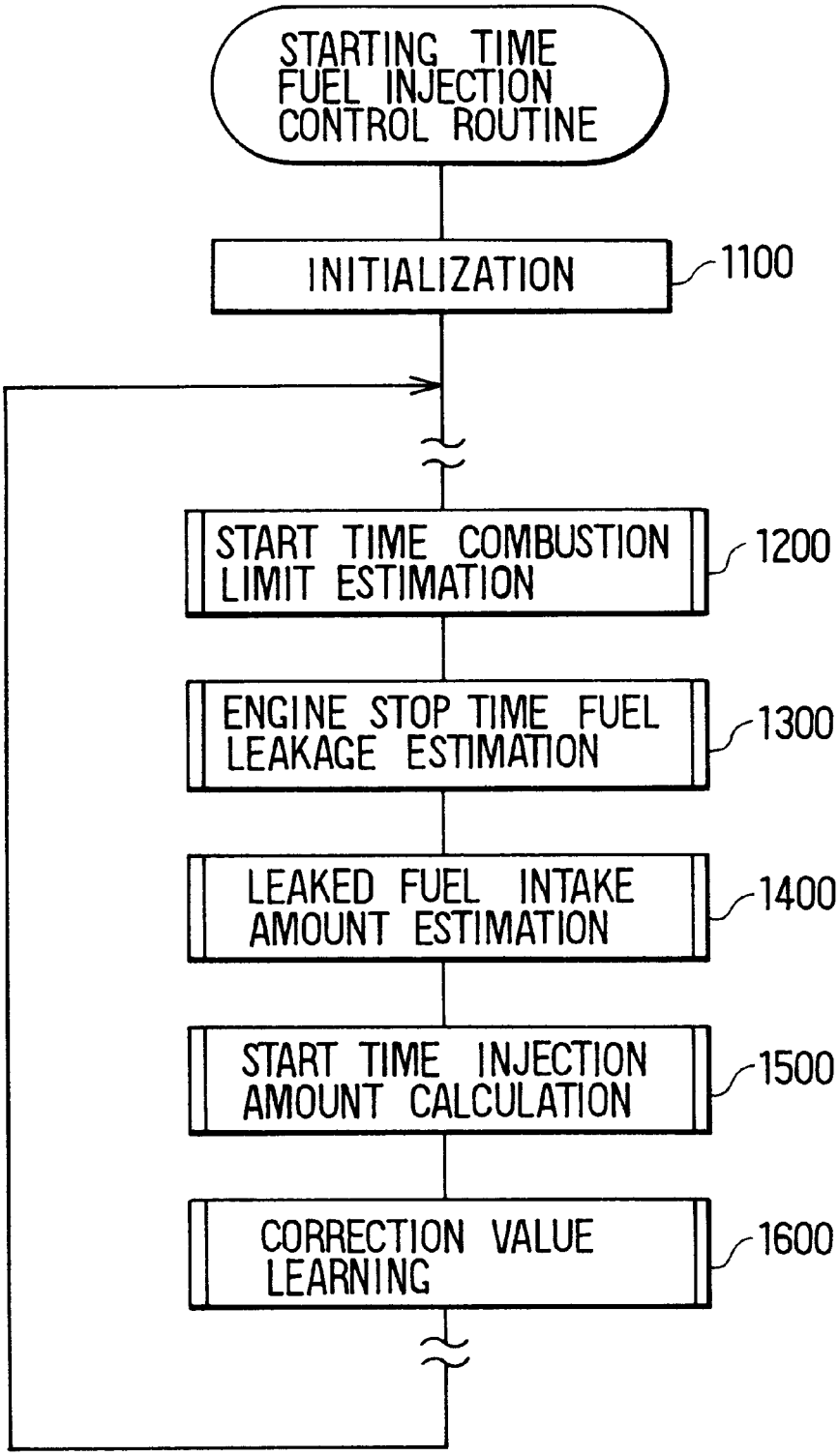
FIG. 14 is a flowchart showing the processing of a starting time fuel injection control routine.

A starting time fuel injection control main routine shown in FIG. 14 is executed as follows every predetermined time (for example, 4 m/sec) after turning on the ignition switch 68. First in step 1100, an initializing processing is executed. Initial values are set in storing areas of a RAM and the like and various input signals are checked up. In step 1200, a starting time combustion limit estimating routine of FIG. 15 which will be described hereinlater is executed to estimate the limit of the air-fuel ratio in which the mixture in the cylinder can be burned on the basis of a cooling water temperature of the engine 10.

After that, the routine advances to step 1300 where an engine stop period fuel leakage amount estimating routine of FIG. 18 which will be described hereinlater is executed to estimate the total amount of the fuel leaked from the fuel injection valve 19 during engine stop. In step 1400, a leaked fuel intake amount estimating routine of FIG. 23 which will be described hereinlater is executed to estimate the leaked fuel intake amount which is an amount taken by one cylinder out of the fuel leaked from the fuel injection valve 19.

In the following step 1500, a starting time injection amount calculating routine of FIG. 24 which will be described hereinlater is executed. The fuel injection amount at the starting time is calculated so that the air-fuel ratio of the intake mixture at the starting time is within the starting time combustion limit derived in step 1200 in consideration of the leaked fuel intake amount obtained in step 1400. The fuel of the calculated starting time fuel injection amount is injected synchronously with the suction stroke of each cylinder from the first fuel injection.

After that, the routine proceeds to step 1600. A correction value learning routine of FIG. 26 which will be described hereinlater is executed to determine a combustion state of the injected fuel of the first time and to learn a correction value for reflecting the combustion state in the fuel injection amount calculation at the next starting time. At the time of starting, the processes of steps 1200 to 1600 are repeatedly performed.

[Starting Time Combustion Limit Estimating Routine]

Figure 15:
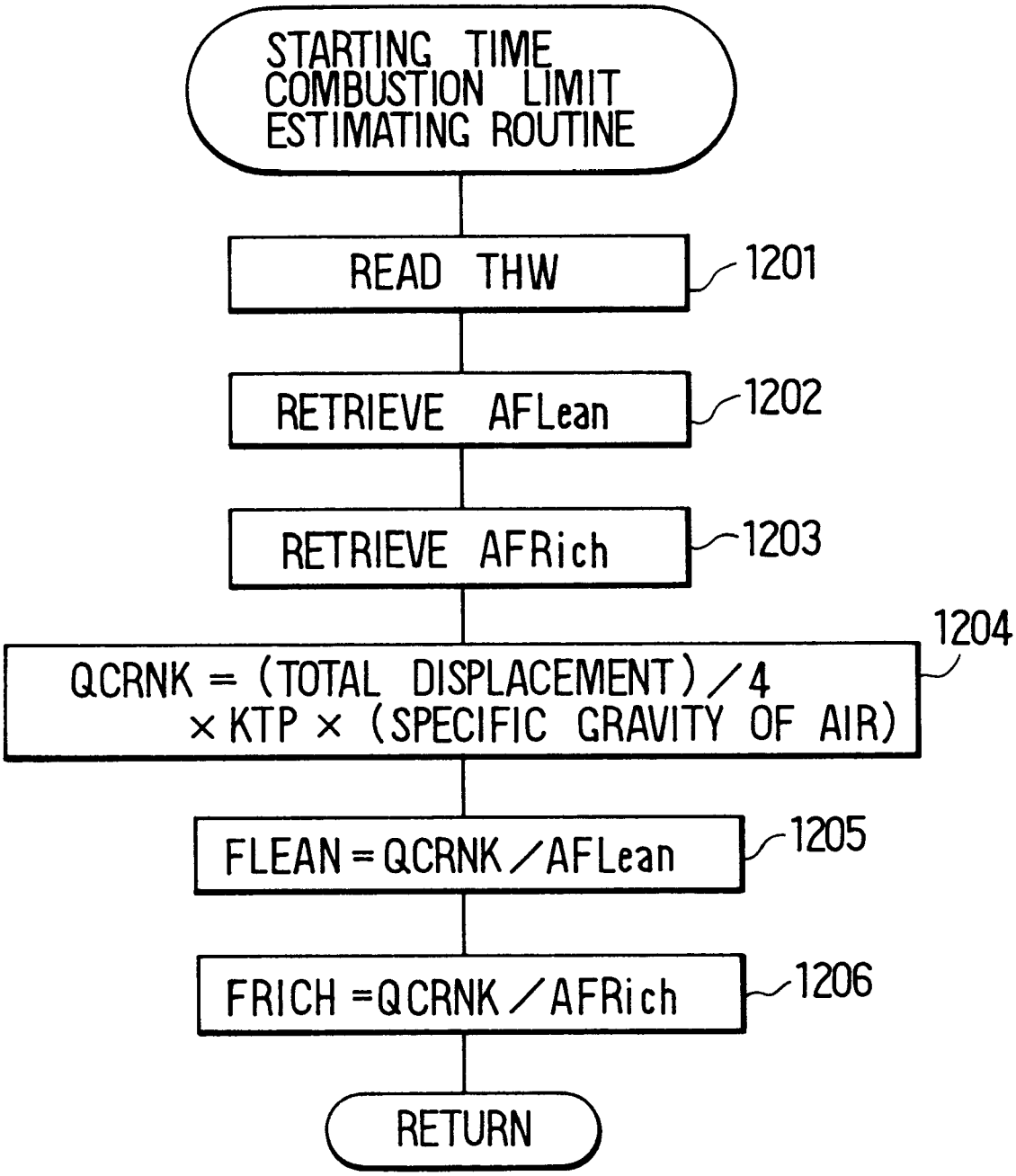
FIG. 15 is a flowchart showing the processing of a starting time combustion limit estimating routine.
Figures 16, 17:
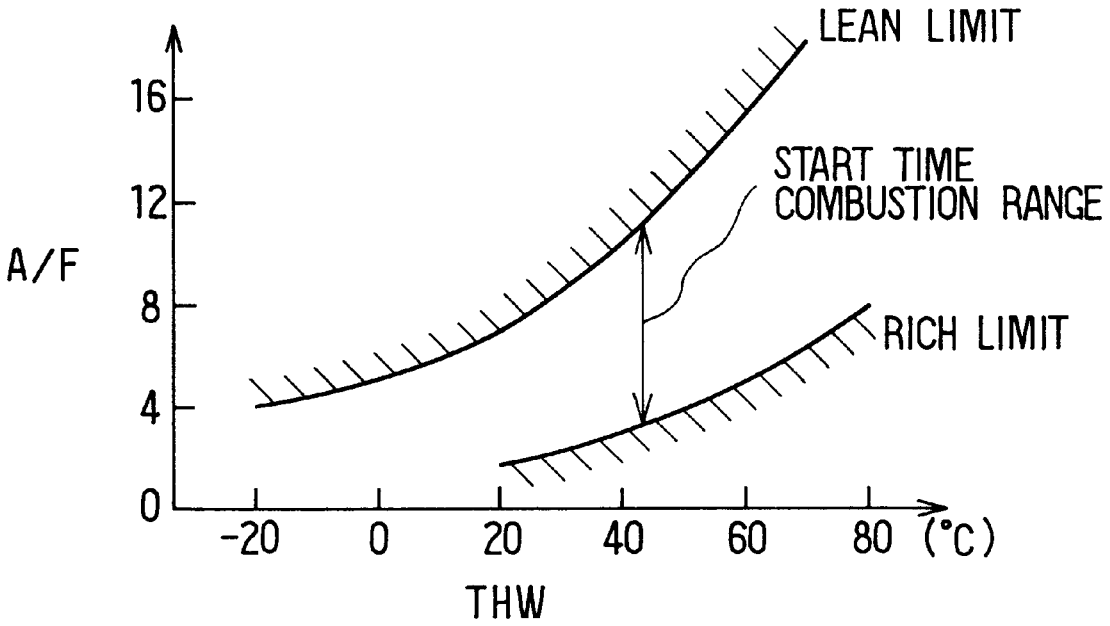
FIG. 16 is a diagram showing a starting time combustion limit.
FIG. 17 is a table showing a charging efficiency map.

The starting time combustion limit estimating routine shown in FIG. 15 (step 1200 in FIG. 14) is carried out, for instance, every 8 m/sec as follows. First in step 1201, the cooling water temperature TWH sensed by the water temperature sensor 23 is read. In step 1202, a map data of a lean limit curve of the starting time combustion limit using the cooling water temperature THW as a parameter shown in FIG. 16 is retrieved and a lean limit AFLean of the starting time combustion limit according to the present cooling water temperature THW is obtained. The lean limit AFLean of the starling time combustion limit is a lean limit of the air-fuel ratio at which the mixture taken into a cylinder at the starting time can be perfectly burned. A mixture leaner than the lean limit is imperfectly burned.

In step 1203, a map of a rich limit curve of the starting time combustion limit using the cooling water temperature THW as a parameter shown in FIG. 16 is retrieved and a rich limit AFRich of the starting time combustion limit according to the present cooling water temperature THW is obtained. The rich limit AFRich of the starting time combustion limit is a rich limit of the air-fuel ratio at which the mixture taken into a cylinder at the starting time can be perfectly burned. A mixture richer than the rich limit is imperfectly burned. The maps of the lean and rich limit curves shown in FIG. 16 are preliminarily set by experimental data or a theoretical expression and are stored in the ROM in the ECU 27.

Instep 1204, an intake air amount QCRNK [g] per cylinder at the time of cranking is calculated by the following equation.

$$QCRNK=(\text{total displacement})/4\times KTP\times(\text{specific gravity of air}) \quad [g]$$

where, "4" denotes the number of cylinders of the engine 10 and KTP indicates a charging efficiency. The charging efficiency KTP is obtained from a charging efficiency map using the engine speed NE and the intake air pressure PM as parameters shown in FIG. 17. The charging efficiency map is preliminarily set by experiment or a theoretical calculation and stored in the ROM in the ECU 27.

After calculating the intake air amount QCRNK, the routine advances to step 1205 and a lean limit fuel amount FLEAN [g] corresponding to the lean limit AFLean derived in step 1202 is calculated by the following equation.

$$FLEAN=QCRNK/AFLean \quad [g]$$

After that, the program proceeds to step 1206, a rich limit fuel amount FRICH [g] corresponding to the rich limit AFRich derived in step 1203 is calculated by the following equation, and the routine is finished.

$$FRICH=QCRNK/AFRich \quad [g]$$

The lean and rich limit fuel amounts FLEAN and FRICH can be obtained from a map data preliminarily formed in accordance with the cooling water temperature THW or the like. However, the engine speed NE at the time of engine cranking fluctuates depending on the battery voltage and the viscosity of oil and the intake air amount QCRNK fluctuates accordingly. When the lean and rich limit fuel amounts FLEAN and FRICH are calculated by using the lean and rich limits AFLean and AFRich derived according to the cooling water temperature THW and the intake air amount QCRNK in a manner similar to the routine, even if the intake air amount QCRNK fluctuates, the lean and rich limit fuel amounts FLEAN and FRICH can be calculated with high accuracy.

It is also possible to form data maps of the lean and rich limit fuel amounts FLEAN and FRICH using the cooling water temperature THW and the intake air amount QCRNK (or engine speed NE and intake pipe air pressure PM) as parameters on the basis of experiment or a theoretical calculation and to obtain the lean and rich limit fuel amounts FLEAN and FRICH from the maps.

[Engine Stop Period Leaked Fuel Amount Estimating Routine]

Figure 18:
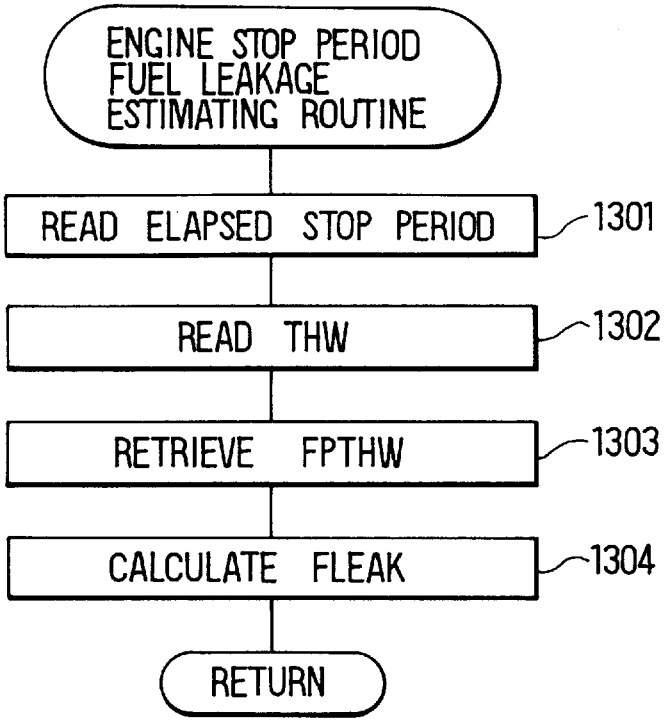
FIG. 18 is a flowchart showing the processing of an engine stop period fuel leakage amount estimating routine.

The engine stop period leaked fuel amount estimating routine (step 1300 in FIG. 14) shown in FIG. 18 is executed, for example, every 50 m/sec by a backup power source even when the engine is stopped. The total amount (leaked fuel integrated value FLEAK) of the fuel leaked from the fuel injection valves 19 of all of the cylinders during the engine stop is calculated as follows. In step 1301, an elapsed period from the previous engine stop (turn-off of the ignition switch 68) to the present is measured by a stop period measuring timer (not shown), the elapsed period (stop period) is read, and instep 1302, the present cooling water temperature THW is read.

Figure 19:
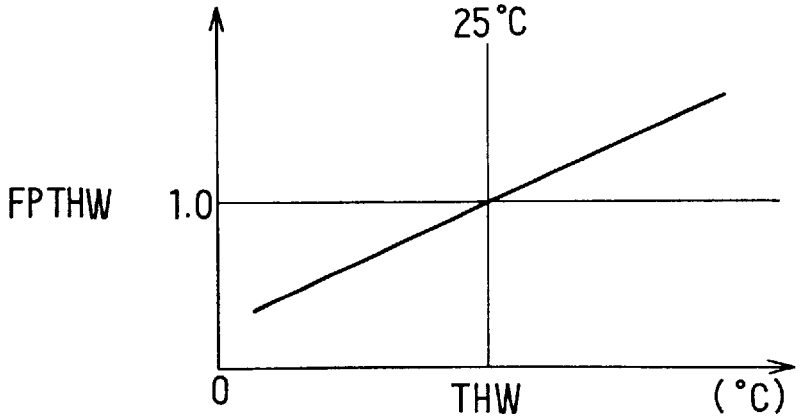
FIG. 19 is a graph showing the relation between cooling water temperature THW and a water temperature correction value FPTHW.
Figure 20:
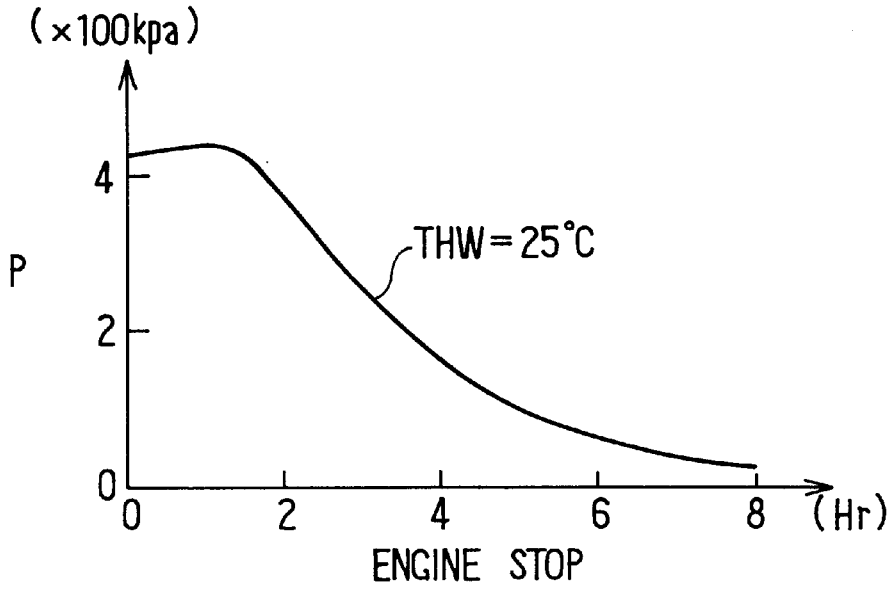
FIG. 20 is a graph showing the relation between engine stop period and fuel pressure.
Figure 21:
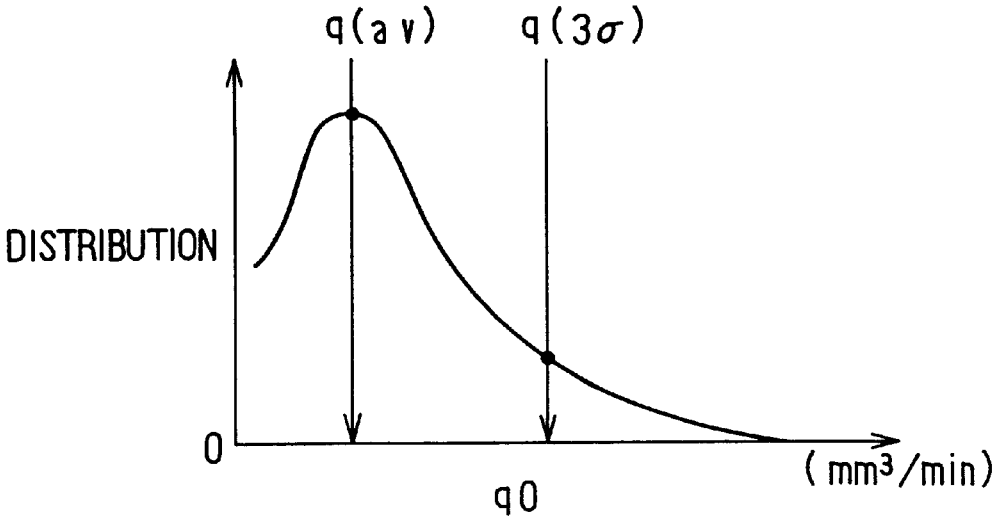
FIG. 21 is a graph showing the distribution characteristic of a total fuel leakages amount of a fuel injection valve.

Thereafter, the routine advances to step 1303, a map data of a water temperature correction value FPTHW using the cooling water temperature THW as a parameter shown in FIG. 19 is retrieved and the water temperature correction value FPTHW according to the present cooling water temperature THW is obtained. In step 1304, the leaked fuel integrated value FLEAK is calculated by the following equations using the water temperature correction value FPTHW.

$$q25(P)=(a\times q0-b)\times p^{1/c} \quad (1)$$

$$FLEAK=\Sigma\{q25(P)\}\times FPTHW \quad (2)$$

where, a, b, and c are conversion constants for obtaining the fuel leakage amount from a fuel pressure characteristic which is different according to a fuel supply system. P is a present fuel pressure (kPa). By retrieving a map data of a fuel pressure change characteristic using an engine stop period as a parameter shown in FIG. 20, the fuel pressure P according to the stop period until present time is obtained. q0 is a total amount ($mm^3$/min) of the fuel leaked from the fuel injection valves 19 of all of the cylinders per minute at a reference temperature (for instance, 25° C.) and a reference fuel pressure. The total fuel leakage amount q0 shows a distribution characteristic as shown in FIG. 21 and the variation central value q(av) and the variation upper limit value q(3σ) are obtained from the distribution characteristic.

By repeatedly calculating the equations (1) and (2) by using the backup power source during the engine stop, for example, every 50 m/sec., the fuel leaked from the fuel injection valves 19 of all of the cylinders during the engine stop is integrated and a leakage fuel integrated value FLEAK from the previous engine stop until present time is calculated. The leakage fuel integrated value FLEAK calculated in the beginning of starting (at the time of turn-on of the starter) is a total amount of the leakage fuel during the engine stop. In this case, by using the variation central value q(av) and the variation upper limit value q(3σ) of the total fuel leakage amount q0, the variation fuel central value FLEAK(av) and the variation upper limit value FLEAK(3σ) of the leaked fuel integrated value FLEAK are calculated.

Figure 22:
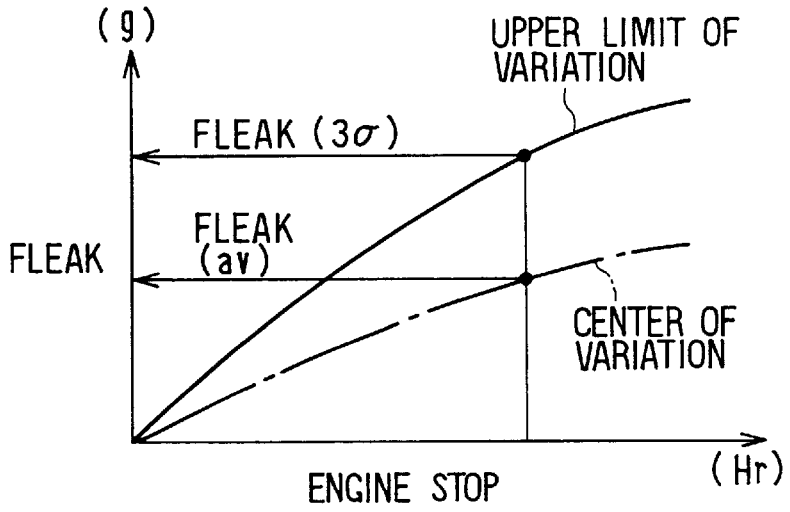
FIG. 22 is a graph showing the relation between the engine stop period and a leaked fuel integrated value FLEAK.

Although the fuel leakage is integrated during the engine stop in the routine, as shown in FIG. 22, it is also possible to preliminarily form a data map of the fuel leakage integrated value FLEAK using the engine stop period as a parameter by experimental data or a theoretical calculation, store the map in the ROM in the ECU 27, retrieve the map data in the beginning of starting (at the time of turn-on of the starter), and obtain the leakage fuel integrated value FLEAK according to the engine stop period.

[Leakage Fuel Intake Amount Estimating Routine]

Figure 23:
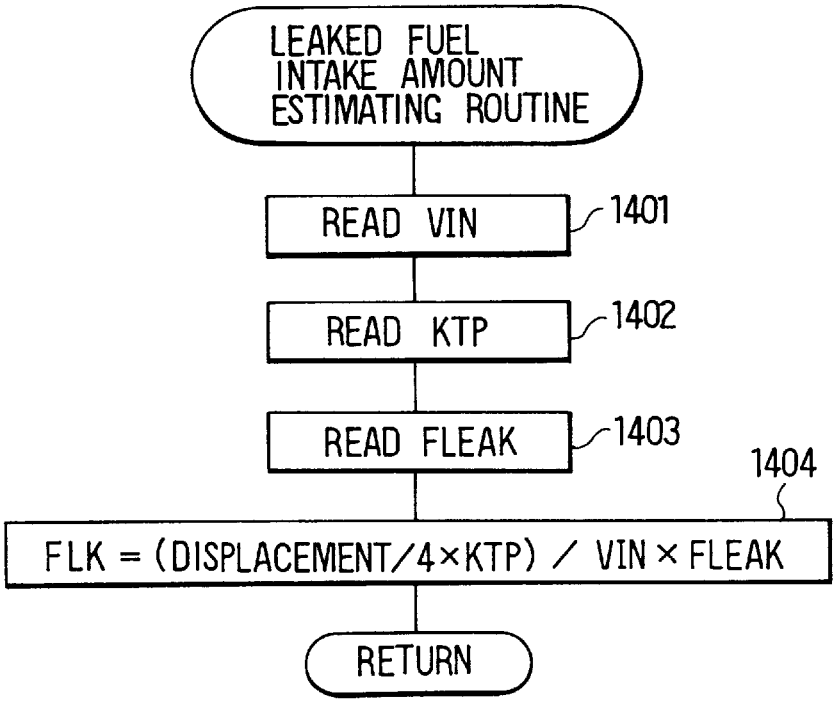
FIG. 23 is a flowchart showing the processing of a leaked fuel intake amount estimating routine.

A leakage fuel intake amount estimating routine shown in FIG. 23 (step 1400 in FIG. 14) is executed, for instance, every 16 m/sec. to estimate the leakage fuel intake amount per cylinder as follows. First in step 1401, an intake pipe capacity VIN is read. The intake pipe capacity VIN in this case denotes a whole capacity from the intake port 12 of the intake pipe 13 to the air cleaner 73 in which the fuel leaked during the engine stop is estimated to be spread with the elapse of time. After reading the charging efficiency KTP obtained by the starting time combustion limit estimating routine in step 1402, the leakage fuel integrated value FLEAK calculated by the engine stop period leaked fuel amount estimating routine is read in step 1403.

After that, in step 1404, the leakage fuel intake amount FLK sucked by one cylinder out of the leaked fuel is calculated by the following equation.

$$FLK=(\text{engine displacement}/4\times KTP)/VIN\times FLEAK$$

That is, it is estimated that the fuel leaked during the engine stop is spread in the whole intake pipe 13 and the leaked fuel integrated value FLEAK is multiplied by the ratio of the intake air amount (engine displacement/4×KTP) of one cylinder in the intake pipe capacity VIN, thereby calculating the fuel intake amount FLK sucked by one cylinder.

In this case, by using the variation central value FLEAK (av) and the variation upper limit value FLEAK(3σ) of the leakage fuel integrated value FLEAK, the variation central value FLK(av) and the variation upper limit value FLK(3σ) of the leakage fuel intake amount FLK are calculated.

[Starting Time Injection Amount Calculating Routine]

Figure 24:
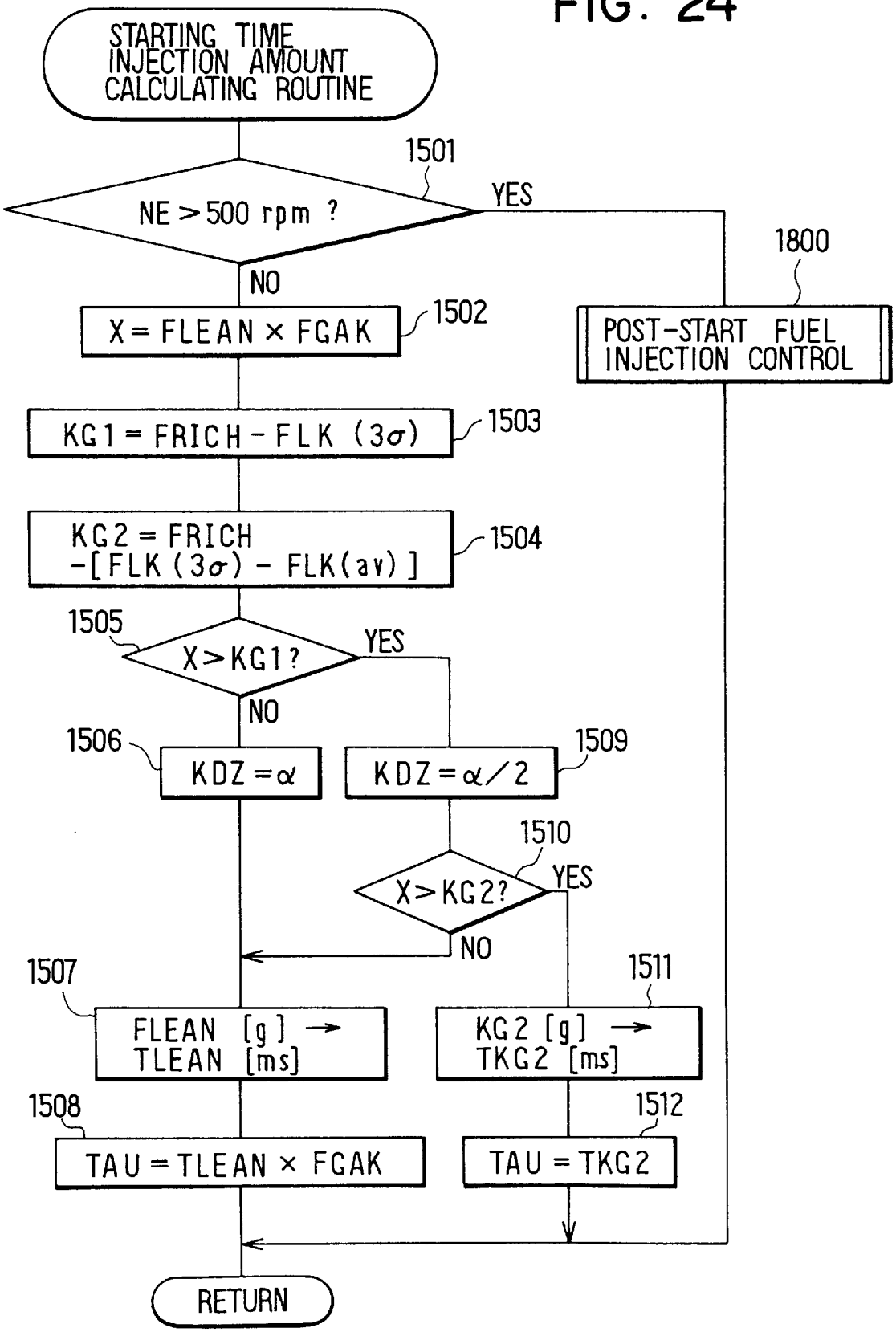
FIG. 24 is a flowchart showing the processing of a starting time injection amount calculating routine.

The starting time injection amount calculating routine (step 1500 in FIG. 14) shown in FIG. 24 is carried out every predetermined crank angle (for example, every 30° CA) and the fuel injection amount upon starting (starting time injection period TAU) is calculated as follows. In step 1501, whether the engine speed NE is higher than, for example, 500 rpm or not is discriminated. 500 rpm is a sufficient rotational speed to discriminate the completion of starting. If the engine speed NE is higher than 500 rpm, completion of starting is determined. The routine advances to step 1800 and an injection control post-starting which will be described hereinlater will be executed.

When the engine speed NE is smaller than 500 rpm in step 1501, it is determined that the starting has not been finished. The processing advances to step 1502 and the lean limit fuel amount FLEAN calculated in the starting time combustion limit estimating routine is multiplied by a learned correction value FGAK obtained by a correction value learning routine of FIG. 26 which will be described hereinlater, thereby calculating a temporary fuel injection amount X.

$$X=FLEAN\times FGAK$$

Figure 25:
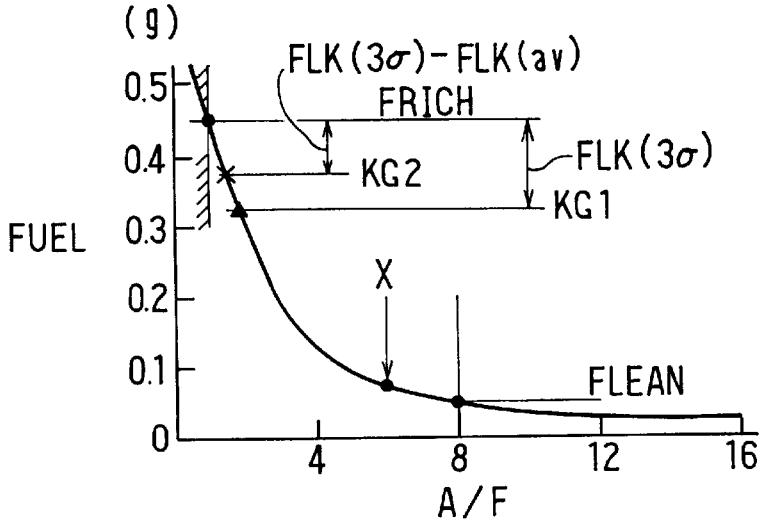
FIG. 25 is a graph showing a fuel injection amount at the time of starting.

Thereafter, the processing proceeds to step 1503 and a first rich limit injection amount KG1 (FIG. 25) when the variation upper limit value FLK (3σ) of the leakage fuel intake amount is considered is obtained by subtracting the variation upper limit value FLK (3σ) of the leakage fuel intake amount from the rich limit fuel amount FRICH.

$$KG1=FRICH-FLK(3\sigma)$$

Thereafter, the routine advances to step 1504 and a second rich limit injection amount KG2 (FIG. 25) is calculated by the following equation.

$$KG2=FRICH-\{FLK(3\sigma)-FLK(av)\}$$

where, {FLK(3σ)−FLK(av)} denotes a value obtained by subtracting the variation central value FLK(av) from the variation upper limit value FLK(3σ) of the leakage fuel intake amount, that is, a deviation between the variation central value FLK(av) and the variation upper limit value FLK(3σ).

When the temporary fuel injection amount X is compared with the first rich limit injection amount KG1 and it is determined as X≦KG1, that is, the temporary fuel injection amount X is positioned on the leaner side than the first rich limit injection amount KG1 in step 1505, the routine advances to step 1506 and a learned dither value KDZ used for the correction value learning routine of FIG. 26 which will be described hereinlater is set to a predetermined value α. After that, the program proceeds to step 1507 and the lean limit fuel amount FLEAN[g] is converted to a fuel injection period TLEAN[m/sec] of the fuel injection valve 19. In step 1508, the lean limit fuel injection period TLEAN is multiplied by the learned correction value FGAK, thereby calculating the starting time injection period TAU.

$$TAU=TLEAN\times FGAK$$

That is, the lean limit fuel injection period TLEAN is corrected by the learned correction value FGAK, thereby obtaining the starting time injection period TAU.

On the other hand, when X>KG1 is determined in step 1505, that is, when the temporary fuel injection amount X is on the richer side than the first rich limit injection amount KG1, the temporary fuel injection amount X is close to the rich limit fuel amount FRICH. It is therefore discriminated that the total amount of the fuel taken in the cylinders may exceed the rich limit fuel amount FRICH depending on the degree of variation of the leakage fuel intake amount and there is the possibility that a misfire occurs. The processing routine advances to step 1509, the learned dither value KDZ is switched to α/2 and the learned correction value FGAK is updated little by little.

Then, the processing advances to step 1510, when the temporary fuel injection amount X is compared with the second rich limit injection amount KG2 and X≦KG2 is discriminated, that is, when the temporary fuel injection amount X is on the leaner side than the second rich limit injection amount KG2, it is determined that there is no possibility of misfire. In a manner similar to the above case of X≦KG1, the processing advances to steps 1507 and 1508 and the lean limit fuel injection period TLEAN is corrected by the learned correction value FGAK, thereby acquiring the starting time injection period TAU.

On the contrary, when X>KG2 is discriminated in step 1510, that is, when the temporary fuel injection amount X is on the richer side than the second rich limit injection amount KG2, if the temporary fuel injection amount X is used as a fuel injection amount at the time of starting, there is the possibility that the total amount of the fuel taken into cylinders exceeds the rich limit fuel amount FRICH depending on the degree of variation in the leakage fuel intake amount and a misfire occurs. Consequently, the routine advances to step 1511 and the second rich limit injection amount KG2[g] is converted to the fuel injection period TKG2[m/sec] in order to guard the fuel injection amount upon starting by the second rich limit injection amount KG2. The fuel injection period TGK2 is used as the starting time injection period TAU in step 1512.

In the starting time injection period TAU calculated as described above, the ECU 27 injects the fuel synchronously with the suction stroke of each cylinder at the time of starting from the first fuel injection.

[Correction Value Learning Routine]

Figure 26:
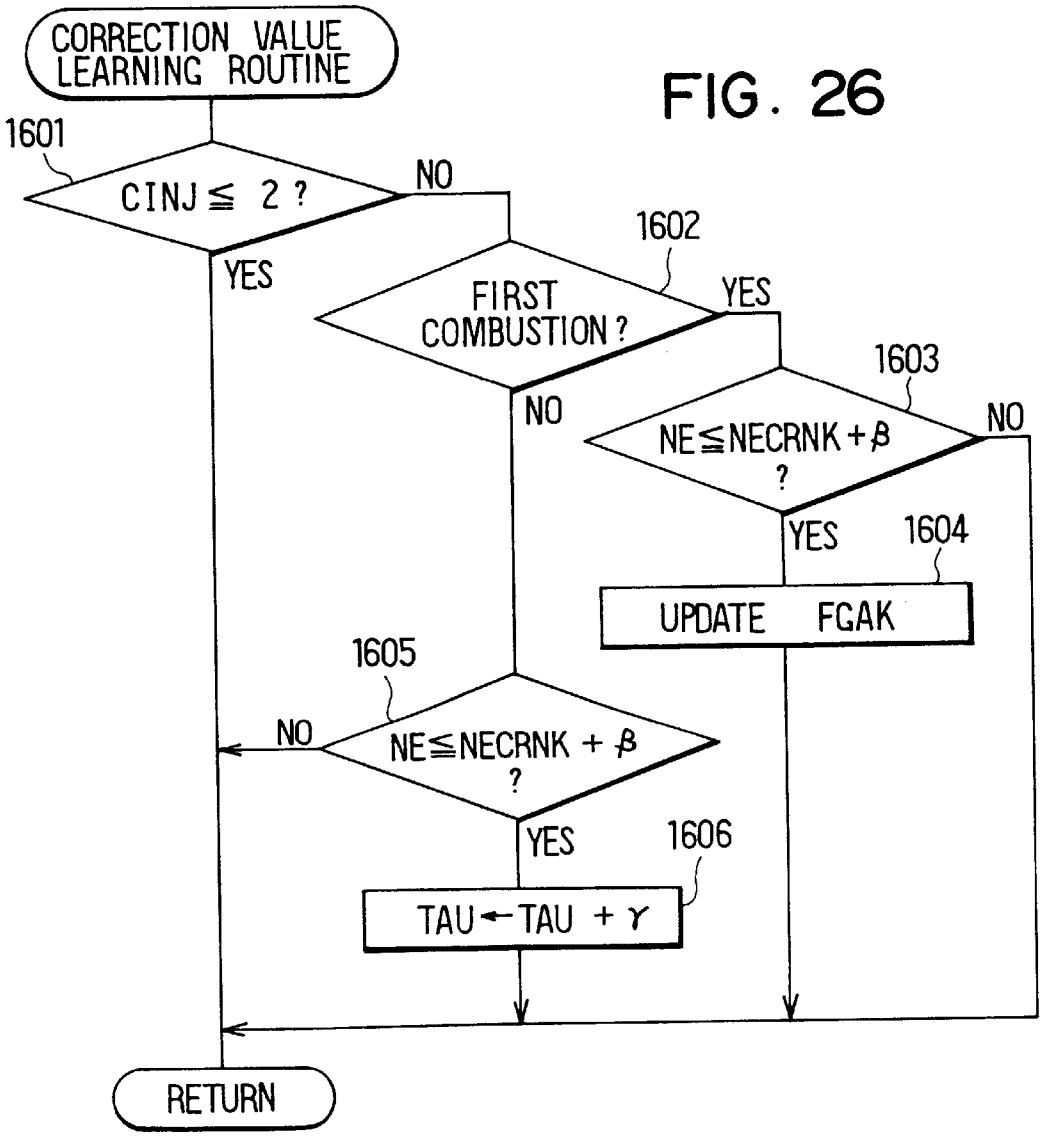
FIG. 26 is a flowchart showing the processing of a correction value learning routine.
Figure 27:
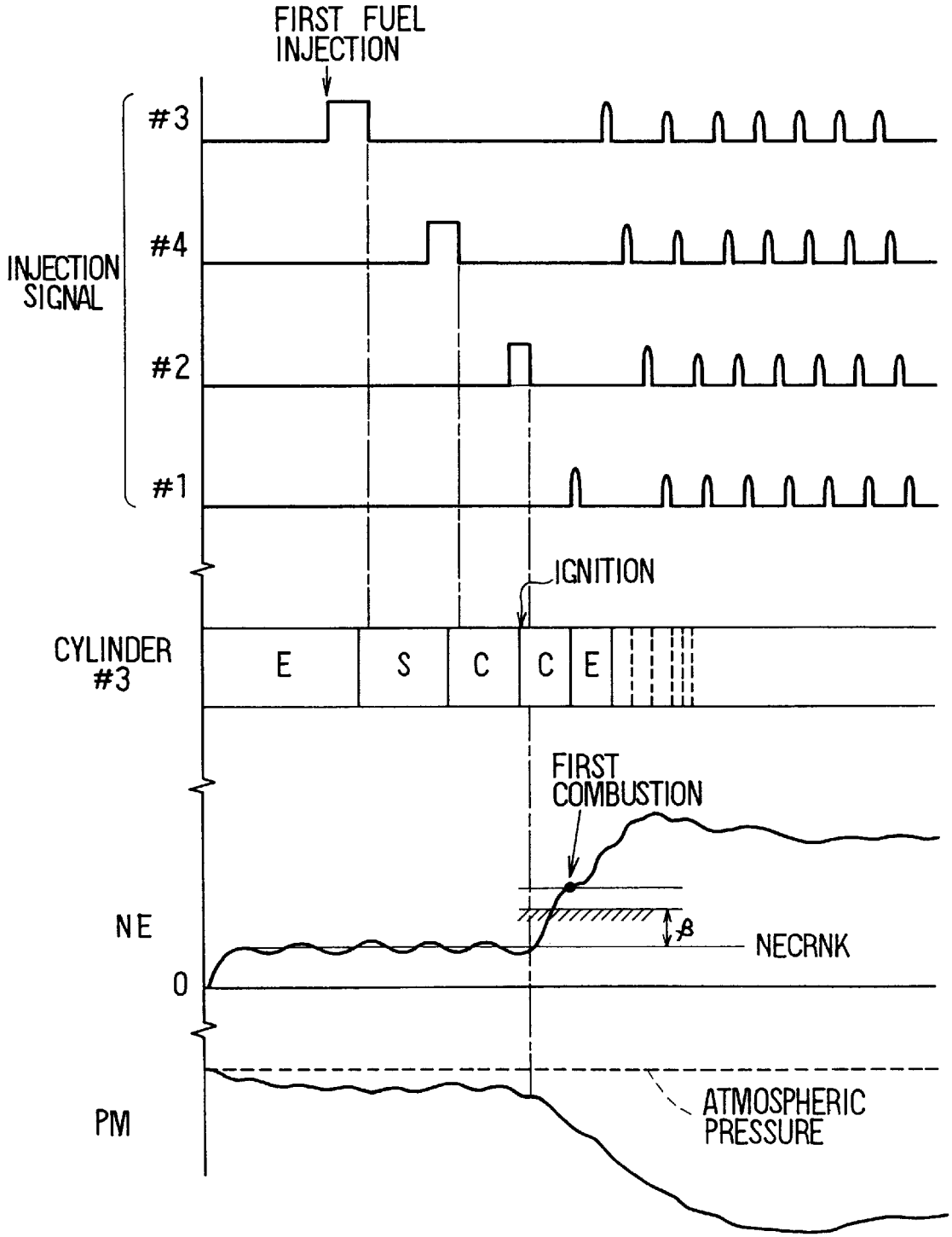
FIG. 27 is a time chart showing an example of the fuel injection control at the time of starting.

The correction value learning routine (step 1600 in FIG. 14) shown in FIG. 26 is executed, for instance, every 30° CA and the learned correction value FGAK is updated as follows. First in step 1601, whether the count value of a counter CINJ for counting the total number of injections of the fuel injection valves 19 of all of the cylinders after cranking is started is equal to 2 or smaller is discriminated. When the count value of the counter CINJ is 2 or smaller, that is, when the total number of injections is 2 or smaller, as shown in FIG. 27, the cylinder which performed the first fuel injection has not reached the first combustion stroke (c) and the first combustion state cannot be discriminated. Consequently, the routine is finished without carrying out the subsequent processes. As shown in FIG. 27, after discriminating the cylinder, for example, when the fuel injection is started synchronously with the suction stroke from a #3 cylinder upon starting, two strokes of suction (S) and compression (C) of the #3 cylinder (180° CA×2) are carried out and then the first combustion stroke is performed. Before the #3 cylinder reaches the first combustion stroke, the fuel injection is carried out in a #4 cylinder.

Figure 28:
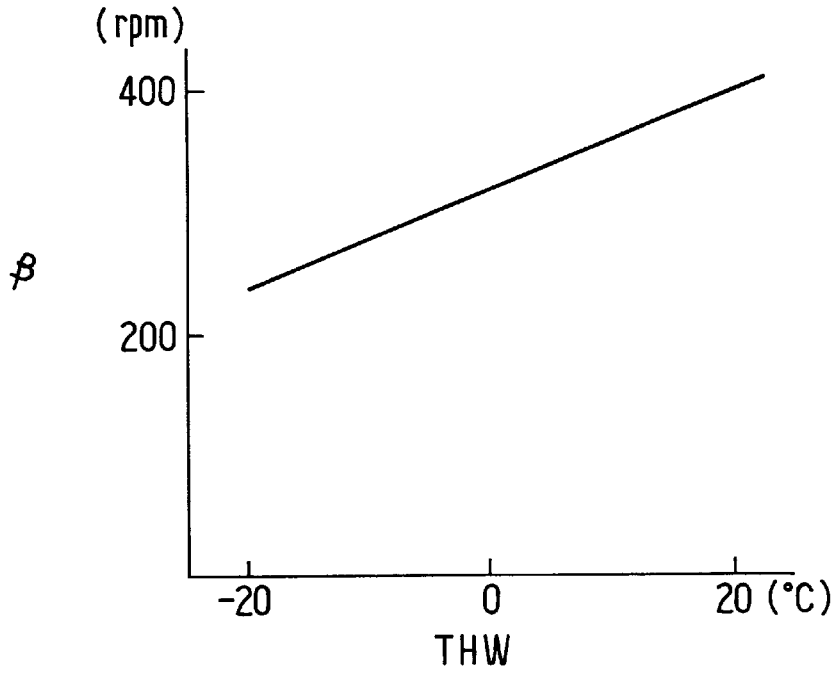
FIG. 28 is a graph showing the relation between the cooling water temperature THW and a rotational speed increase amount discrimination value β.

On the other hand, in step 1601, when the count value of the counter CINJ exceeds 2 (the total injection number is three or larger), it is determined that the injected fuel can be burned. The routine advances to step 1602 and whether it is a first combustion point at which the first injected fuel is burned or not is determined. If Yes, the routine advances to step 1603 and whether the engine speed NE is equal to or lower than a predetermined speed (NECRNK+β) or not is discriminated in order to determine whether the first combustion state is proper or not. NECRNK is an average value of the cranking speeds and β is a rotational speed increase amount discrimination value at the time of proper combustion. The rotational speed increase amount discrimination value β is obtained according to the present cooling water temperature THW from a map data using the cooling water temperature THW as a parameter shown in FIG. 28. By the process of step 1603, the combustion state is discriminated.

Since the engine speed NE at the time of starting increases according to the degree of combustion when the first injected fuel is burned, by comparing the engine speed NE at the first combustion point with the rotational speed lower limit (NECRNK+β) at the time of proper combustion at which a sufficient torque can be generated, the first combustion state can be discriminated.

When {NE>NECRNK+β} is discriminated in step 1603, it is determined that the first combustion state is proper (complete combustion). Since it is unnecessary to correct the fuel injection amount at the next starting time, the routine is finished without updating the learned correction value FGAK.

On the contrary, when {NE≦NECRNK+β} is discriminated in step 1603, it is determined that the first combustion state is not proper. The routine advances to step 1604 and the learned correction value FGAK is updated by the following equation.

$$FGAK(i)=(FGAK(i-1)\times FLEAN+KDZ)/FLEAN$$

where, FGAK(i) is a learned correction value at this time and FGAK(i−1) is a previous learned correction value. The learned correction value FGAK is a value indicative of the degree of correction to the rich side with respect to the lean limit fuel amount FLEAN as a reference. KDZ is a learned dither value determined by the starting time injection amount calculating routine. When X≦KG1, KDZ=α is used. When X>KG1, KDZ=α/2 is used. The learned dither value KDZ used in the above equation is a dither value (correction amount) for the fuel injection amount (FGAK×FLEAN). When the learned dither value KDZ is set to a dither value for the learned correction value FGAK, it is sufficient to update the learned correction value FGAK by the following equation.

$$FGAK(i)=FGAK(i-1)+KDZ$$

The learned correction value FGAK updated in step 1604 is stored into a backup RAM (not shown) in the ECU 27, held even if the ignition switch 68 is turned off and used to calculate the starting time injection period TAU of the next time. Consequently, the fuel injection amount of the first time at the next starting time is increased to the rich side only by the learned dither value KDZ. Thus, the combustion state of the first time is improved.

On the other hand, when it is discriminated that the combustion point is nol the first combustion point (that is, when it is discriminated that the combustion is the second or afterward combustions) in step 1602, the routine advances to step 1605 and whether {NE≦NECRNK+β} or not is discriminated in a manner similar to step 1603. When NE≦NECRNK+β, it is determined that the combustion state of the second and afterward times is not proper. The routine advances to step 1606, a predetermined correction value γ is added to the starting time injection period TAU to thereby correct the starting time injection period TAU to the rich side and the routine is finished. The correction value γ is a value for correcting the starting time injection period TAU to the rich side by a proper amount and is preset by an experiment or the like.

When NE>NECRNK+β in step 1603, it is determined that the combustion state of the second and subsequent times is proper and the routine is finished.

Figure 29:
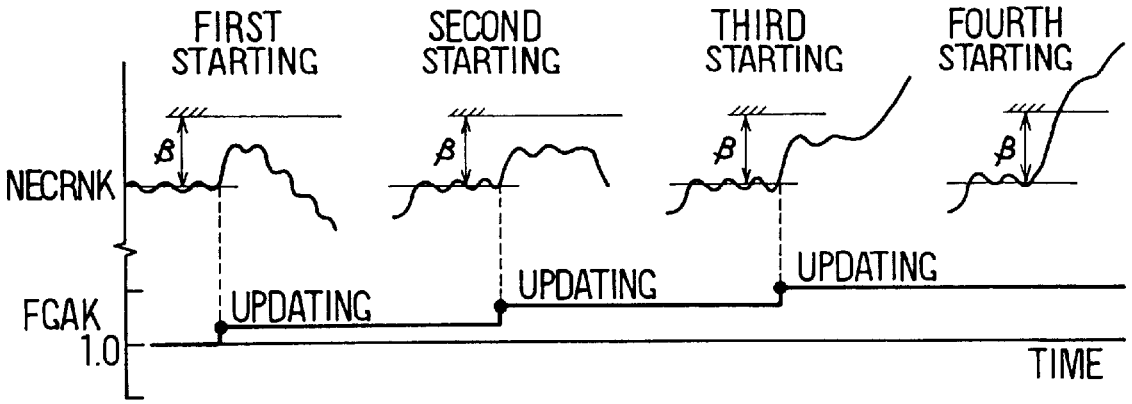
FIG. 29 is a time chart showing an example of a learning control at the time of starting.

The above learning process will be described with reference to a time chart of FIG. 29. Since the engine speed NE does not reach the predetermined value (NECRNK+β) at the first combustion point upon the first starting, the learned correction value FGAK (initial value is set to, for example, 1.0) is updated to the rich side in accordance with the learned dither value KDZ. In the example of FIG. 29, at the second and third starting times as well, the engine speed NE does not reach the predetermined value (NECRNK+β) at the first combustion point, so that the learned correction vaLue FGAK is sequentially updated. In this manner, the learned correction value FGAK is updated every starting and the combustion state is sequentially improved. When the engine speed NE reaches the predetermined value (NECRNK+β) for the first time upon the fourth starting, a proper combustion state is determined and the learned correction value FGAK is held at the value updated upon starting of the third time. In this manner, the fuel injection amount at the starting is optimized in accordance with the combustion state of the first time.

[Post-starting Injection Control Routine]

Figure 30:
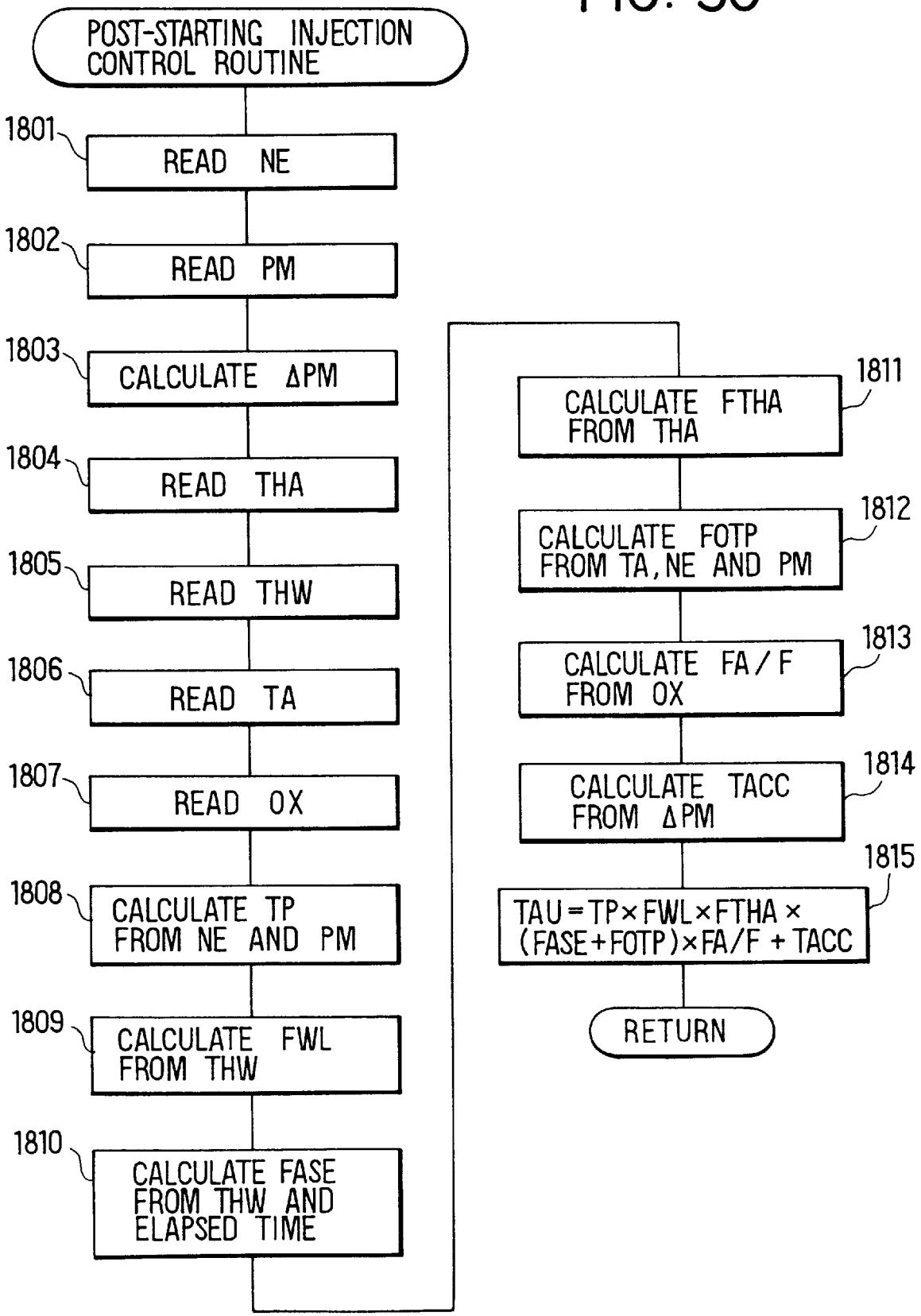
FIG. 30 is a flowchart showing the processing of a post-starting injection control routine.

The post-starting injection control routine (step 1800 in FIG. 24) shown in FIG. 30 is executed as follows, for example, every 30 CA°. After reading the engine speed NE and the intake pipe pressure PM in steps 1801 and 1802, an intake pipe pressure change amount ΔPM is calculated in step 1803. After that, the intake air temperature THA, the cooling water temperature THW, the throttle opening angle TA, and the concentration of oxygen Ox in the exhaust are detected in steps 1804 to 1807. In step 1808, a basic injection period TP is calculated in accordance with the engine speed NE and the intake pipe pressure PM.

A water temperature correction coefficient FWL is calculated according to the cooling water temperature THW in step 1809 and an post-starting correction coefficient FASE is calculated according to the cooling water temperature THW and an elapsed time post-starting in step 1810. Further, an intake air temperature correction coefficient FTHA is calculated according to the intake air temperature THA in step 1811 and a high load correction coefficient FOTP is calculated according to the throttle opening angle TA, the engine speed NE, and the intake pipe pressure PM in step 1812. After that, an air-fuel ratio feedback correction coefficient FA/F is calculated according to the concentration of oxygen Ox in the exhaust in step 1813 and an acceleration correction pulse TACC is calculated according to the intake pipe pressure change amount ΔPM in step 1814. The final fuel injection period TAU is calculated by the following equation in the following step 1815.

$$TAU=TP\times FWL\times FTHA\times(FASE+FOTP)\times FA/F+TACC$$

According to the third embodiment, the fuel injection amount of the first time is calculated so that the air-fuel ratio of the mixture taken for the first time upon starting lies within the starting time combustion limit in consideration of the leakage fuel intake amount during the engine stop, and the cylinder is discriminated and the fuel is injected synchronously with the suction stroke upon starting from the fuel injection of the first time. Consequently, adhesion (wet) of the fuel to the intake port wall and the like is reduced and the air-fuel ratio of the mixture can be certainly set within the starting time combustion limit from the fuel injection of the first time without being influenced by the suction of the leakage fuel. The fuel can be certainly burned from the injected fuel of the first time. Consequently, the starting performance can be improved and the HC exhaust amount upon starting can be reduced.

Moreover, since the combustion state of the intake mixture of the first time is discriminated upon starting and the learned correction value for the fuel injection amount of the first time upon next starting is updated according to the combustion state, even if there is a variation in fuel supply system parts such as the fuel injection valve 19 and control system parts such as sensors or a variation in the fuel injection characteristics due to aging degradation, the variation can be automatically corrected by the effects of learning. The improvement in starting performance and the effects of the exhaust emission reduction can be stably continued for a long time.

Further, since the fuel injection amount of the first time is calculated by using the lean limit of the starting time combustion limit as a reference, the fuel injection amount of the first time can be set to a minimum of the starting time combustion limit and the HC exhaust amount upon starting can be largely reduced.

Fourth Embodiment

Figure 31:
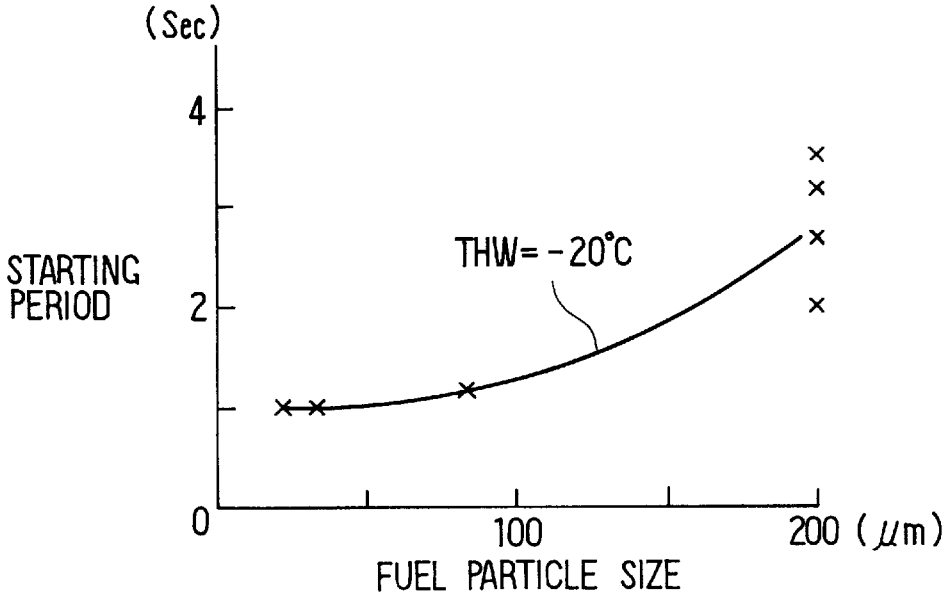
FIG. 31 is a graph showing the relation between fuel particle size and starting period.
Figure 32:
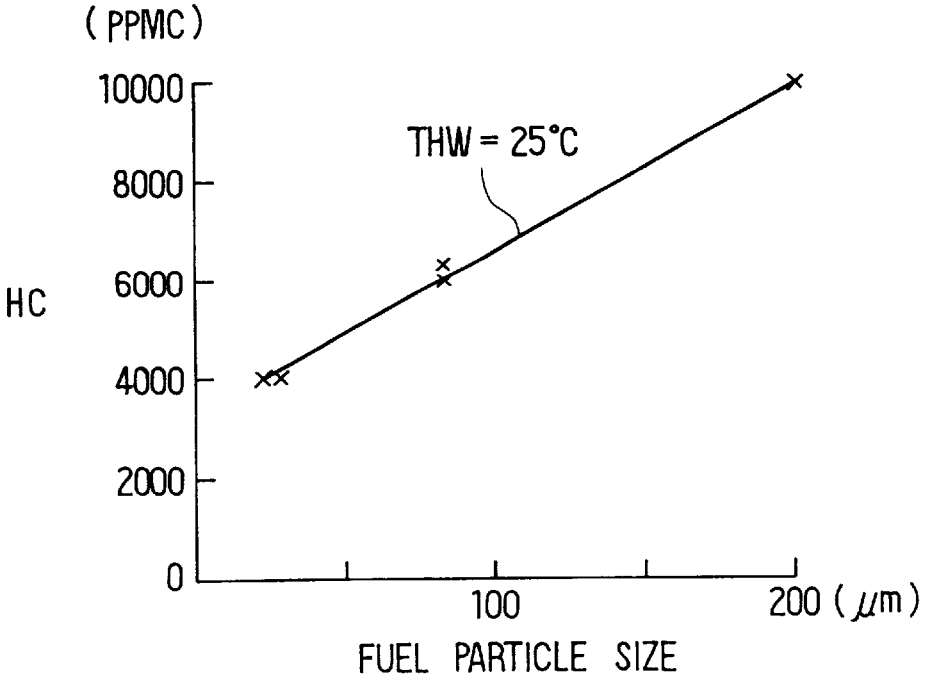
FIG. 32 is a graph showing the relation between the fuel particle size and a starting time HC exhaust amount.

As shown in FIG. 31, as the particle size of the injected fuel becomes smaller, the starting time becomes shorter. When the particle size of the fuel is equal to or smaller than 100 μm, the starting time is about 1 sec. As shown in FIG. 32, the HC exhaust amount upon starting is reduced as the particle size of the fuel becomes smaller. Consequently, in order to improve the starting performance and to reduce the HC exhaust amount upon starting, it is preferable to atomize the fuel and inject the atomized fuel.

Figure 33:
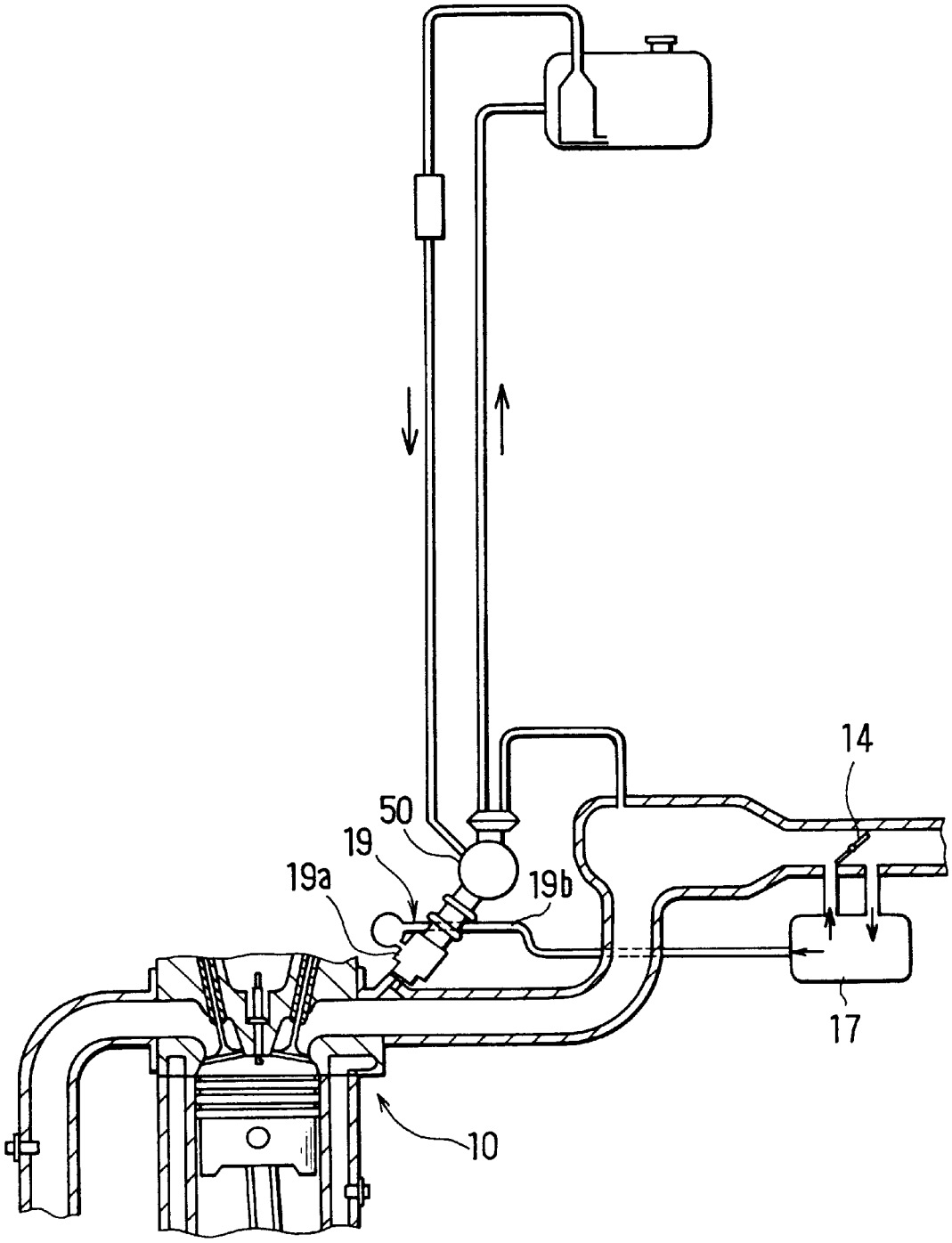
FIG. 33 is a diagram showing a fuel injection control system according to a fourth embodiment of the present invention.

From the above viewpoint, in the fourth embodiment of the invention shown in FIG. 33, the fuel injection valve 19 of an air assist type is employed for fuel atomization. An air mixing socket 19*a* is attached to the fuel injection valve 19 and a part of bypass air is supplied as an assist air from a three-position idle speed control valve 17 for bypassing the throttle valve 14 via an air passage 19*b* to the air mixing socket 19*a*. The assist air is delivered to the air mixing socket 19*a* by a differential pressure between the ups-tream and downstream sides of the throttle valve 14. The assist air is mixed with the injected fuel atomizing the injected fuel.

The flow rate of the assist air is regulated by the opening angle of the ISC valve 17 and an idle speed control is performed so that the total flow rate of the bypass air returned from the ISC valve 17 to the downstream side of the throttle valve 14 and the assist air delivered to the fuel injection valve 19 is equal to a target bypass flow rate. The distribution ratio of the assist air and the bypass air is controlled according to the engine operating conditions. The fuel injection control and the learning control at the time of starting are the same as those of the third embodiment.

As mentioned above, when the injected fuel is atomized by using the air assist type fuel injection valve 19, the effects of the improvement in the starting performance and the reduction in the HC exhaust amount can be further enhanced.

The fuel atomization is not limited to the air assist type. The injected fuel can be also atomized by improving the fuel injection valve. The injected fuel can be also atomized by increasing the set pressure of the pressure regulator 50 to increase the discharge pressure of the fuel pump, thereby increasing the fuel pressure supplied to the fuel injection valve.

Fifth Embodiment

Figure 34:
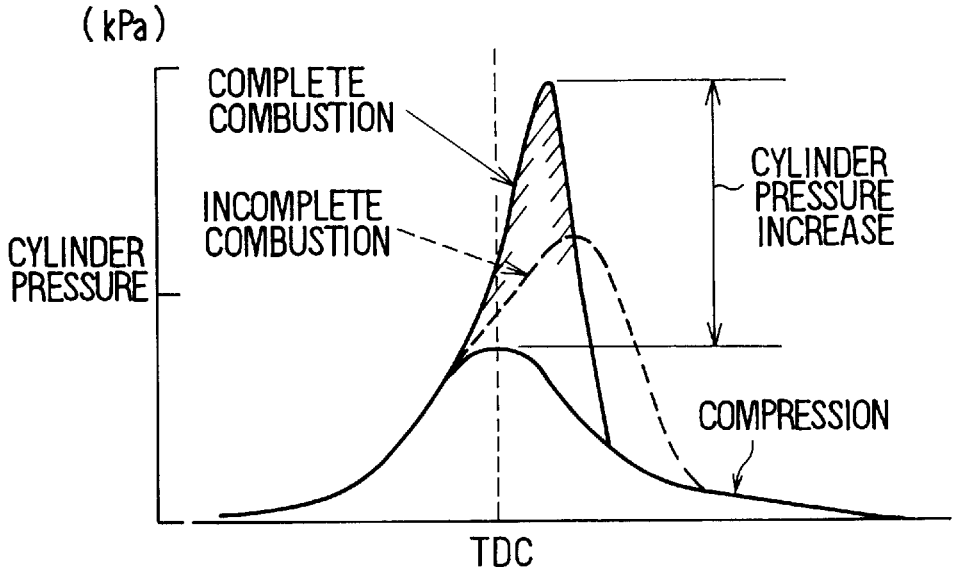
FIG. 34 is a time chart showing a change in the pressure in a cylinder upon combustion.

The combustion state of the first time is discriminated by the degree of increase in the engine speed in the combustion stroke of the first times upon starting in the third embodiment. As shown in FIG. 34, since the degree of increase in the pressure in the cylinder changes according to the combustion state, the combustion state of the first time can be also discriminated on the basis of the degree of increase in the pressure in the cylinder.

Figure 35:
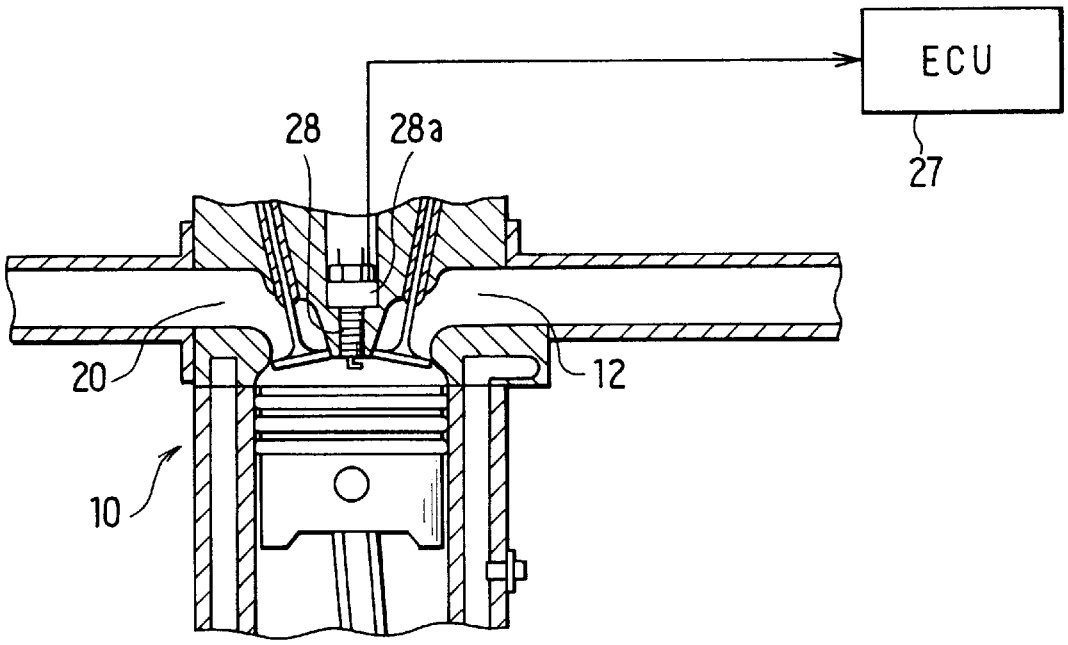
FIG. 35 is a diagram showing a fuel injection control system according to a fifth embodiment of the present invention.

In the fifth embodiment shown in FIG. 35, the spark plug 28 with a sensor 28*a* for sensing the pressure in a cylinder is attached to the cylinder head of the engine 10. The pressure in the cylinder and the compression pressure at the time of combustion are detected by the sensor 28*a* and the difference between the pressures (an increase amount of the pressure in the cylinder at the time of combustion) is calculated and compared with a discrimination value, thereby determining the complete combustion or incomplete combustion. Except for the above point, the fifth embodiment is similar to the third or fourth embodiment.

In this case, in the correction value learning routine of FIG. 26, it is sufficient to discriminate whether the increase amount of the pressure in the cylinder at the time of combustion is equal to or lower than the discrimination value in steps 1603 and 1605. Consequently, in a manner similar to the third embodiment, the learned correction value for the fuel injection amount of the first time of the next starting can be updated in accordance with the combustion state of the first time.

The combustion state of the first time can be also determined by using both of the increase amount of the pressure in the cylinder and the increase amount of the engine speed.

Sixth Embodiment

Figure 36:
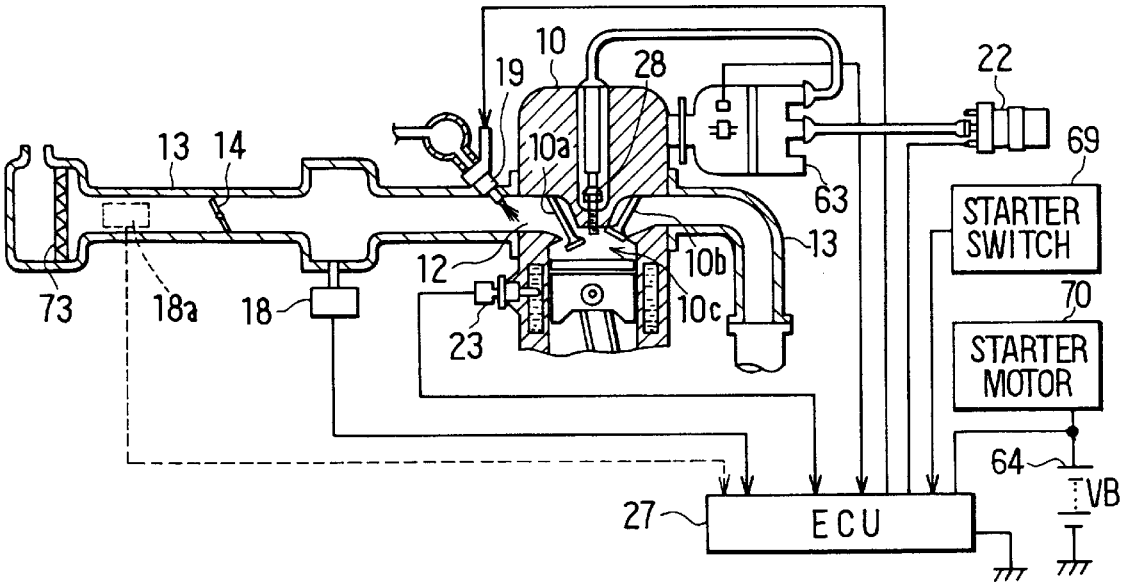
FIG. 36 is a schematic diagram showing a fuel injection control system according to a sixth embodiment of the present invention.

In a sixth embodiment shown in FIG. 36, the engine 10 is a four-cylinder spark ignition type internal combustion engine having first to fourth cylinders (#1 to #4) and the combustion order is #1→#3→#4→#2.

A starter motor 70 applies an initial rotation to the engine 10 upon engine starting and is rotated by an electric power supplied from a battery 64 in response to an ON operation of a starter switch 69.

A "suction stroke synchronized injection" for injecting the fuel in a predetermined period in which the engine 10 shifts from the exhaust stroke to the suction stroke and supplying the injected fuel into the cylinder (into the combustion chamber 10*c*) with opening of the intake valve 10*a* in the suction stroke is carried out. In this case, the fuel injection timing is set to the retard angle side as compared with a "suction stroke asynchronized injection" for injecting the fuel in the exhaust stroke of the engine 10, forming a uniform mixture in the intake port 12. In the asynchronized injection, the fuel injection is started around 150° CA to 90° CA before intake TDC. In the synchronized injection, on the contrary, the fuel injection is started around 60° CA before intake TDC.

The ECU 27 also receives operation information (ON/OFF signals) of the starter switch 69 and determines whether the starting operation to the engine 10 is being executed or not on the basis of the operation information of the starter switch 69.

Figure 37:
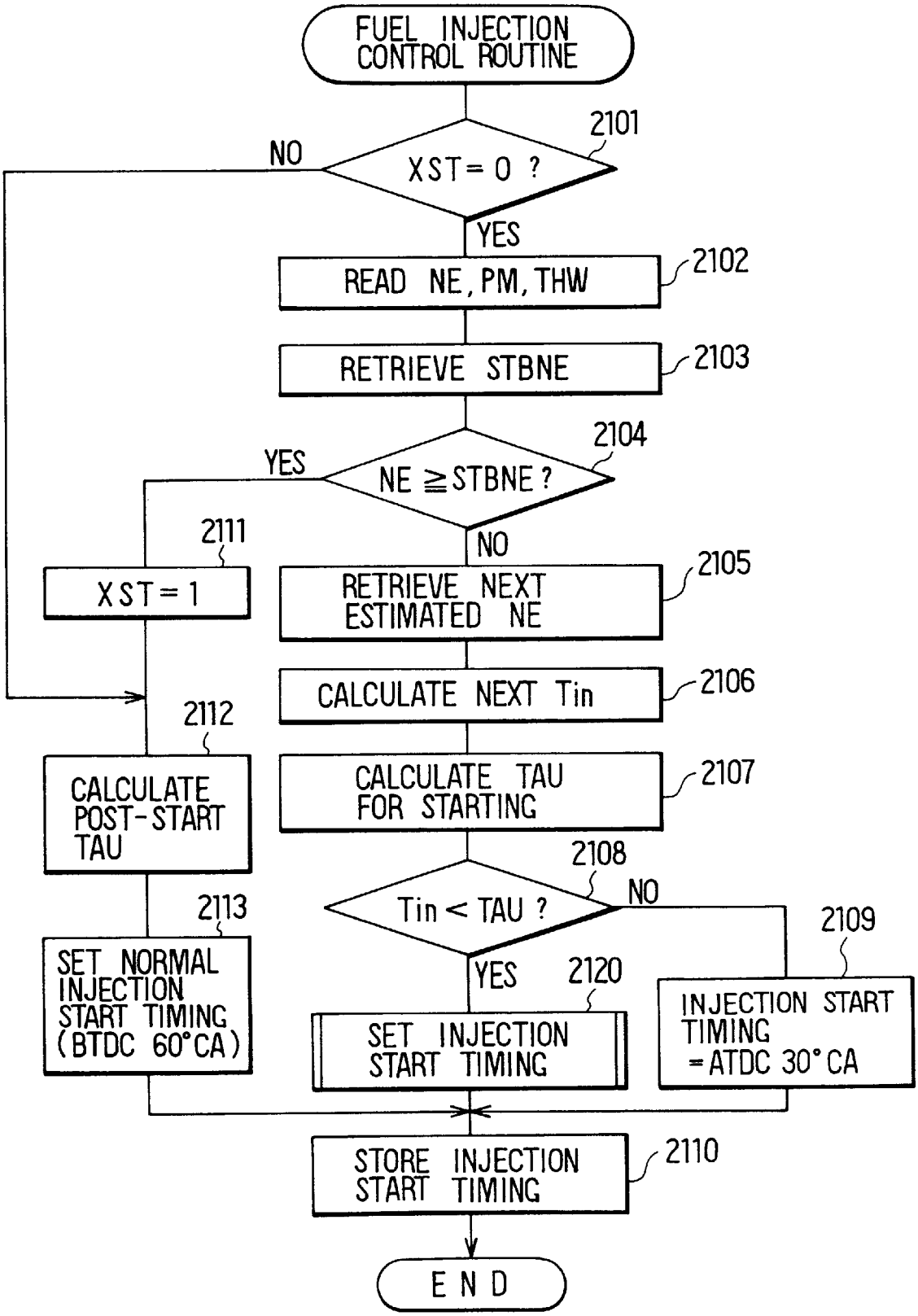
FIG. 37 is a flowchart showing a fuel injection control routine.

FIG. 37 is a flowchart showing a fuel injection control routine which is executed by the ECU 27 every fuel injection of each cylinder, that is, every 180° CA.

When the routine of FIG. 37 start, first in step 2101, the ECU 27 discriminates whether a complete combustion flag XST is "0" or not. The complete combustion flag shows whether the combustion of the engine 10 post-starting has been completed or not. XST=0 shows a state before the completion of combustion and XST=1 denotes a state after the completion of combustion. In the beginning of turn-on of the power source of the ECU 27, the flag is initialized to "0".

If XST=0, the ECU 27 advances to step 2102 and reads various information necessary for the fuel injection control at the time of starting of the engine. That is, the engine speed NE sensed by the rotation speed sensor 28, the intake pressure PM sensed by the intake pressure sensor 18, the water temperature THW sensed by the water temperature sensor 23, and the like are read.

Figures 39, 40:
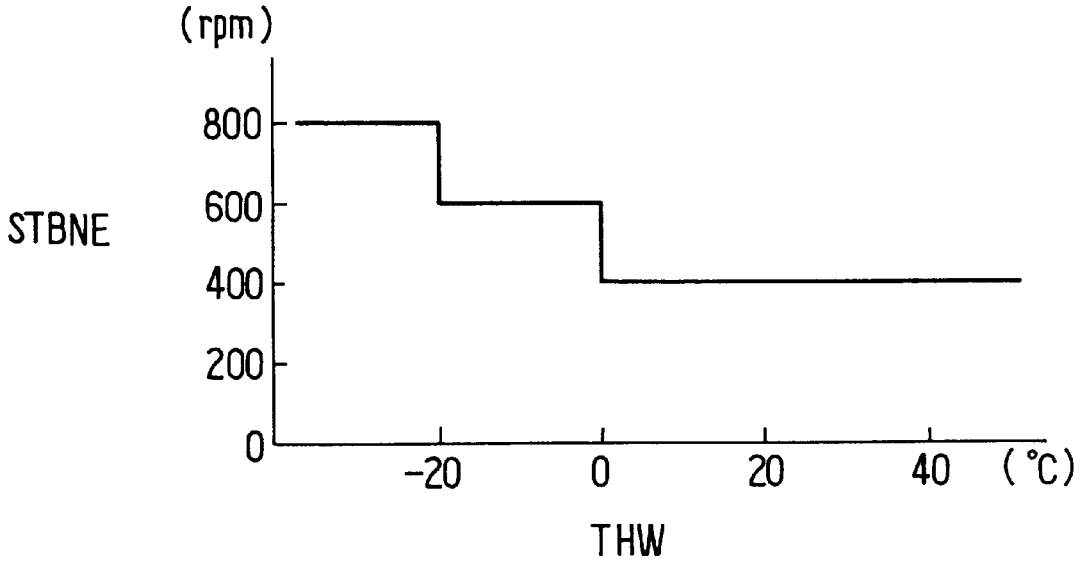
FIG. 39 is a graph showing the relation between the water temperature and complete combustion determining rotational speed STBNE.
FIG. 40 shows a map for retrieving a predicted NE.

After that, the ECU 27 retrieves a map of a complete combustion discriminating rotational speed STBNE in step 2103. Specifically, in accordance with the relation of FIG. 39, the complete combustion discriminating rotational speed STBNE according to the water temperature THW at each time is set. The following is set according to FIG. 39. STBNE=800 rpm when THW<−20° C. STBNE=600 rpm when THW=−20 to 0° C. STBNE=400 rpm when THW>0° C.

Thereafter, the ECU 27 compares the engine speed NE with the complete combustion discriminating rotational speed STBNE in step 2104. If NE<STBNE, the ECU 27 regards that the state is before combustion, negatively discriminates step 2104, and advances to step 2105. In step 2105, the ECU 27 retrieves a map data of an estimated engine speed in the next combustion cylinder (estimated NE of the next time) by using table data FIG. 40. According to FIG. 40, the estimated NE of the next time is obtained from the engine speed NE before complete combustion and the intake pressure PM.

Figure 41:
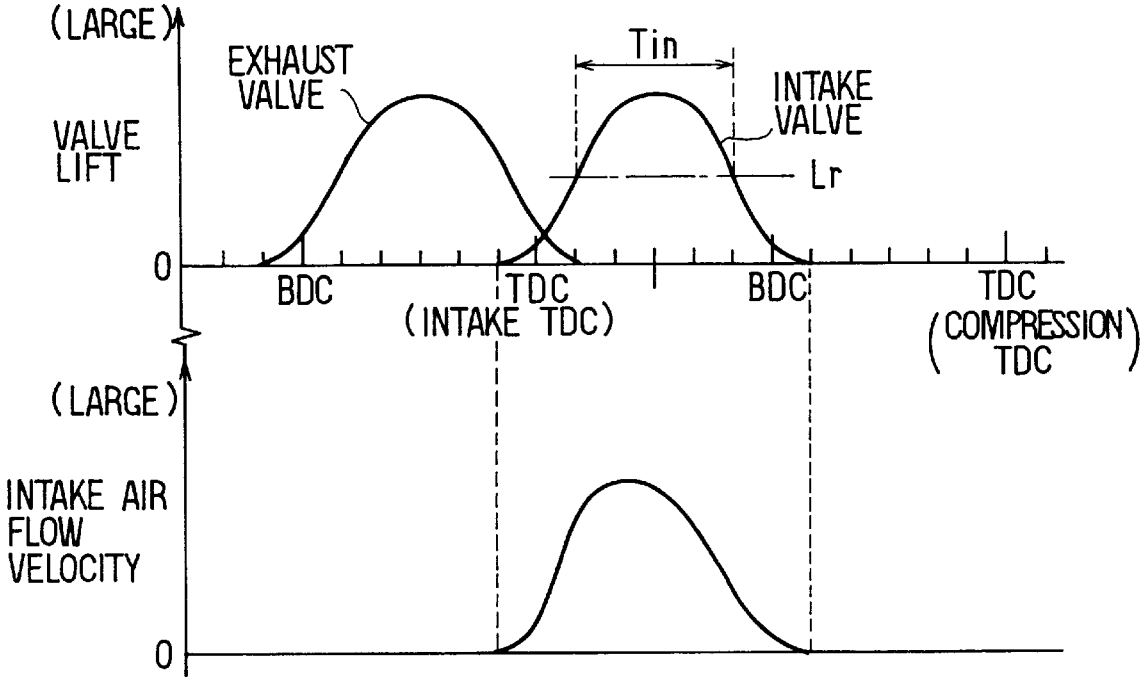
FIG. 41 is a chart showing the relation between a valve lift amount and an intake air flow velocity.

The ECU 27 calculates an open period of an intake valve 10*a* (valve open period Tin) in the next combustion cylinder in the following step 2106. Specifically, as shown in FIG. 41, the exhaust valve 10*b* opens just before BDC and closes just after TDC (intake TDC). The intake valve 10*a* opens just before the intake TDC and closes just after BDC. When a period during which a lift amount of the intake valve 10*a* exceeds a predetermined threshold value Lr is set to the "valve open period Tin", the valve open period Tin [m/sec] is calculated as follows.

$$Tin=30/NE\cdot 1000\cdot K$$

where, K denotes a coefficient (K<1) for deriving a period in which the valve lift amount exceeds the threshold value Lr in the suction stroke (180° CA) when the intake valve 10*a* opens. In the equation, in order to increase the reliability of the NE value, if THW<0° C., the instantaneous rotational speed at TDC to ATDC 30° CA is used as NE [rpm]. If THW≧0° C., the instantaneous rotational speed in a range from ATDC 30° CA to ATDC 60° CA is used as NE [rpm].

As mentioned above, by obtaining the valve open period Tin in the period in which the valve lift amount>Lr, the valve open period Tin can be set in a period of a relatively fast intake flow. That is, the Tin value can be set except for the region (before and after Tin) where the intake flow is slow and the fuel wet amount increases.

Figure 42:
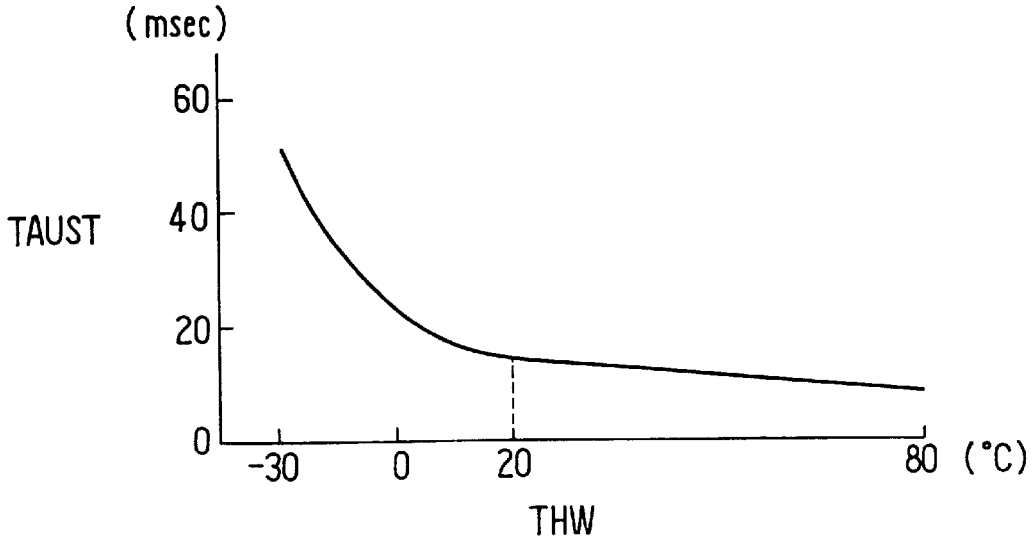
FIG. 42 is a diagram showing the relation between the water temperature and a starting time fuel amount TAUST.

After that, the ECU 27 calculates the fuel injection amount (period) TAU at the engine starting time in step 2107. For example, by calculating the starting time fuel amount TAUST in accordance with the water temperature THW on the basis of the relation of FIG. 42 and performing the rotational speed correction to the starting time fuel amount TAUST, the fuel injection amount TAU [m/sec] on the time unit basis can be calculated.

Further, after that, the ECU 27 compares the calculated valve open period Tin with the fuel injection amount TAU in step 2108. When Tin≧TAU, the ECU 27 regards that a desired fuel amount TAU can be injected and supplied within the next valve open period Tin, discriminates step 2108 negatively, and advances to step 2109. In step 2109, the ECU 27 sets the injection start timing by the injector 19 to "ATDC 30° CA (30° CA after intake TDC)". The setting of the injection start timing to ATDC 30° CA denotes that the fuel injection is carried out by aiming at the timing when the intake flow becomes maximum in the low temperature starting of the engine 10.

Thereafter, the ECU 27 advances to step 2110, store the set injection start timing (ATDC 30° CA) to an output comparing register and finishes the routine once.

When Tin<TAU in step 2108, the ECU 27 regards that the ECU 27 cannot inject a desired fuel amount (TAU) within the next valve open period Tin, positively discriminates step 2108, and proceeds to step 2120. In such a case, the ECU 27 sets the injection start timing in accordance with the procedure of FIG. 38 which will be described hereinlater instep 2120. After that, the ECU 27 advances to step 2110, store the injection start timing to the output comparing register, and finishes the routine once.

On the other hand, when NE≧STBNE (YES in step 2104), the ECU 27 regards that the combustion has been completed and advances to step 2111. The ECU 27 sets "1" to the complete combustion flag XST in step 2111 and calculates the TAU value after starting (post-start TAU) in the subsequent step 2112. Generally, the basic injection amount is calculated according to the engine speed NE and the engine load (intake air pressure PM) and the air-fuel ratio correction and the like are performed to the basic injection amount, thereby calculating the TAU value.

After that, the ECU 27 sets the injection start timing post-starting (in the normal state) in step 2113. Specifically, the injection start timing is set to "BTDC60° CA (60° CA before intake TDC)". After setting the injection start timing, the ECU 27 advances to step 2110, stores the injection start timing to the output comparing register, and finishes the routine once.

After "1" is set to the complete combustion flag XST, step 2101 is negatively discriminated each time. The ECU 27 advances from step 2101 directly to step 2112 and calculates the TAU value after starting so that the normal fuel injection control is carried out.

The procedure for setting the injection start timing in step 2120 in FIG. 37 will be described hereinbelow with reference to FIG. 38.

Figure 38:
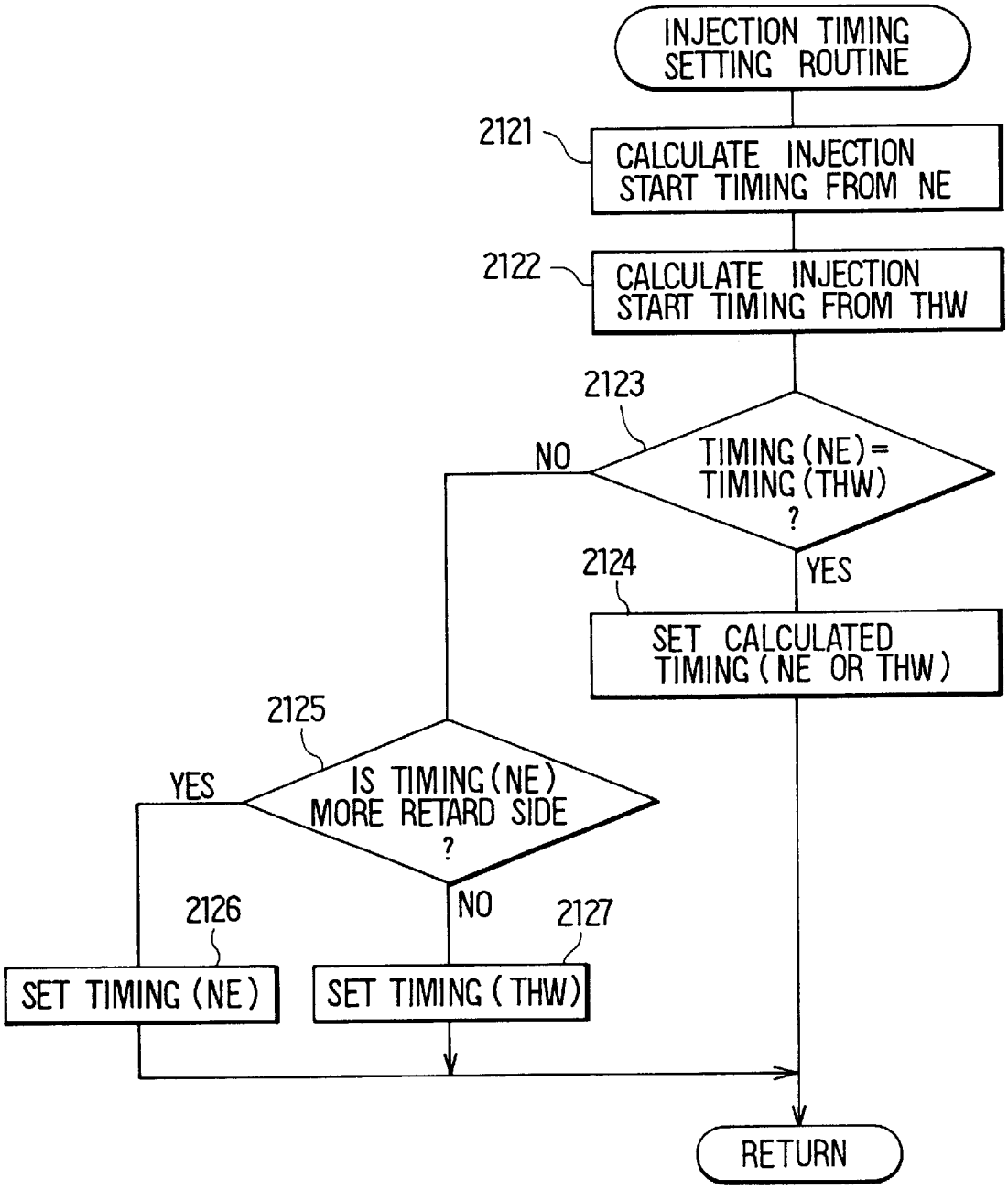
FIG. 38 is a flowchart showing an injection timing setting routine.
Figure 43:
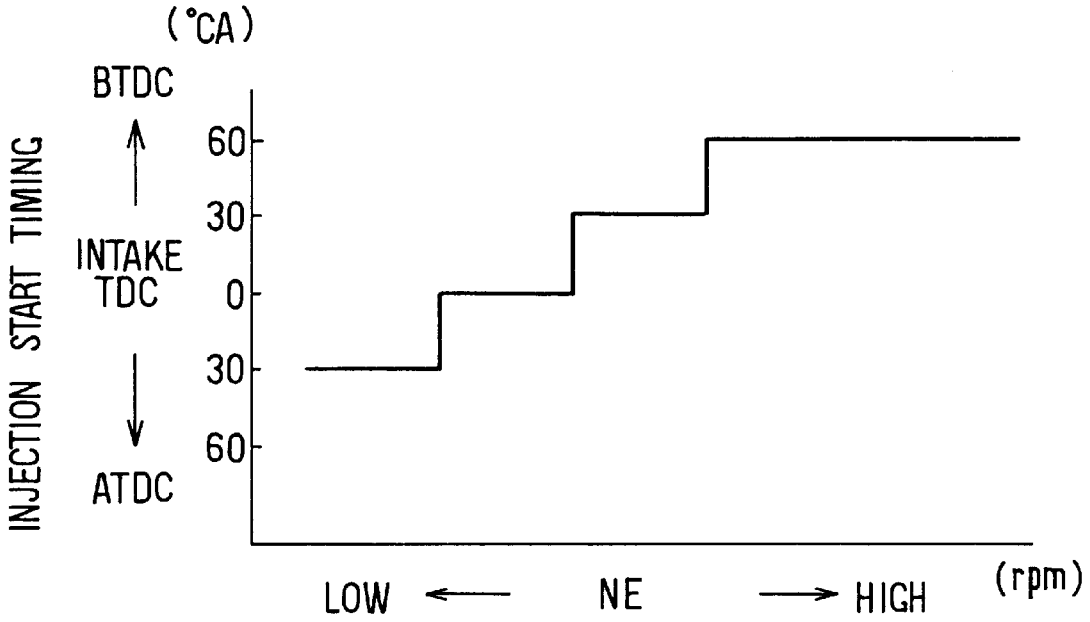
FIG. 43 is a graph showing the relation between the engine speed and the injection start timing.

In FIG. 38, the ECU 27 calculates the injection start timing in accordance with the engine speed NE at each time on the basis of the relation of FIG. 43 in step 2121. According to FIG. 43, the injection start timing shifts toward the advanced angle side with respect to ATDC30° CA as a reference as the engine speed NE increases. The ECU 27 calculates the injection start timing in accordance with the water temperature THW at each time on the basis of the relation of FIG. 44 in step 2122. According to FIG. 44, as the water temperature THW increases, the injection start timing shifts toward the advanced angle side with respect to ATDC30° CA as a reference.

In the following step 2123, the ECU 27 discriminates whether the injection start timings calculated in steps 2121 and 2122 coincide with each other or not. When YES in step 2123 (in the case where the value according to NE=the value according to THW), the ECU 27 advances to step 2124. The ECU 27 sets the value (value according to NE or THW) calculated according to FIG. 43 or 44 to the injection start timing of this time in step 2124 and, after that, returns to the main routine of FIG. 37.

When NO in step 2123 (the value according to NE≠the value according to THW), the ECU 27 proceeds to step 2125. The ECU 27 sets either the calculation value based on FIG. 43 (the value according to NE) or the calculation value based on FIG. 44 (the value according to THW) as an injection start timing of this time (step 2126 or 2127) and then returns to the main routine of FIG. 37. In steps 2125 to 2127, the injection start timing on the retard angle side is selected from the values calculated based on FIGS. 43 and 44.

In practice, when the water temperature THW is for example −20° C. or higher, the calculation value based on FIG. 43 (the calculation value according to NE) is selected. When the water temperature THW is lower than −20° C., the calculation value based on FIG. 44 (the calculation value according to THW) is selected.

Figure 45:
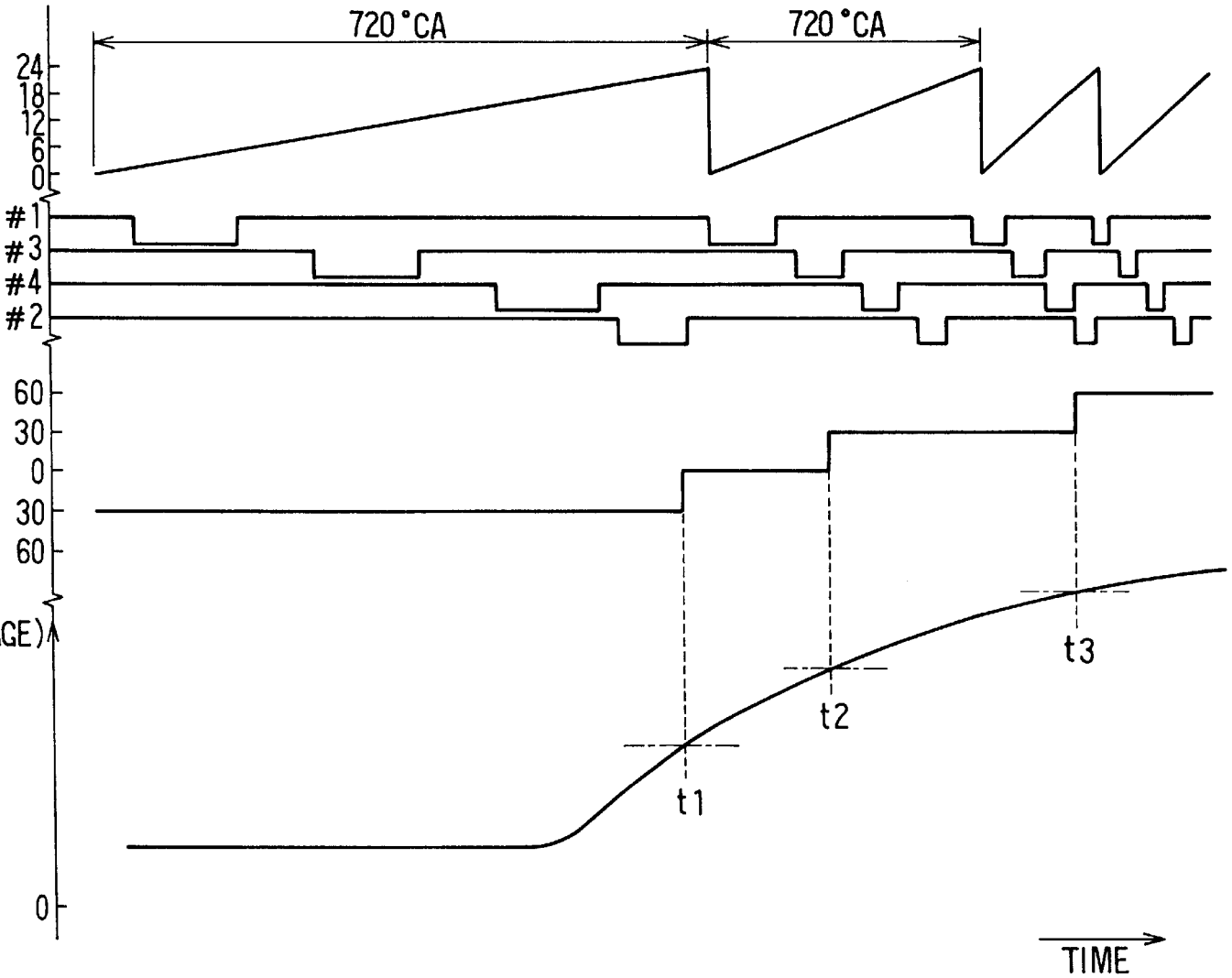
FIG. 45 is a time chart showing a fuel injection control operation.

FIG. 45 shows the fuel injection operation in the beginning of the low temperature engine starting (THW= approximately −20 to 0° C.) of the engine 10. The crank angle counter crank in FIG. 45 is a counter which is counted up every NE pulse (every 30° CA) and is cleared to "0" every 720° CA (every one cycle) in which the combustion of all of the cylinders #1 to #4 is completed once. The counter is counted within the range from 0 to 24. Although the counting operation of the counter is executed by the fuel injection control routine of FIG. 37, it is omitted in FIG. 37.

The injection signals to the cylinders are outputted from the ECU 27 in accordance with the order of #1→#3→#4→#2. The complete combustion flag XST is initialized to "0" in the beginning of the engine starting (not shown). At the time of cranking by the starter motor 70, the engine speed NE is in a small rotation zone. In the routines of FIGS. 37 and 38, for example, the injection start timing is set according to the engine speed NE on the basis of the relation of FIG. 43. That is, the injection start timings are set as follows.

- the injection start timing=ATDC30° CA in a period from the beginning of the engine starting to time t1
- the injection start timing=intake TDC in a period from time t1 to t2
- the injection start timing=BTDC30° CA in a period from t2 to t3.
- the injection start timing=BTDC60° CA in a period after t3

In this manner, at the time of low-temperature starting of the engine 10, the injection start timing is switched with increase in the engine speed NE in accordance with the order of ATDC30° CA→intake TDC→BTDC30° CA→BTDC 60° CA. In other words, the injection start timing is advanced with the increase in NE.

In this embodiment, the completion of combustion is discriminated in step 2104 in FIG. 37 and the starting time injection timing is set in steps 2105 to 2109 and 2120. The comparing operation is carried out in step 2108, the first setting is performed in step 2109, and the second setting is performed in step 2120 (routine of FIG. 38).

According to this embodiment, the following effects can be obtained.

(a) In this embodiment, the injection start timing is shifted to the retard angle side more than the normal injection start timing in the starting state before completion of combustion, thereby enabling the fuel injection to be carried out synchronously with the suction stroke (when the intake valve 16 is open) even in the small rotation zone. The wet amount of the fuel can be therefore reduced and a desired combustion torque can be obtained. As a result, the rotational speed increases promptly in a stable state at the engine starting time, so that the starting performance of the engine 10 is improved. According to the construction, an incomplete combustion such as a misfire due to port wetting or the like is improved.

Figure 44:
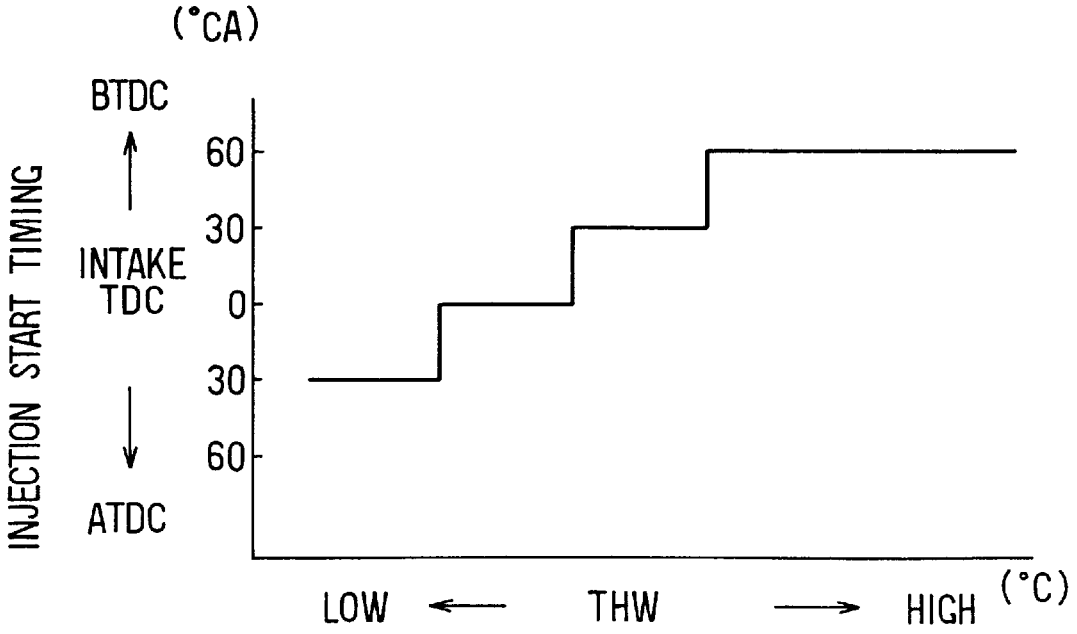
FIG. 44 is a graph showing the relation between the water temperature and the injection start timing.

(b) The open period (Tin) of the intake valve 10*a* in the next combustion cylinder is compared with the fuel injection period (TAU) in the next combustion cylinder. When the valve open period Tin is longer, the injection start timing by the injector 19 is set to a predetermined angle (ATDC30° CA). When the fuel injection period TAU is longer, the injection start timing by the injector 19 is shifted to the advanced angle side (FIGS. 43 and 44).

That is, although the valve open period Tin is shortened gradually with the increase in the rotational speed upon the starting of the engine 10, an inconvenience such that the fuel injection timing by the injector 19 is too late and is not in time for the closing of the intake valve 10*a* can be avoided and the injected fuel can surely flow into the cylinder. The injected fuel does not therefore become wet in the intake port 12.

(c) The valve open period Tin is calculated in the period in which the valve lift amount is equal to or larger than a predetermined value. That is, even when the intake valve 10*a* is open, if the valve lift amount is very small, the intake flow is slow and the fuel wet amount increases. The valve open period Tin is consequently specified as mentioned above and the fuel flows in a period during which the intake flow is relatively fast.

(d) Upon starting of the engine, the injection start timings are calculated according to the engine speed NE and the water temperature THW, respectively (FIGS. 43 and 44) and the value on the retard angle side is selected from the injection start timings. In this case, by selecting the injection start timing on the retard angle side, an excessive advanced angle control is suppressed and the wet due to remaining of the fuel in the intake port 12 (remaining before opening of the intake valve 10*a*) can be more certainly prevented.

(e) In FIG. 43, as the engine speed NE increases, the injection start timing is gradually shifted to the advanced angle side. In FIG. 44, the injection start timing is gradually shifted to the advanced angle side with the increase in water temperature THW. In such a case, the injection start timing to the completion of combustion can be properly set and the operation can be smoothly shifted to the normal fuel injection (suction stroke sync injection) when the combustion is completed.

(f) The complete combustion discriminating rotational speed STBNE is variably set according to the water temperature THW and whether the engine 10 has completed the combustion or not is determined according to the complete combustion discriminating rotational speed STBNE. In this case, even if the rotational speed at which the engine 10 can maintain the rotation by itself differs according to the water temperature THW (engine temperature), the proper fuel injection amount control can be continued until the combustion has been completed actually.

(g) The fuel injection control at the engine starting time can be properly carried out, so that an effect that the emission exhaust amount at the starting time is reduced can be also obtained.

Seventh Embodiment

Figure 46:
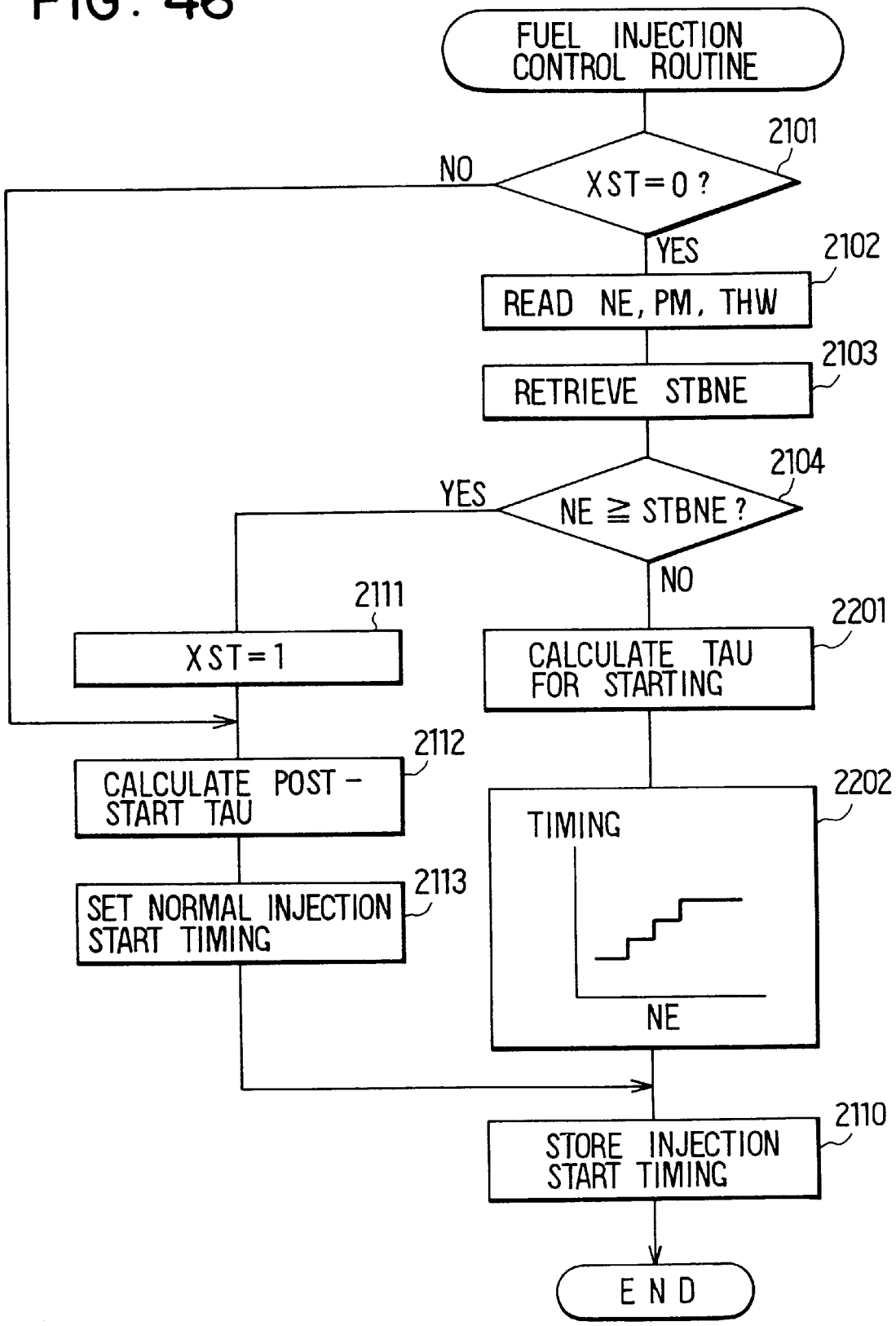
FIG. 46 is a flowchart showing a fuel injection control routine according to a seventh embodiment of the present invention.

The routine of FIG. 46 is a modification of a part of the routine of FIG. 37 (sixth embodiment). The processes of steps 2105 to 2109 and 2120 in FIG. 37 are changed to processes of steps 2201 and 2202 in FIG. 46.

FIG. 46 differs from FIG. 37 as follows. After setting the fuel injection TAU at the starting time in step 2201, the ECU27 sets the injection start timing in step 2202. In this case, by using, for example, the relation of FIG. 43, the injection start timing is set according to the engine speed NE. Alternatively, the injection start timing is set according to the water temperature THW by using the relation of FIG. 44. In short, different from FIG. 37, operations such as the calculation of the valve open period Tin and comparison between the Tin value and the fuel injection amount TAU are omitted in FIG. 46.

According to the seventh embodiment, in a manner similar to the sixth embodiment, the rotational speed increases promptly in a stable state at the engine starting time and excellent effects such that the starting performance of the engine 10 is improved can be obtained.

Eighth Embodiment

An eighth embodiment will be described with reference to FIGS. 47 to 50. The sixth and seventh embodiments are characterized in that the injection start timing upon the engine starting is variably set. In this embodiment, in addition to variably set the injection start timing in a manner similar to the above, a surplus of the fuel which cannot be supplied within the intake valve open period is carried over to the fuel injection of the next combustion cylinder.

Figure 47:
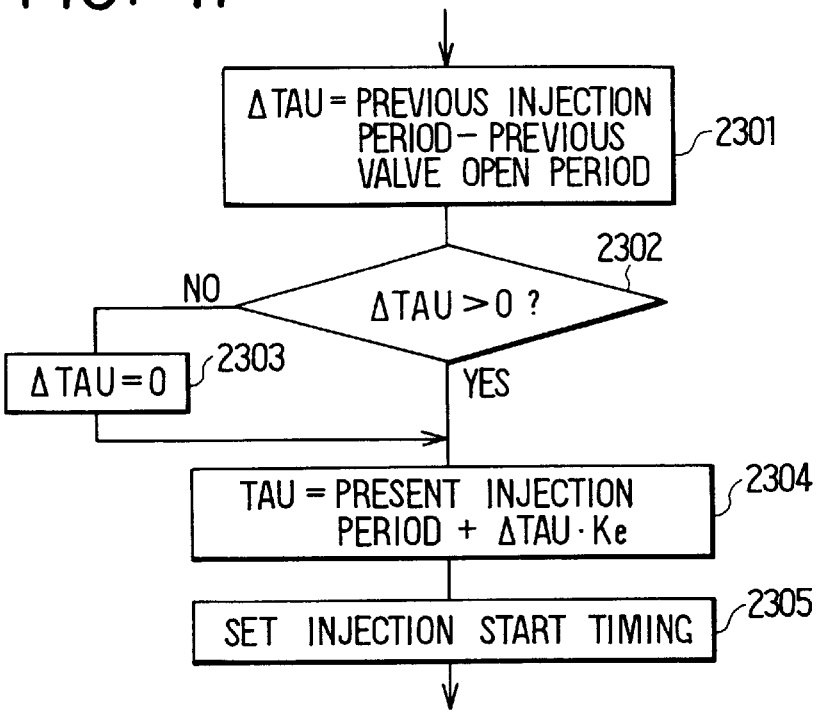
FIG. 47 is a flowchart showing a part of the fuel injection control routine according to an eighth embodiment of the present invention.

FIG. 47 is a flowchart showing a part of the fuel injection control routine in the embodiment. In FIG. 47, the ECU 27 subtracts the previous valve open period [m/sec] from the previous fuel injection amount (period) [m/sec] to calculate TAU in step 2301.

Subsequently, the ECU 27 discriminates whether TAU is larger than "0" or not in step 2302. When $\Delta TAU \leqq 0$ (NO in step 2302), the ECU 27 sets "$\Delta TAU=0$" in step 2303 and advances to step 2304. When $\Delta TAU>0$ (YES in step 2302), the ECU 27 proceeds to step 2304.

The ECU 27 adds "$\Delta TAU \cdot Ke$" to the present injection amount (period) in step 2304 and uses the resultant value as the fuel injection amount TAU. "Ke" denotes an evaporation ratio correction coefficient for correcting the evaporation ratio of the fuel and is set, for example, in accordance with the relation of FIG. 49. For instance, under the condition that the outside air temperature (or intake air temperature) is −10° C. or higher, the evaporation ratio correction coefficient Ke is set according to the outside air temperature (Ke>1). After that, the ECU 27 sets a predetermined injection start timing to the output comparing register in step 2305.

Figure 48:
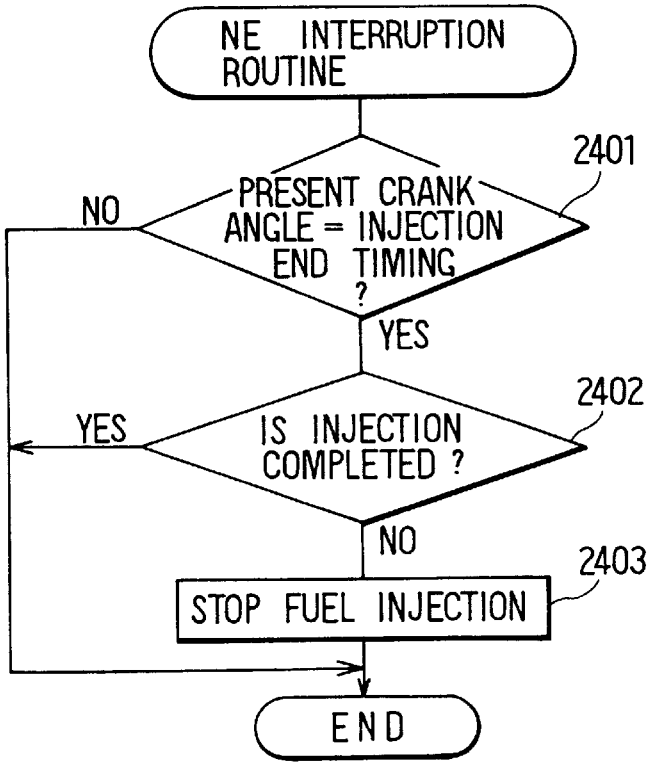
FIG. 48 is a flowchart showing an NE interruption routine.
Figure 49:
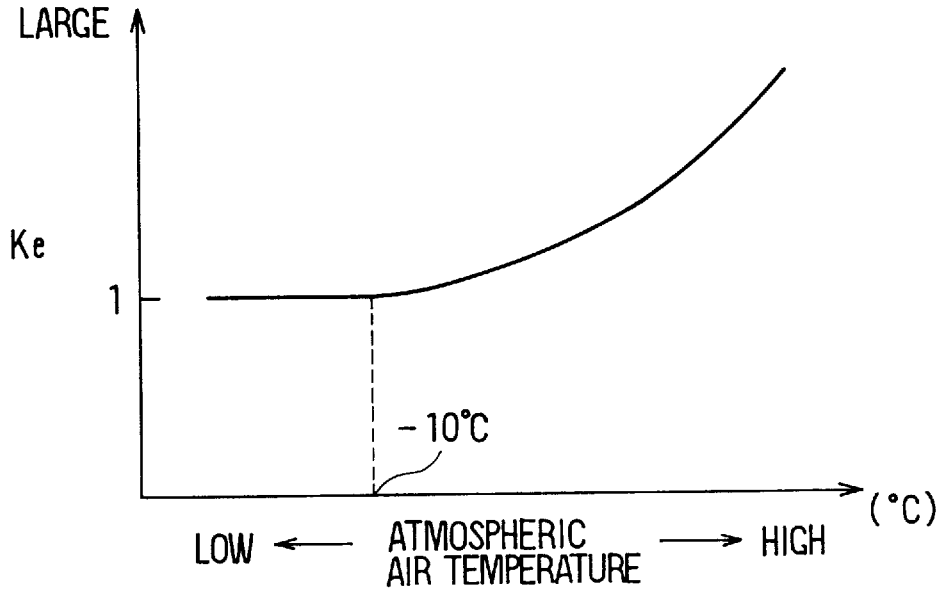
FIG. 49 is a graph showing the relation between the atmospheric air temperature and an evaporation ratio correction coefficient Ke.

On the other hand, FIG. 48 is a flowchart showing a routine of NE interruption by the ECU 27. It is sufficient to carry out the process only before completion of the combustion. In FIG. 48, the ECU 27 discriminates whether the present crank angle has reached an "injection end timing" or not in step 2401. The injection end timing corresponds to the valve open end timing of the intake valve 10*a*.

Whether the fuel injection has been already completed or not is determined in step 2402. Under the condition of YES in step 2401 and NO in step 2402, the ECU 27 advances to step 2403 and stops the fuel injection immediately. That is, the fuel injection which has been continued is forcedly finished at a crank angle of the injection end.

When the fuel injection is interrupted in the middle by the routine of FIG. 48, a surplus of the fuel which cannot be injected is calculated as ΔTAU in step 2301 in FIG. 47. "ΔTAU·Ke" is added to the injection amount of the next time, thereby obtaining the fuel injection amount TAU. The amount TAU of fuel is injected and supplied to the engine 10 (steps 2304 and 2305).

According to this embodiment, in a manner similar to the sixth and seventh embodiments, the rotational speed increases promptly and stably at the engine starting time and excellent effects such that the starting performance of the engine 10 is improved can be obtained.

Especially, in the eighth embodiment, the surplus (ΔTAU) of the fuel injected and supplied for a time longer than the intake valve open period upon engine starting is added to the fuel injection amount of the next combustion cylinder. At the time point when the fuel injection by the injector 19 continues to a predetermined crank angle, the fuel injection at that time is stopped. Consequently, the injection start timing is set to the retard angle side at the engine starting time. Even if a predetermined fuel injection amount cannot be injected within the open period of the intake valve 10*a*, therefore, by carrying over the fuel surplus to the next combustion, a desired combustion torque can be assured. Further, since the ΔTAU amount is multiplied by the correction coefficient Ke of the fuel evaporation ratio, the fuel injection control with higher accuracy can be realized.

Figure 50:
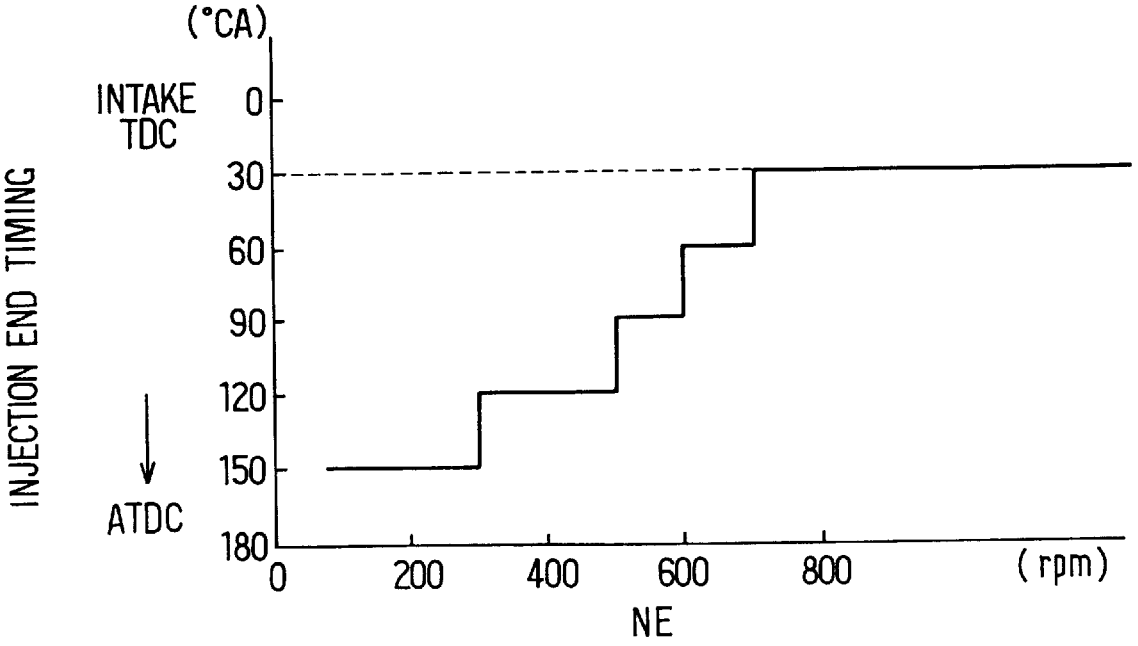
FIG. 50 is a diagram showing the relation between the engine speed and the injection end timing.

In the eighth embodiment, the injection end timing at the engine starting time (the injection end timing in step 2401 in FIG. 48) may be also variably set. Specifically, for example, in accordance with the relation of FIG. 50, the injection end timing is set on the basis of the engine speed NE. In FIG. 50, the injection end timing is set within the range from ATDC150° CA to ATDC30° CA in accordance with the NE value before completion of the combustion. The lower the NE is, the more the injection end timing is set to the retard angle side. Consequently, both of the injection start timing and the injection end timing shift to the advanced angle side with increase in the rotation and the fuel can flow into the cylinder at the optimum timing.

Ninth Embodiment

The ninth embodiment will be described with reference to FIGS. 51 to 56. In this embodiment, the fuel amount which is injected when the intake valve is closed and becomes port wet out of the fuel injection amount at the engine starting time is obtained and the injection amount is corrected according to the obtained fuel amount. The embodiment mainly aims at solution of the fuel shortage due to the wet to improve the engine starting performance.

Figure 51:
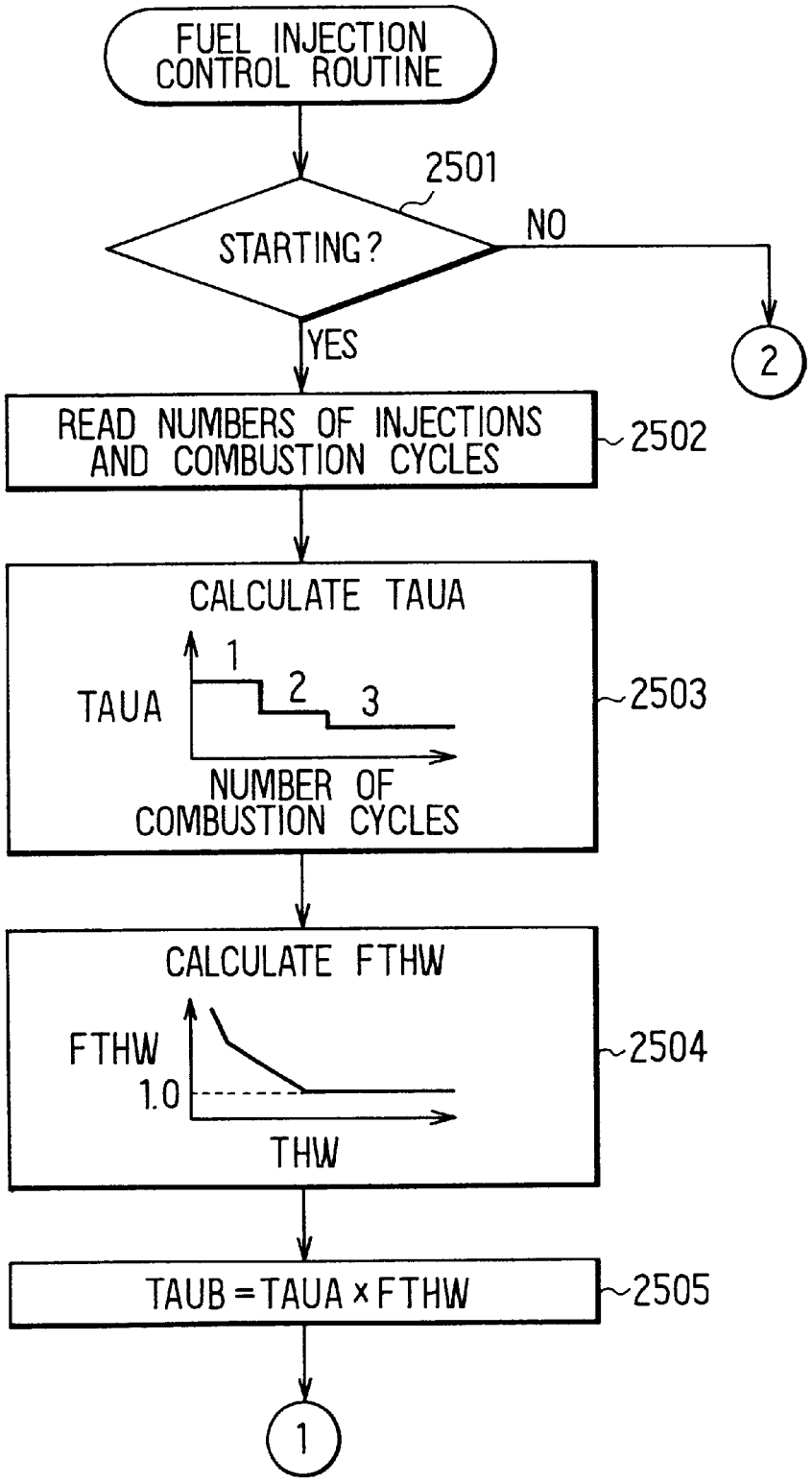
FIG. 51 is a flowchart showing a fuel injection control routine according to a ninth embodiment of the present invention.
Figure 52:
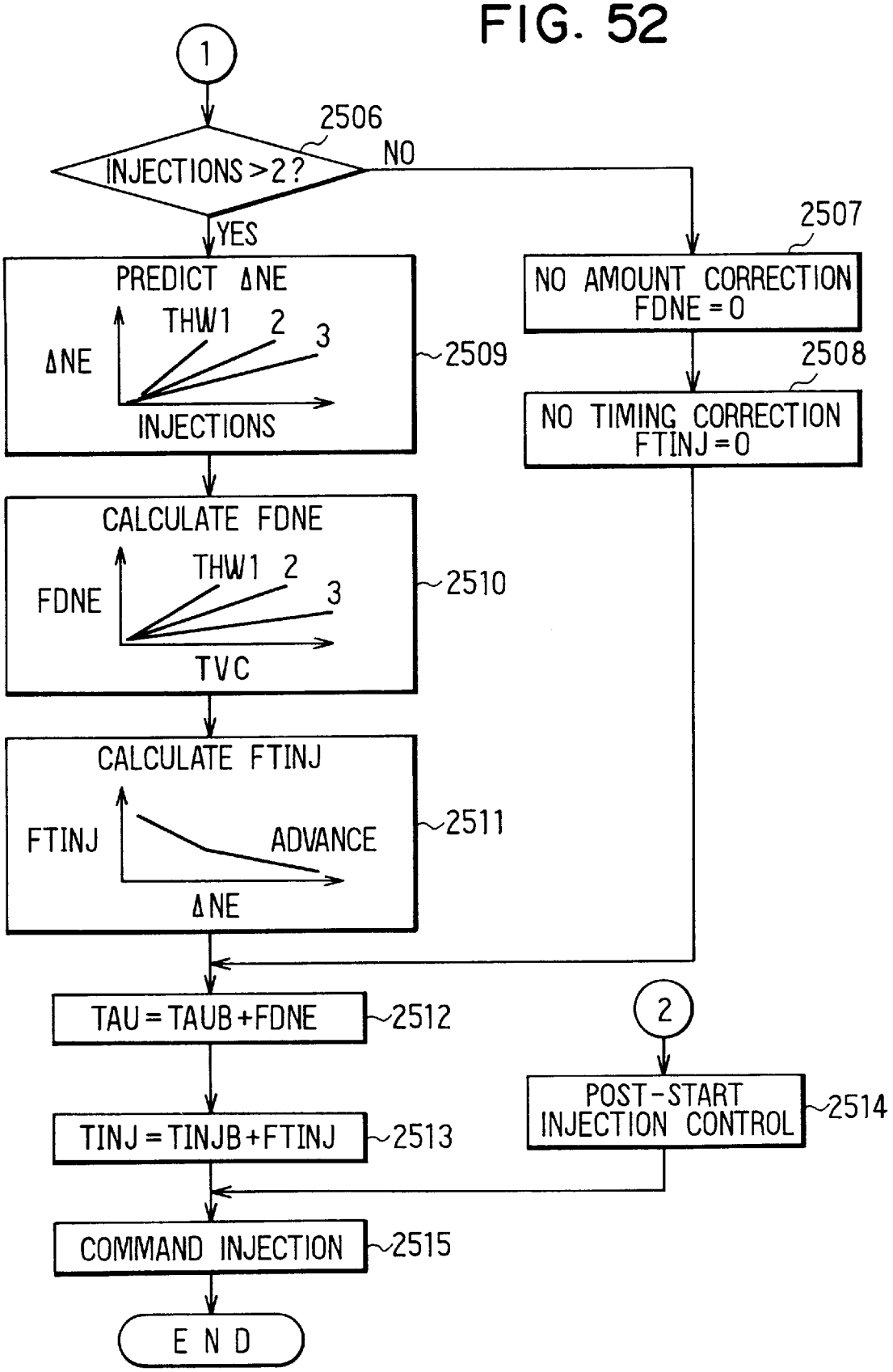
FIG. 52 is a flowchart showing the fuel injection control routine subsequent to FIG. 51.

FIGS. 51 and 52 show the fuel injection control routine of the embodiment. The routine is executed in place of, for example, the routine of FIG. 37 (sixth embodiment). The ECU 27 determines whether the engine is being started at present or not in step 2501 in FIG. 51. In this case, for instance, whether the engine speed NE reaches the complete combustion discriminating rotational speed (the value set in FIG. 39) or not is discriminated. When the NE value is lower than the complete combustion discrimination rotational speed, it is regarded that the engine is being started.

When it is determined that the engine is being started (YES in step 2501), the ECU 27 advances to step 2502 and reads the number of injections and the number of combustion cycles since the cranking has been started after turn-on of the ignition. The number of combustion cycles is a numerical value which is counted up at the time point the fuel injection of all of the cylinders of the engine 10 is finished once (every 720° CA). For example, in case of a four-cylinder engine, the number of injections is 4 counts and the count is increased one by one. The number of injections and the number of combustion cycles are calculated by another process (not shown).

After that, the ECU 27 calculates a starting time basic injection amount TAUA on the basis of the number of combustion cycles in step 2503. The starting time basic injection amount TAUA is set so as to be reduced as the number of combustion cycles increases. The same amount TAUA is given to each of the #1 to #4 cylinders having the same combustion cycle. That is, an increase amount in which the wet amount of the injection fuel is considered is added to the basic injection amount in the beginning of the starting (first cycle). On the contrary, since the wet amount becomes closer to a saturation point as the combustion cycle is repeated in the two or subsequent cycles, the basic injection amount is decreased.

Thereafter, the ECU 27 calculates a water temperature correction coefficient FTHW on the basis of the engine water temperature THW in step 2504. The lower the water temperature THW is, the larger water temperature correction coefficient FTHW is set.

The ECU 27 multiplies the calculated starting time basic injection amount TAUA by the water temperature correction coefficient FTHW in step 2505 and sets the product as the starting time injection amount TAUB (TAUB=TAUA·FTHW).

In step 2506 in FIG. 52, the ECU 27 determines whether the number of injections since the cranking has been started is larger than 2 or not. When it is assumed that the injection is the first or second injection just after the starting, the ECU 27 discriminates step 2506 negatively. The ECU 27 sets an injection amount correction value FDNE according to a rotational speed increase amount ΔNE by the combustion to "0" in step 2507. In the subsequent step 2508, an injection timing correction value FTINJ according to the rotational speed increase amount NE to "0".

That is, since the first and second injections of the engine starting are not influenced by the increase in the rotational speed by combustion, the correction based on the rotational speed increase amount ΔNE is inhibited. It is considered that a rotation of about 360° CA is required from the cranking start to the combustion start.

In the third injection and afterward, the ECU 27 discriminates step 2506 positively. The ECU 27 predicts the rotational speed increase amount ΔNE by combustion on the basis of the number of injection periods from the starting in step 2509. The ΔNE value is predicted from the increase in NE when it is assumed that the fuel can be normally burned from the first injection post-starting. In this case, the ΔNE value is obtained from the number of injections as shown by the table data in the diagram and different characteristics are properly switched every water temperature THW at the starting time (in the diagram, THW1>THW2>THW3).

The transition of NE increase will be described by using the time chart of FIG. 53. In the third and subsequent injections when it is estimated that the combustion is started post-starting (injection of the #4 cylinder and subsequent injections in the diagram), the degree of increase in NE varies depending on the water temperature THW. In this case, the higher the water temperature THW is, the less the influence of the engine friction is. Consequently, when THW1>THW2, the degree of increase in NE with respect to THW1 is higher (ΔNE value is larger).

The ECU 27 calculates the injection amount correction value FDNE on the basis of the predicted ΔNE value in step 2510.

In this case, the predicted ΔNE value is added to the NE value in the intake TDC of the combustion cylinder of this time and an intake valve open period TVO is calculated from the resultant value (NE+ΔNE). The surplus of the intake valve open period injection, that is, the intake valve closing period injection amount TVC is calculated from the difference between the starting time injection amount (injection period) TAUB and the intake valve open period TVO (TVC=TAUB−TVO). In accordance with the characteristic of each water temperature THW, the injection amount correction value FDNE corresponding to an injection amount shortage when the intake valve is closed is calculated based on the intake valve closed period injection amount TVC from the values of the table in the diagram.

Figure 54:
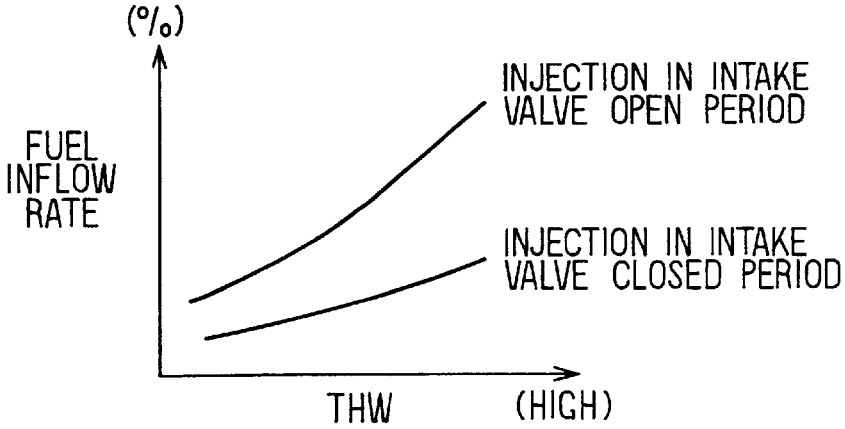
FIG. 54 is a graph showing the relation between the water temperature and the fuel inflow rate.

The inflow ratio of the fuel of the same injection amount injected into a cylinder when the intake valve is opened and that when the intake valve is closed have the relation, for example, shown in FIG. 54. According to FIG. 54, the fuel inflow ratio when the intake valve is closed is smaller than that when the intake valve is open. The lower the water temperature THW is, the smaller the fuel inflow ratio is. Consequently, the injection amount correction value FDNE is set in consideration of the fact that the fuel inflow ratio is relatively low when the intake valve is closed and the fuel inflow ratio changes according to the water temperature THW.

Figure 53:
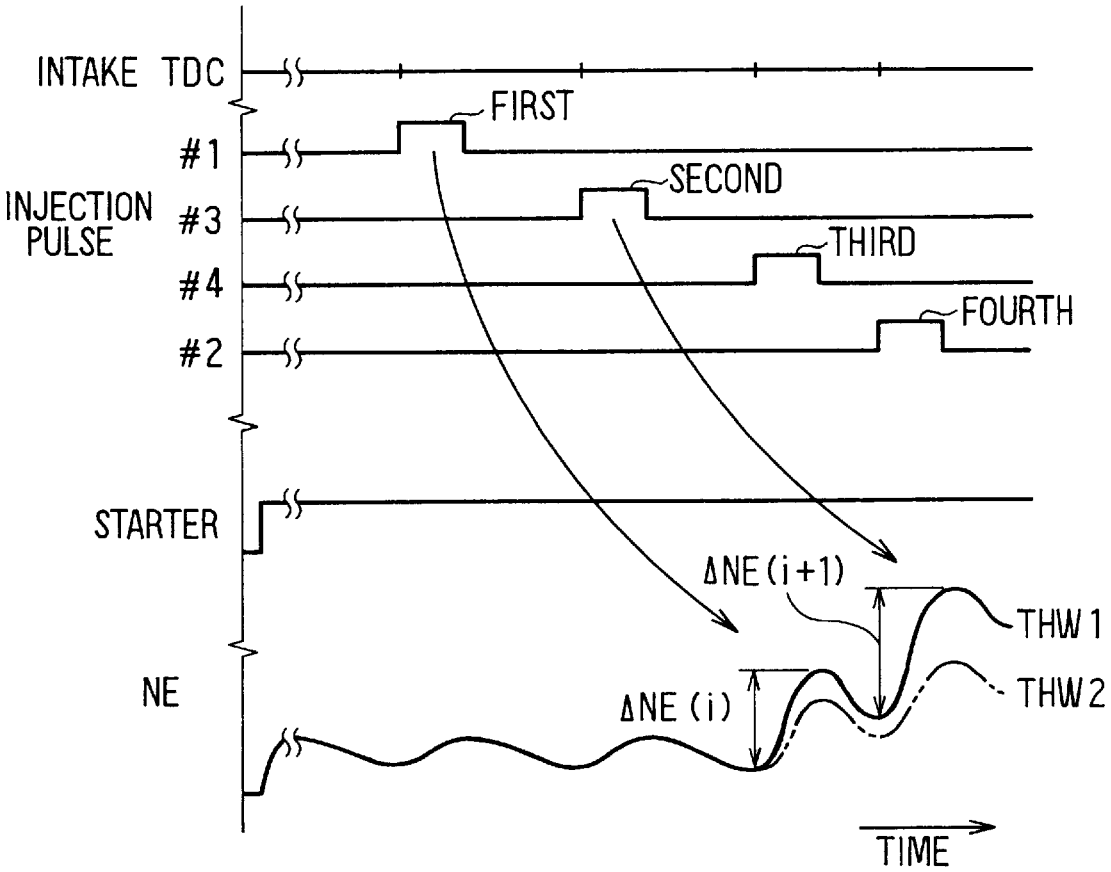
FIG. 53 is a time chart showing fuel injection operation and increase in rotational speed at the engine starting time.

In the time chart of FIG. 53, upon calculation of the injection amount correction value FDNE of the third injection, the intake valve open period TVO is calculated from the predicted rotational speed (NE+ΔNE(i)) in the intake TDC of the #4 cylinder and the injection amount TVC when the intake valve is closed (surplus amount at the time of intake valve open period injection) is calculated from the TVO value. The rotational speed increase amount NE(i) at the third injection corresponds to an increase in rotational speed by the combustion of the first injection (injection of the #1 cylinder). The increase NE (i+1) in rotational speed by the fourth injection corresponds to an increase in the rotational speed by the combustion of the second injection (injection of the #3 cylinder).

Further, the ECU 27 calculates a correction value FTINJ of the next injection timing on the basis of the predicted ΔNE value in step 2511. In this case, by using the table data in the diagram, the larger the ΔNE value becomes, the injection timing correction value FTINJ is set to a correction value on the more advanced angle side.

After calculating the correction values FDNE and FTINJ, the ECU 27 calculates the final injection amount TAU by the following equation in step 2512.

$$TAU=TAUB+FDNE$$

The ECU 27 calculates the final injection timing TINJ by the following equation in step 2513.

$$TINJ=TINJB+FTINJ$$

"TINJB" is a fixed basic injection timing which is preset.

Finally, the ECU 27 instructs the fuel injection by the injector 19 on the basis of the calculated TAU and TINJ values in step 2515 and finishes the routine. On the other hand, when NO in step 2501 in FIG. 51 (when it is not the engine starting time), the ECU 27 advances directly to step 2514 in FIG. 52 and executes the normal fuel injection control post-starting in steps 2514 and 2515.

The control on the fuel injection amount and the fuel injection timing at the engine starting time will be described with reference to FIGS. 55 and 56. In FIGS. 55 and 56, for convenience, fuel injection pulses are shown by setting time of flight of the injection fuel to zero.

Figure 55A:
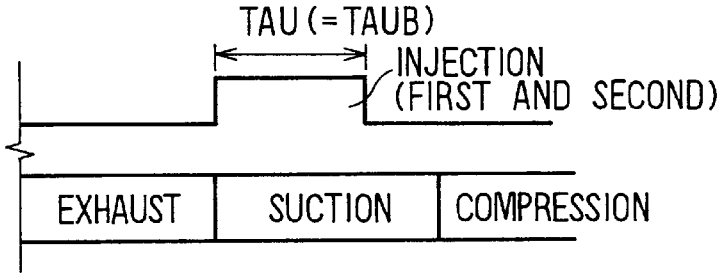
FIGS. 55A and 55B are time charts showing the injection amount correction.
Figure 55B:
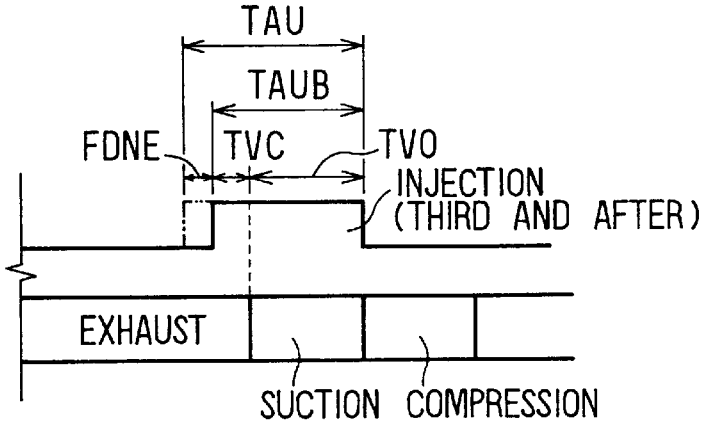

As shown in FIG. 55(A), since the injection amount correction value FDNE is "0" in the first and second injections just post-starting, the final injection amount TAU is set by "TAU=TAUB". As shown in FIG. 55(B), in the third injection and afterward, the intake valve closing time injection amount TVC and the injection amount correction value FDNE according to the ΔNE value are calculated and the final injection amount TAU is set by "TAU=TAUB+FDNE" on the basis of the calculation results.

Figure 56A:
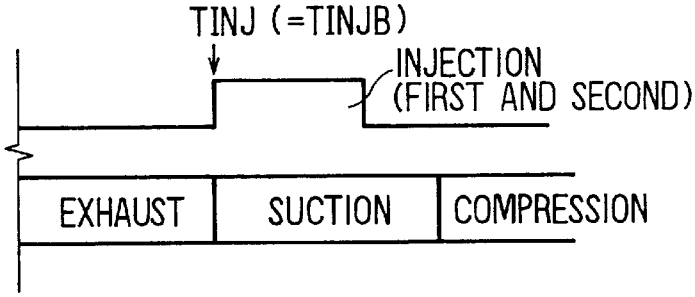
FIGS. 56A and 56B are time charts showing the injection timing correction.
Figure 56B:
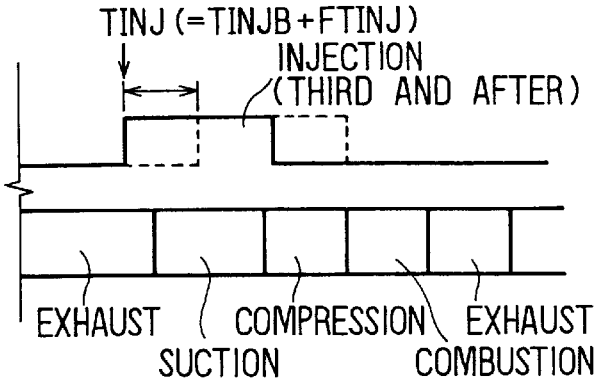

On the other hand, as shown in FIG. 56(A), in the first and second injections just after the starting, since the injection timing correction value FTINJ is "0", the final injection timing TINJ (injection start timing) is set by "TINJ=TINJB". As shown in FIG. 56(B), in the third injection and afterward, the injection timing correction value FTINJ is calculated according to the ΔNE value and the final injection timing TINJ (injection start timing) is set by "TINJ=TINJB+FTINJ". In FIG. 56(B), the injection timing is corrected so as to be close to the end of the suction stroke (for example, BDC) on the basis of the predicted rotational speed increase amount ΔNE. That is, the final injection timing TINJ is set so that the end of the fuel injection at the starting time is not late for the close timing of the intake valve 10*a*.

In the embodiment, the injection amount at the starting time is calculated in steps 2503 to 2505 in FIG. 51, the rotational speed increase is predicted in step 2509 in FIG. 52, the injection amount when the intake valve is closed is calculated in step 2510, the injection amount is corrected in steps 2510 and 2512, and the fuel injection timing is corrected in steps 2511 and 2513.

According to the ninth embodiment, the following effects can be obtained.

(a) The rotational speed increase amount ΔNE is predicted at the engine starting time and the fuel injection amount when the intake valve is closed (the intake valve closed time injection amount TVC) out of the injection amount TAUB at the starting time is calculated on the basis of the ΔNE value. The starting time injection amount TAUB is increased and corrected on the basis of the intake valve closed period injection amount TVC. With the above structure, even when the rotational speed NE suddenly increases and the fuel injection by the injector 19 is carried out also in the intake valve closing period (period before the suction stroke) at the engine starting time, the fuel shortage due to the wet of the injection when the intake valve is closed can be solved. As a result, the starting performance of the engine 10 can be improved.

(b) The injection amount correction value FDNE is obtained on the basis of the ratio of the fuel flowing into the cylinder of the injection at the open period of the intake valve 10*a* and that at the closed period of the valve 10*a* and the starting time injection amount TAUB iLs corrected by using the injection amount correction value FDNE. In such a case, by using the injection amount correction value FDNE in which the fuel inflow ratio at the open period and that at the close time of the intake valve 10*a* is considered, the fuel can be injected more properly.

(c) The fuel injection timing is corrected on the basis of the predicted rotational speed increase amount ΔNE so that the end of the starting time fuel injection is not late for the closing timing of the intake valve. When the fuel injection by the injector 19 is still carried out after the suction stroke, the fuel inflow amount into the cylinder is accordingly reduced. However, by correcting the fuel injection timing in accordance with the rotational speed increase amount ΔNE, the inconvenience can be avoided.

(d) The rotation speed increase amount ΔNE is predicted from the number of injection periods from the beginning of the engine starting and the water temperature THW. In this case, the influence by the engine friction is reflected in the rotation speed prediction, so that the rotational speed increase amount ΔNE can be accurately predicted.

(e) For the fuel injection in the beginning of the engine starting, the correction of the fuel injection amount and the fuel injection timing is not performed. Consequently, an unnecessary correcting process can be omitted.

(f) The starting time injection amount TAUB is calculated on the basis of the number of combustion cycles from the beginning of starting of the engine 10 and the water temperature THW. The larger the number of combustion cycles is, the more the injection amount is decreased, and the lower the water temperature THW is, the more the injection amount is increased. In this case, the starting time injection amount TAUB can be set according to the degree of saturation cf the fuel wet so that the inconvenience such that an excessive amount of fuel is injected is suppressed.

Tenth Embodiment

A tenth embodiment is a modification of a part of the ninth embodiment. In the tenth embodiment, in order to increase the flow ratio of the injected fuel into the cylinder by the injector, the starting time injection amount is divided and injected. This operation will be explained by using the time chart of FIG. 57.

Figure 57:
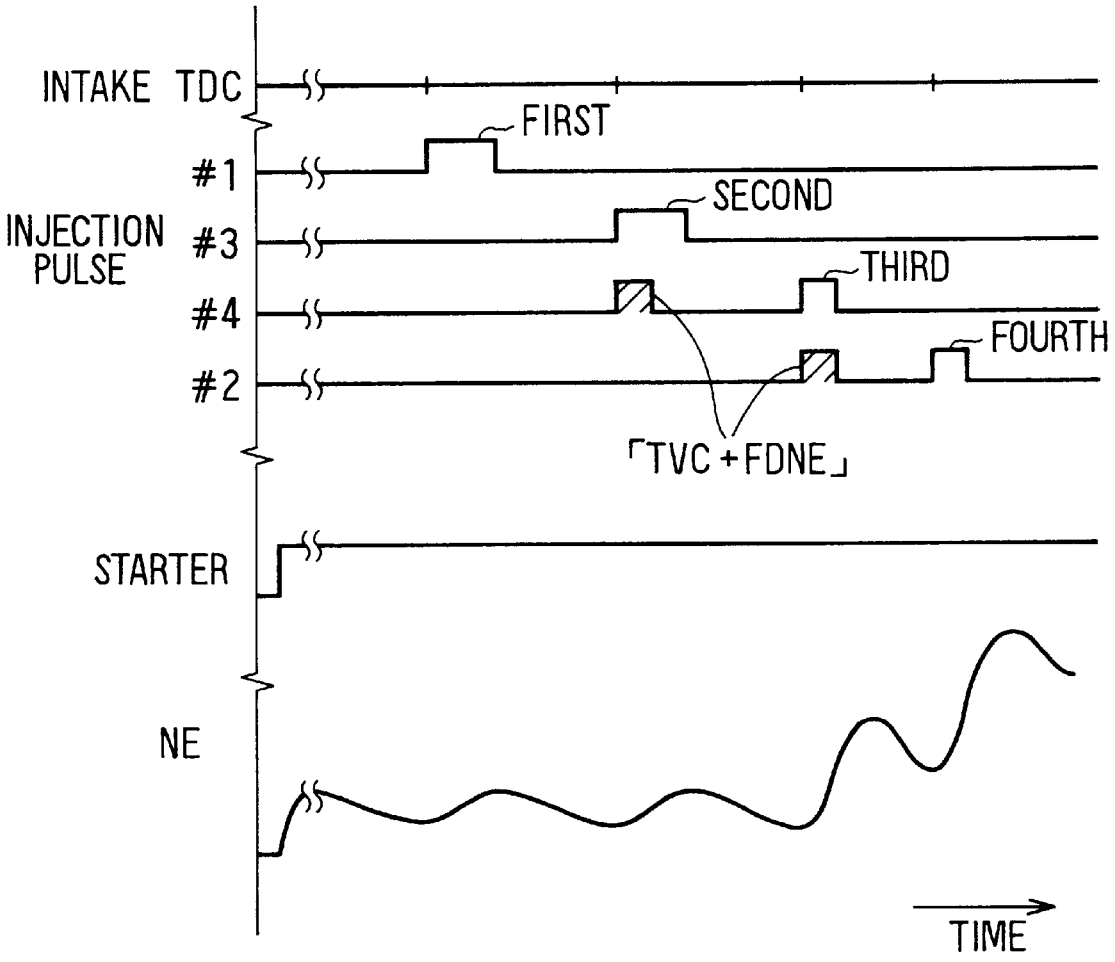
FIG. 57 is a time chart showing the fuel injection of each cylinder and increase in the rotational speed at the engine starting time according to a tenth embodiment of the present invention.

As shown in FIG. 57, for the third and afterward fuel injections (injections of the #4 and afterward cylinders), a part (hatched part in the diagram) of the final injection amount TAU is divided and injected in accordance with the fuel injection timing of the previous fuel cylinder. That is, the fuel amount (TVC+FDNE) obtained by adding the intake valve closed period injection amount TVC (the fuel injection amount when the intake valve is closed) and the injection amount correction value FDNE according to the TVC value is divided and injected at the timing preceding to the suction stroke of the combustion cylinder at that time.

With the construction, the fuel divided and injected at the timing preceding to the suction stroke of the combustion cylinder is once adhered to the wall of the intake port. The fuel is gradually evaporated until the suction stroke and flows into the cylinder in the suction stroke. Consequently, the problem that the fuel injected when the intake valve is closed remains wet in the intake port and the fuel amount which should be inherently flowed becomes insufficient is solved. As a result, the fuel flows into the cylinder efficiently and the engine starting performance is improved.

Although the divided injection (preinjection) is carried out in accordance with the fuel injection timing of the preceding combustion cylinder in FIG. 57, the timing of the preinjection is not limited to the above timing. In short, as long as the fuel is injected at a preceding timing in consideration of the evaporation time of the fuel injection amount when the intake valve is closed. For example, when it is predicted that the evaporation time on the wall of the intake port is long, the preinjection is performed at a relatively early timing. When it is predicted the evaporation time is short, the preinjection is carried out at a relatively late timing.

The above-embodiments can be modified as follows.

Although the injection start timing is set according to the engine speed NE or the water temperature THW at the engine starting time in the sixth to eighth embodiments, this timing can be changed. For example, the injection start timing is set according to the number of combustion cycles from the beginning of the engine starting (since the ignition is turned on). In this case, it is sufficient to use a map data obtained by changing the axis of abscissa of FIG. 43 to the number of cycles. The injection start timing is gradually shifted to the advanced angle side with the counting up of the number of combustion cycles.

Also, the injection start timing is set according to an elapsed time from the beginning of the engine starting (turn-on of the ignition). In this case, the injection start timing is shifted to the advanced angle side with an increase in the elapsed time. Further, when the injection start timing is set according to the engine speed NE, the water temperature THW, the number of combustion cycles, the elapsed time, and the like, the timing can be also linearly set. The above processes can be also applied properly to step 2202 in FIG. 46 of the seventh embodiment.

Further, the injection start timing (fuel injection timing) before completion of the combustion of the engine and that after completion of combustion can be made different by using two values. For example, the injection start timing is set to ATDC30° CA before completion of the combustion and the injection start timing is set to BTDC60° CA after completion of the combustion. In short, when the fact that the combustion has not been completed is discriminated, it is sufficient to set the timing to the retard angle side more than the normal injection start timing which is set after completion of combustion.

Although the complete combustion discriminating rotation speed STBNE is variably set according to the water temperature THW in the routine of FIG. 37, the STBNE value can be fixed. In this case, since the process for retrieving the STBNE value is omitted, the computing load on the ECU 27 can be reduced.

In the ninth embodiment, as the reference for discriminating the necessity of the injection amount correction or the injection timing correction in the beginning of the engine starting, whether the injection is "the third or afterward injection" or not is determined. The operation can be changed as follows. For example, after the cranking is started, whether the first combustion occurred or not is discriminated. The injection amount correction and the injection timing correction are inhibited (correction amount=0) before the first combustion and the injection amount correction and the injection timing correction are carried out after the first combustion.

In the ninth embodiment, the injection amount and the injection timing are corrected according to the rotational speed increase amount ΔNE, the operation can be changed. At least with respect to an apparatus for performing the injection amount correction by the procedure, the effects such that the fuel shortage due to the wet fuel of injection when the intake valve is closed is solved and the engine starting performance is improved can be obtained.

Eleventh Embodiment

In an eleventh embodiment, the intake pressure sensor 18 in FIG. 36 (sixth embodiment) is not used but an intake amount sensor 18*a* shown by a broken line in the diagram is employed. The fuel injection control is executed every NE pulse, that is every 30° CA by the ECU 27.

Figure 58:
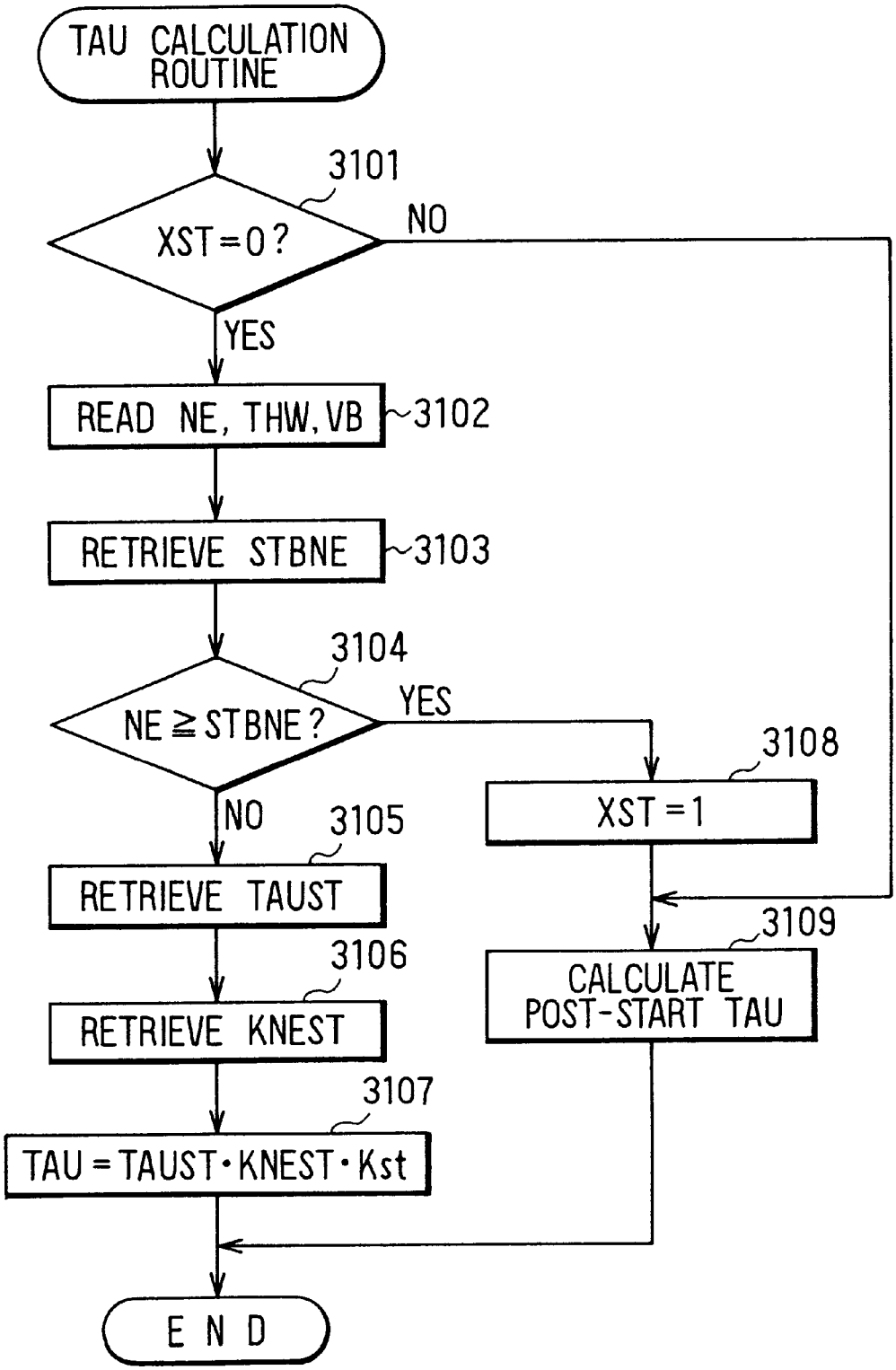
FIG. 58 is a flowchart showing a TAU calculation routine according to an eleventh embodiment of the present invention.

When the routine of FIG. 58 starts, first in step 3101, the ECU 27 discriminates whether the complete combustion flag XST is "0" or not. The complete combustion flag XST indicates whether the engine 10 post-starting has completed an combustion or not. (XST=0) denotes "before the combustion completion" and (XST=1) indicates "after the combustion completion". The flag is initialized to "0" when the power source of the ECU 27 is turned on.

When XST=0, the ECU 27 advances to step 3102 and reads various information such as engine speed NE, water temperature THW, battery voltage VB, and the like necessary for the fuel injection control at the engine starting time.

Figure 59:
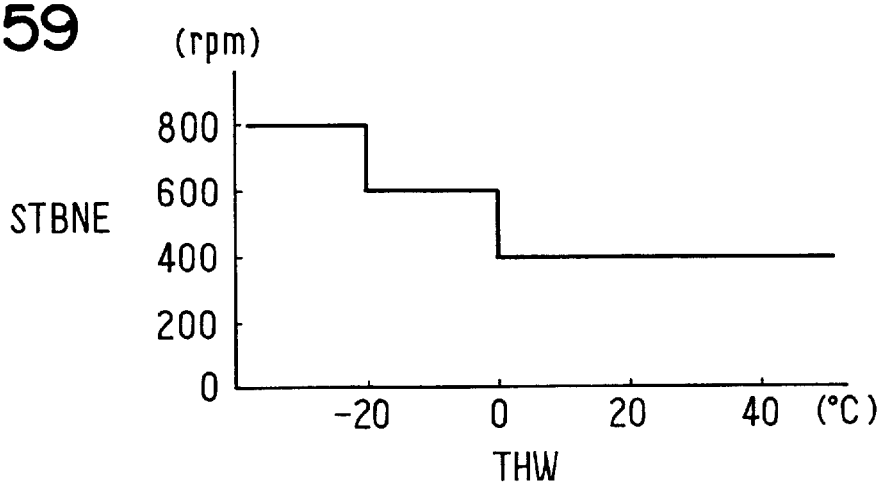
FIG. 59 is a graph showing the relation between the water temperature and complete combustion determining rotational speed.

Thereafter, the ECU 27 retrieves a map data of the complete combustion discriminating rotational speed STBNE in step 3103. Specifically, on the basis of the relation of FIG. 59, the complete combustion discriminating rotational speed STBNE according to the water temperature THW at each time is set. According to FIG. 59, setting is performed as follows; STBNE=800 rpm at THW −20° C., STBNE=600 rpm at THW of −20 to 0° C., and STBNE=400 rpm at THW of >0° C.

Figure 60:
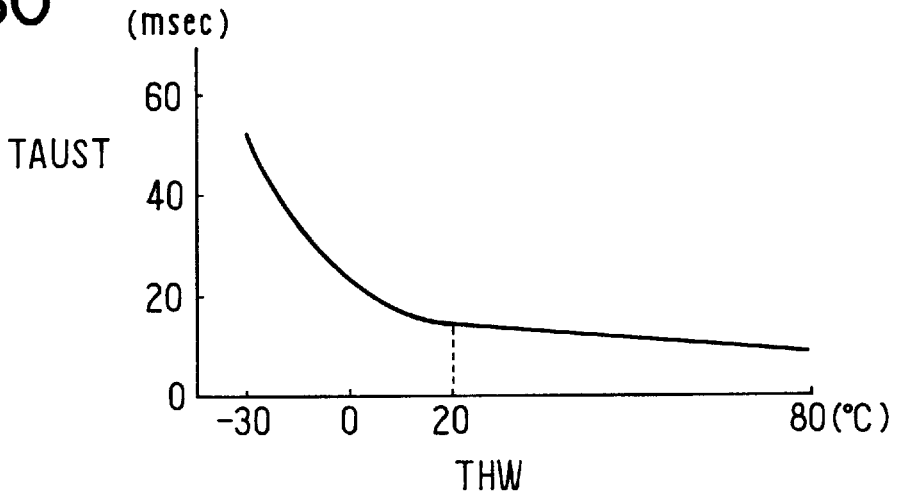
FIG. 60 is a graph showing the relation between the water temperature and the starting time fuel amount.

Thereafter, the ECU 27 compares the engine speed NE with the complete combustion discriminating rotational speed STBNE instep 3104. If NE<STBNE, the ECU 27 regards that the combustion has not been completed, discriminates step 3104 negatively, and advances to step 3105. The ECU 27 retrieves a map data of the starting time fuel amount TAUST by using, for instance, the relation of FIG. 60 in step 3105. In FIG. 60, the lower the water temperature THW is, the larger starting time fuel amount TAUST is set. In the embodiment, as a numerical value obtained by converting the required fuel amount into time, the starting time fuel amount TAUST ([m/sec])is used.

Figure 61:
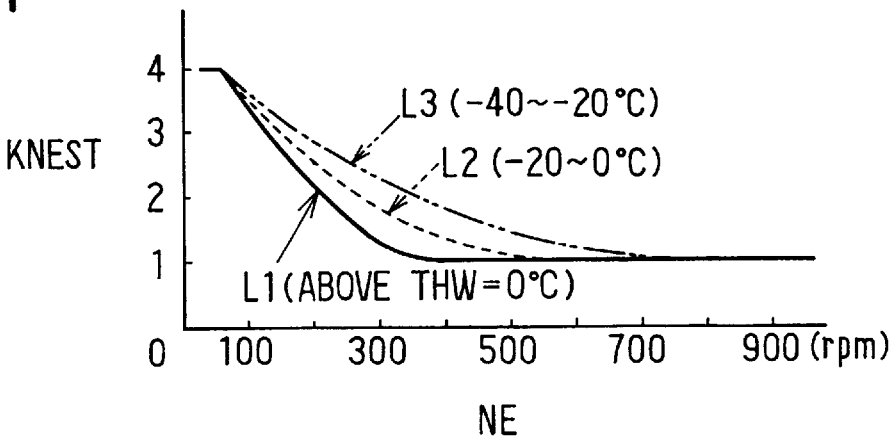
FIG. 61 is a graph showing the relation among the engine speed, water temperature, and rotation correction coefficient KNEST.

The ECU 27 retrieves the rotation correction coefficient KNEST from a map by using, for example, the relation of FIG. 61 in step 3106. From FIG. 61, the rotation correction coefficient KNEST is calculated according to the water temperature THW at each time and the engine speed NE.

As shown in FIG. 61, the lower the engine speed NE is in the rotation zone before completion of the combustion (for example, NE≦800 rpm), the larger rotation correction coefficient KNEST is set. A plurality of characteristic lines for setting the KNEST value are set according to the water temperature THW. In the embodiment, the KNEST value is set in the range from 1 to 4. The characteristic lines L1, L2, and L3 in the graph correspond to THW=0° C. or higher, −20 to 0° C., and −40 to −20° C., respectively. The characteristic lines L1 to L3 correspond to the fact that the engine friction varies according to the water temperature THW. The lower the water temperature THW is, the larger the friction is, so that the KNEST value increases. In FIG. 61, when the increasing degree of NE at the engine starting time is not constant due to the variation in the engine friction, that is, for example, even when the increasing degree of NE is relatively small at the time of first combustion at an extremely low temperature, the fuel amount can be corrected according to the increasing degree of NE.

The ECU 27 calculates the fuel injection amount TAU [m/sec] by using the following equation in step 3107 and, after that, finishes the routine once.

$$TAU=TAUST\cdot NEST\cdot Kst$$

where, Kst denotes a correction coefficient regarding a parameter except for the water temperature THW or the engine speed NE. For example, a correction coefficient by the battery voltage VB corresponds to Kst.

On the other hand, when NE≧STBNE, the ECU 27 regards that the combustion has been completed, discriminates step 3104 positively, and proceeds to step 3108. The ECU 27 sets "1" to the complete combustion flag XST in step 3108 and calculates the TAU value post-starting in step 3109. Generally, the basic injection amount is calculated according to the engine speed NE and the engine load (intake amount) and the air-fuel ratio correction and the like are carried out to the basic injection amount, thereby obtaining the TAU value.

After "1" is set to the complete combustion flag XST, step 3101 is discriminated negatively each time and the ECU 27 proceeds from 3101 directly to step 3109 and calculates the TAU value after starting so that normal fuel injection control is executed.

Figure 62:
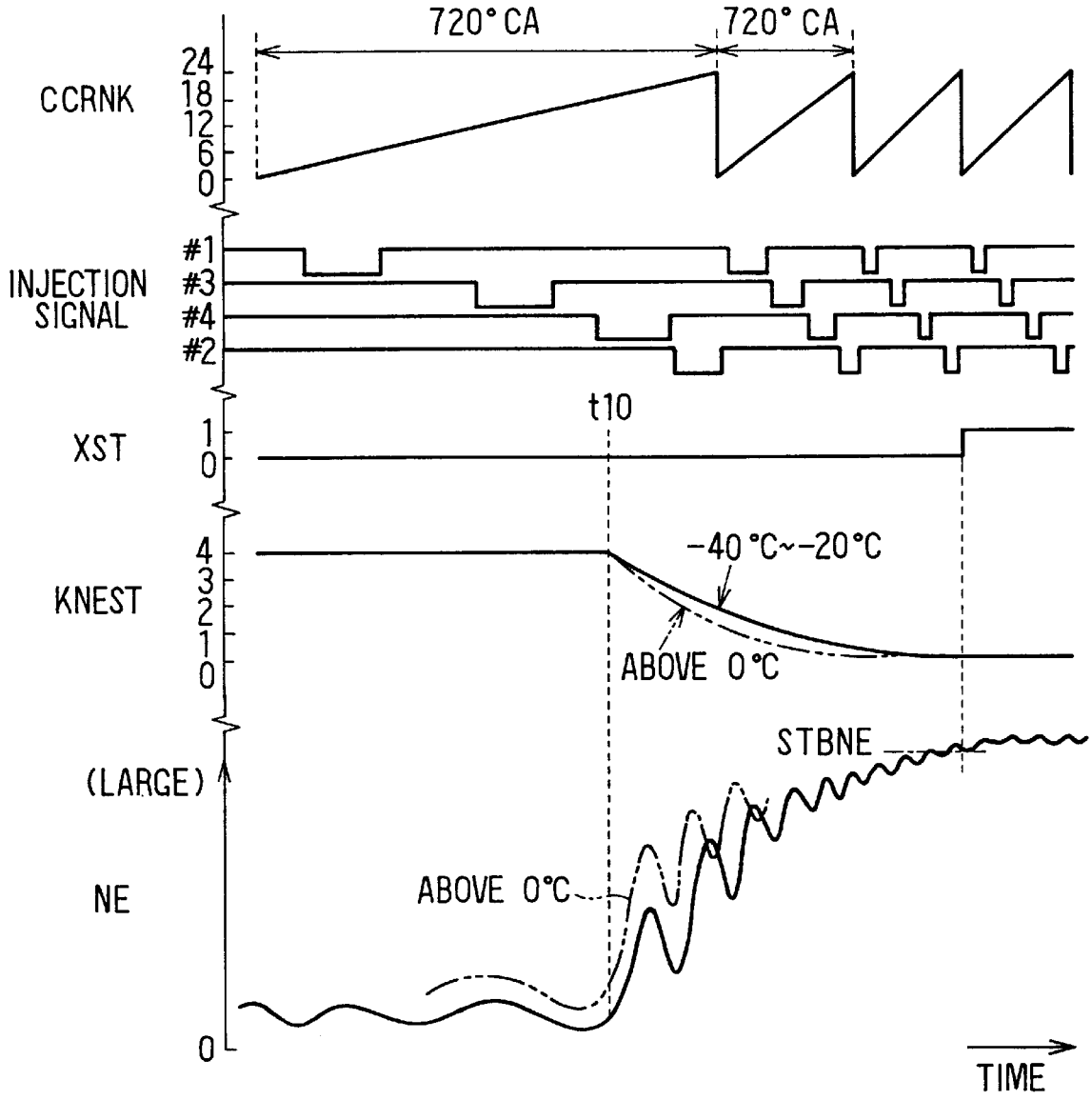
FIG. 62 is a time chart showing the fuel injection operation.

The fuel injection operation in the beginning of low-temperature starting of the engine 10 (in the case where THW=approximately −40 to −20° C.) is shown in FIG. 62. The crank angle counter CCRNK is a counter which is counted up every NE pulse (every 30° CA) and is cleared to "0" every 720° CA (every cycle) in which the combustion of all of the #1 to #4 cylinders is completed once. The counter is counted with the range from 0 to 24. Although the counting operation is executed in the TAU calculation routine of FIG. 58, it is omitted in FIG. 58.

Injection signals to the cylinders are generated from the ECU 27 in accordance with the order of #1→#3→#4→#2. In the beginning of the engine starting, the complete combustion flag XST is initialized to "0". In the event of the cranking by the starter motor 70, the engine speed NE is within the low rotational speed zone. According to the routine of FIG. 58, the starting time fuel amount TAUST and the rotation correction coefficient KNEST are computed and the fuel injection amount TAU is set on the basis of the TAUST and KNEST values (steps 3105 to 3107 in FIG. 58). In the beginning of the engine starting, the rotation correction coefficient KNEST is held at the maximum value 4 (FIG. 61).

When the first combustion occurs at time t10 in the chart, the engine speed NE starts to increase and the rotation correction coefficient KNEST decreases in response to the increase in NE. That is, the rotation correction coefficient KNEST starts to decrease and the fuel injection amount TAU is gradually decreased as compared with the beginning of the starting. Since THW=−40 to −20° C., the KNEST value is set based on the characteristic line L3 in FIG. 61.

When the engine speed NE reaches the complete combustion rotational speed STBNE (800 rpm in this case), "1"

is set to the complete combustion flag XST. After setting the flag, the normal fuel injection control is executed in place of the fuel injection control at the starting time (step 3109 in FIG. 58).

On the other hand, when the engine is started in the state where THW≧0° C., the engine friction becomes relatively small. As shown by a two-dot line in FIG. 62, the increasing degree of the engine speed NE just after the first combustion (after time t10) is higher than that in the case where THW=−40 to −20° C. (solid line). In such a case, according to the relation of FIG. 61, the rotation correction coefficient KNEST is set based on the characteristic line L1 and is set to be smaller than the rotation correction coefficient KNEST when THW=−40 to −20° C. (value based on the characteristic line L3). That is, when THW≧0° C., since the increasing degree of NE after the first combustion is relatively high, the correction width for correction by increasing the fuel injection amount TAU is set rather narrow.

According to the embodiment described above in detail, the following effects can be obtained.

(a) In the embodiment, the starting time fuel amount TAUST is calculated according to the water temperature THW through the process from the first combustion of the engine 10 to the completion of combustion. The lower the engine speed NE is, the more the starting time fuel amount TAUST is increased for correction. At the time of the fuel amount correction, the correction amount (rotation correction coefficient KNEST) is increased or decreased according to the increasing degree of the engine speed NE at each time.

In short, when the engine friction varies in the period from the first combustion to the combustion completion of the engine 10, the increasing degree of NE varies just after the first combustion and the requested fuel amount for obtaining a desired complete combustion torque varies. Consequently, in the process from the first combustion to the combustion completion, the lower the NE value is, the more the starting time fuel amount TAUST is increased for correction and the rotation correction coefficient KNEST of the fuel amount TAUST is increased or decreased according to the increasing degree of NE at each time. Specifically, the KNEST value is increased or decreased according to the water temperature THW.

In this manner, when the increasing degree of NE at the engine starting time fluctuates, that is, for example, even when the engine friction increases at the engine starting time at an extremely low temperature, the required fuel amount according to the friction can be injected and supplied, so that a desired output torque can be always obtained. That is, different from a conventional apparatus which simply sets the fuel injection amount proportional to the engine water temperature for correction of the rotational speed of the fuel injection amount, the output torque which is inherently necessary can be always obtained. As a result, the fuel injection amount at the engine starting time can be controlled with high accuracy.

(b) As shown by the relation in FIG. 61, the widths among the characteristic lines L1 to L3 (differences in the increase and decrease width of the correction amount) are gradually increased with the increase in the rotational speed from the first combustion of the engine 10 and the widths among the characteristic lines L1 to L3 are gradually reduced as the combustion completion of the engine 10 is approaching. That is, the state just before the combustion completion of the engine 10 is such that the engine 10 can almost maintain the rotation by itself, so that the correction according to the increasing degree of NE (proper use of the characteristic lines L1 to L3 in FIG. 61) are not so needed. The degree of correction of the starting time fuel amount TAUST is therefore reduced near the completion of combustion. With the construction, the fuel amount control until the combustion completion can be properly carried out in the engine starting time when the NE increasing degree is different each time.

(c) The complete combustion discriminating rotational speed STBNE is variably set according to the water temperature THW and whether the engine 10 has completed the combustion or not is determined according to the complete combustion discriminating rational speed STBNE. In this case, even when the rotational speed at which the engine 10 can maintain the rotation by itself varies according to the water temperature THW (engine temperature), a proper fuel injection amount control can be continued until the combustion has been actually completed.

(d) Since the fuel injection control at the engine starting time can be properly performed, an effect that the emission exhaust amount at the starting time is reduced can be also obtained.

This embodiment can be also realized in the following modes.

When the period in which the combustion of all of the cylinders #1 to #4 is completed once at the engine starting time, that is, when the period of 720° CA is set to "one cycle", there is a tendency that the required fuel amount of each cylinder can be determined every cycle. The number of cycles from just post-starting is calculated every 720° CA and a correction coefficient KSYCST is set according to the number of cycles.

Figure 63:
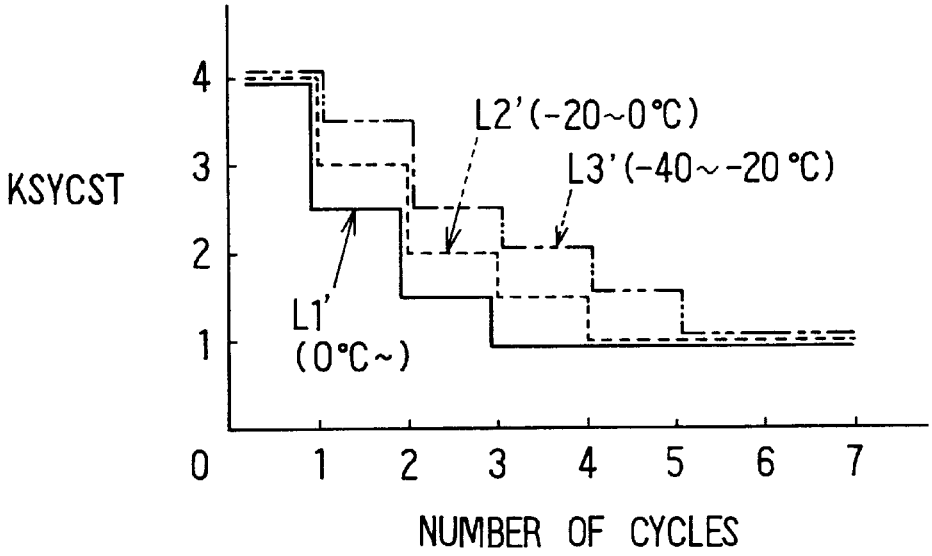
FIG. 63 is a graph showing the relation among the number of cycles, water temperature, and correction coefficient KSYCST according to a modification of the eleventh embodiment.

Specifically, the correction coefficient KSYCST is calculated according to the water temperature THW at each time and the number of cycles on the basis of the relation shown in FIG. 63. In FIG. 63, three characteristic lines L1', L2', and L3' are set according to the water temperatures THW (=0° C. or higher, −20 to 0° C., and −40 to −20° C.). The number of cycles at KSYCST=1 is the number of cycles indicating that the engine 10 has completed the combustions. By the characteristic line L1' with the relatively high water temperature THW, the rat her small KSYCST value is set in the process until the combustion completion (the number of cycles=3). By the characteristic line L3' with the relatively low water temperature THW, the rather large KSYCST value is set in the process until the combustion completion (the number of cycles=5).

In such a case, the fuel injection amount TAU [m/sec] is calculated by the following equation.

$$TAU=TAUST\cdot KSYCST\cdot Kst$$

According to the embodiment using the characteristics of FIG. 63, when the NE increase degree at the engine starting time is not constant due to variation in the engine friction, that is, for example, even when the NE increase degree at the time of the first combustion is relatively low at an extremely low temperature, the fuel amount correction according to the variation in the NE increase degree can be carried out.

When the required fuel amount at the starting time is corrected by using the number of cycles, the TAU value is not suddenly changed just after the first combustion during one cycle (within 720° CA) and the engine 10 can operate stably. The correction coefficient can be also set by using the number of combustion times of each cylinder in place of the number of cycles.

The correction coefficient KVST corresponding to the open period [m/sec] of the intake valve 10*a* can be also used instead of the foregoing embodiment in which the rotation correction coefficient KNEST corresponding to the engine speed NE is set. That is, the correction coefficient KVST is set according to the open period [m/sec] of the intake valve 10*a* with the rotation of the crankshaft.

Figure 64:
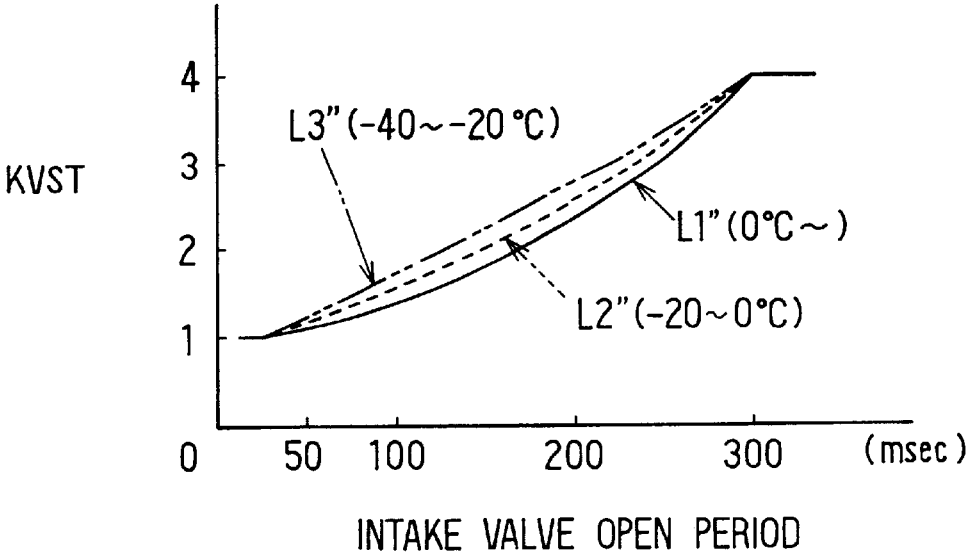
FIG. 64 is a graph showing the relation among intake valve open period, water temperature, and correction coefficient KVST according to a modification of the eleventh embodiment.

Specifically, on the basis of the relation shown in FIG. 64, the correction coefficient KVST is calculated according to the water temperature THW at each time and the valve open period. In FIG. 64, three characteristic lines L1", L2", and L3" are set according to water temperatures THW (0° C. or higher, −20 to 0° C., and −40 to −20° C.), respectively. It denotes that when the valve open period is short, the engine speed NE is in a high zone. On the contrary, when the valve open period is long, the engine speed NE is in a low zone.

In such a case, the fuel injection amount TAU[m/sec] is calculated by the following equation.

$$TAU=TAUST\cdot KVST\cdot Kst$$

That is, the relation of FIG. 63 is obtained by replacing the engine speed NE of the axis of abscissa in FIG. 61 with the valve open period. The longer the valve open period is, the more the starting time fuel amount is increased for correction. By the operation, even when the NE increasing degree at the engine starting time is not constant due to variation in the engine friction (water temperature THW), the fuel amount correction according to the variation in the NE increasing degree can be carried out.

It is also possible that the existence or absence of a misfire is determined based on, for instance, the engine speed NE at the engine starting time and the fuel injection amount TAU is increased for correction when the misfire is determined. This operation intends to correct the fuel injection amount to the increase side in addition to the increase by the rotation correction coefficient KNEST, and correction coefficients KSYCST and KVST, so that the completion of combustion in the case of a misfire can be quickened by the increase.

Although the increasing degree of the rotation speed NE at the engine starting time is obtained according to the water temperature THW in the foregoing embodiment, the engine temperature may be estimated on the basis of the outside air temperature, an elapsed time from the previous engine stop, and the like and the increasing degree of the engine speed NE at the engine starting time can be obtained according to the estimation value of the engine temperature. In short, any operation can be used as long as the NE increasing degree according to the engine friction at the engine starting time is reflected in the fuel injection control.

Although the complete combustion discriminating rotational speed STBNE is variably set according to the water temperature THW in the TAU calculating routine of FIG. 58, the STBNE value can be also fixed. In this case, since the process for retrieving the STBNE value is omitted, the calculation load on the ECU 27 can be reduced.

Twelfth Embodiment

Figure 65:
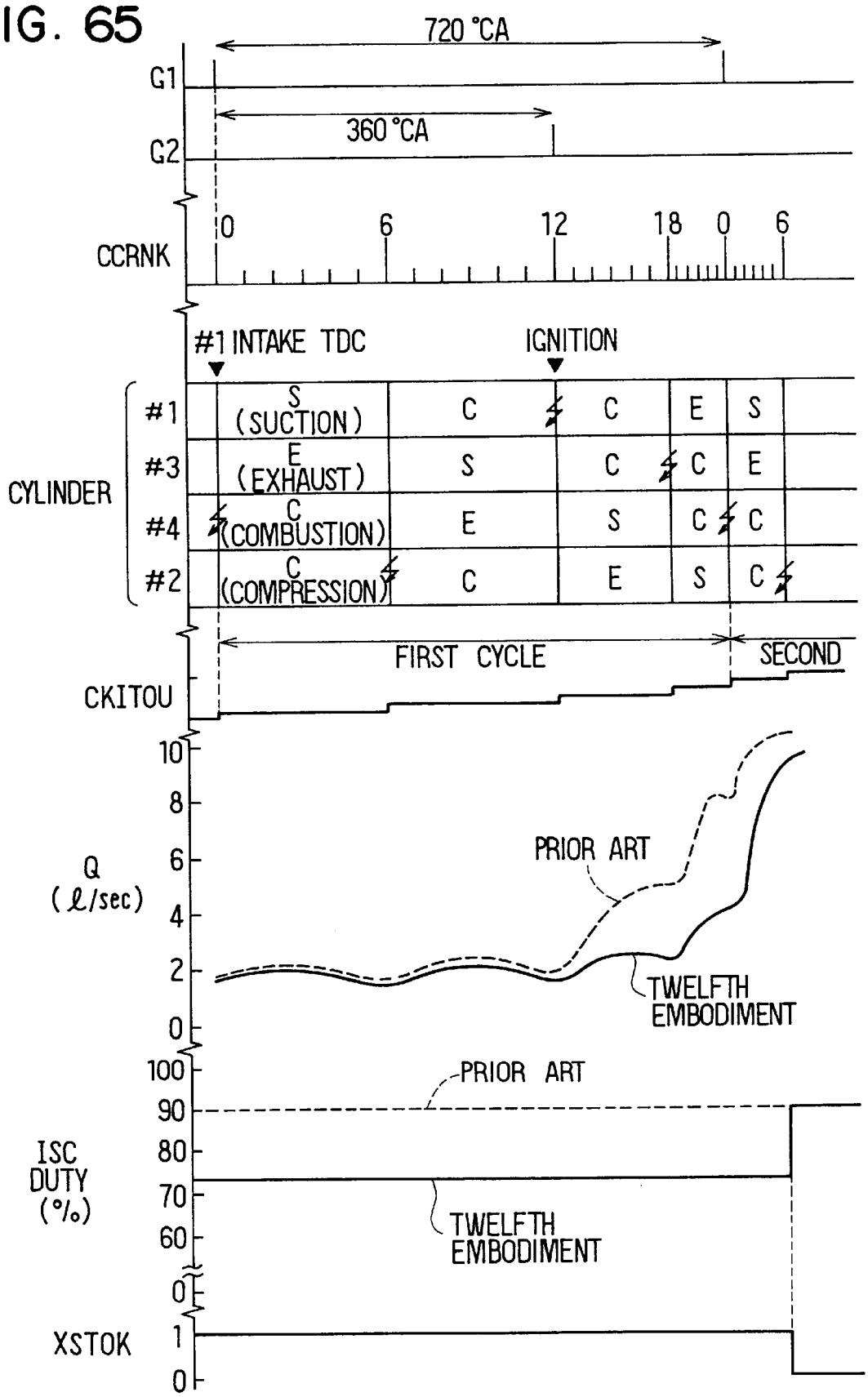
FIG. 65 is a time chart showing the operation of a control at the starting time according to a twelfth embodiment of the present invention.

In a twelfth embodiment as shown in FIG. 65, different from the first embodiment, the duty (opening angle) of the ISC valve 17 is reduced from the conventional duty to thereby reduce the intake air flow passing the ISC valve 17 (ISC flow). When the intake air flow is reduced, the mixture is allowed to have a high air-fuel ratio (rich) with the same fuel injection amount. Consequently, only with the fuel injection in the suction stroke, a sufficiently high fuel concentration mixture can be supplied into the combustion chamber from the beginning of starting operation and the air-fuel ratio of the mixture can be set within the combustion limit. Thus, the mixture can be burned from the cylinder of the first ignition timing at the starting operation and the starting performance can be improved.

Figure 66:
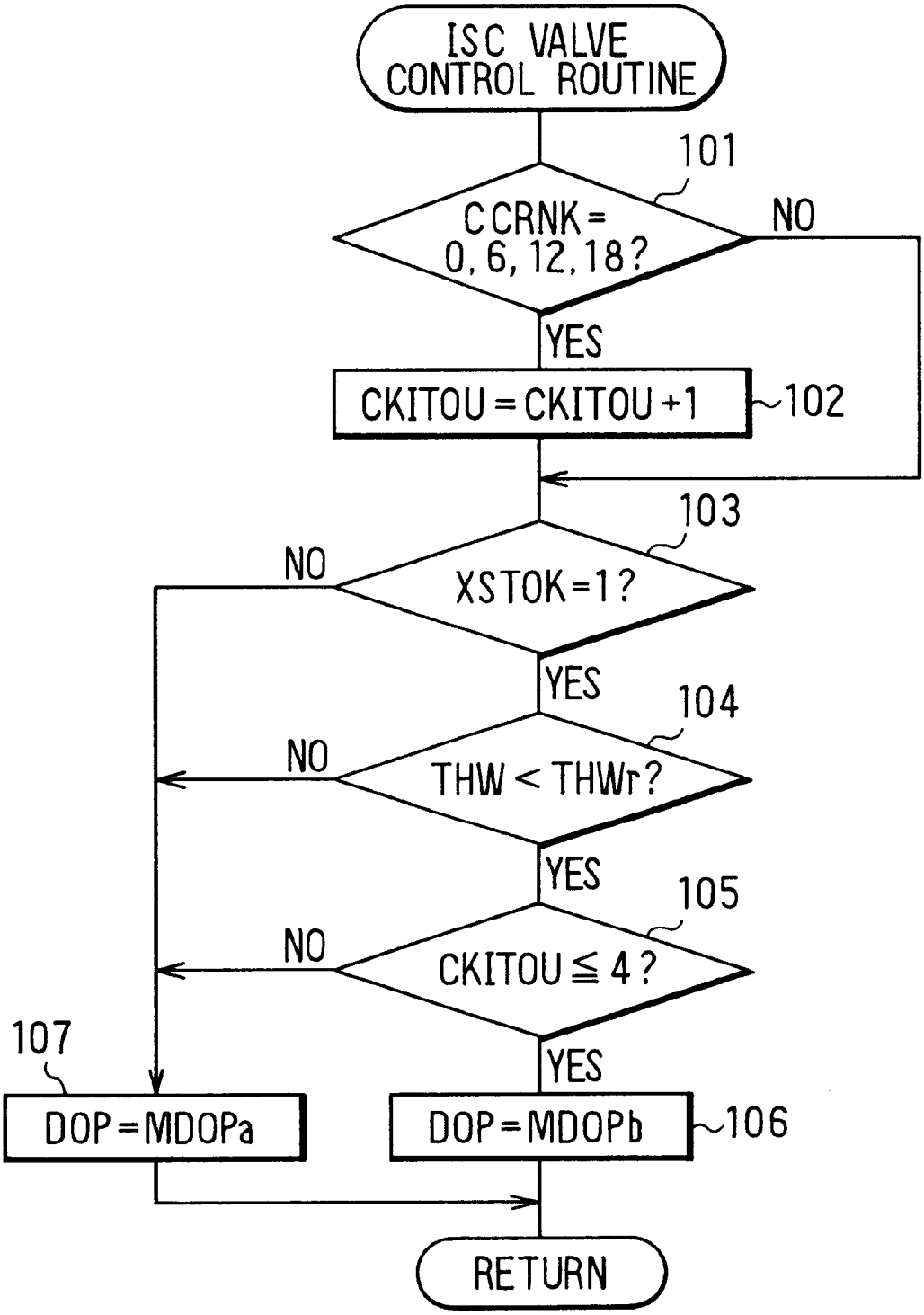
FIG. 66 is a flowchart showing the processing of an ISC valve control routine.
Figure 67:
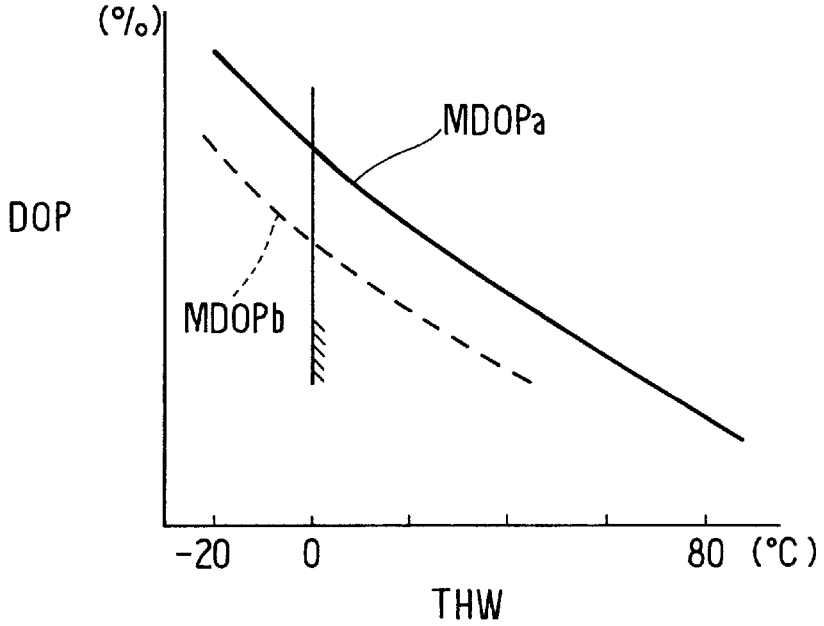
FIG. 67 is a graph showing a map for specifying the relation between the cooling water temperature THW and ISC valve duty DOP.
Figure 68:
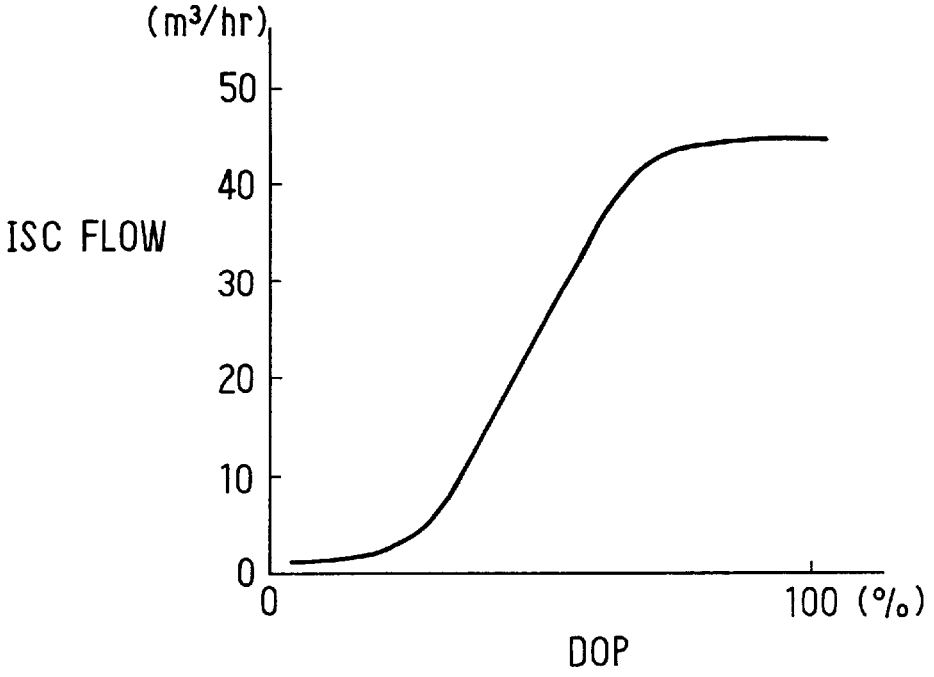
FIG. 68 is a graph showing the relation between the ISC valve duty DOP and ISC flow.

As shown in FIG. 66, when the starting time mode control execution conditions are not satisfied, that is, when "NO" is discriminated in any of steps 103 to 105 (FIG. 3), the processing routine advances to step 107, a regular control map MDOPa in FIG. 67 is retrieved, a duty DOP of the ISC valve 17 is calculated according to the cooling water temperature THW from the regular control map MDOPa, and the processing is finished. The relation between the duty DOP of the ISC valve 17 calculated as described above and the ISC flow is shown in FIG. 68.

On the other hand, when the starting time mode control execution conditions are satisfied, namely, when all of steps 103 to 105 are determined as "YES", the routine advances to step 106. A starting time mode map MDOPb in FIG. 67 is retrieved, the duty DOP of the ISC valve 17 is calculated according to the cooling water temperature THW from the map MDOPb of the starting time mode, and the processing is finished. The value of the starting time mode map MDOPb is set to be smaller than that of the normal control map MDOPa so as to set the ISC flow in the starting time mode smaller than that in the normal control mode.

According to the embodiment, the fuel injection is executed in the suction stroke at the starting time. Consequently, since the injected fuel is directly taken into the combustion chamber, adhesion of the fuel to the intake port 12 and the like can be reduced and a larger amount of the fuel can be accordingly supplied into the combustion chamber at the starting time as compared with the prior art.

Moreover, when the starting time mode control execution conditions are satisfied at the starting time, the duty (opening angle) of the ISC valve 17 is made smaller than the conventional one to reduce the ISC flow and the intake air flow at the starting time is accordingly made smaller than the conventional one, as shown in FIG. 65. Consequently, only with the fuel injection in the suction stroke, the sufficiently high fuel concentration mixture can be supplied into the combustion chamber from the beginning of the starting and the air-fuel ratio of the mixture can be set within the combustion limit, so that the starting performance can be improved and the HC exhaust amount at the starting time can be reduced.

Further, since the period of the starting time mode is limited within, for example, one cycle from the turn-on of the starter (start of the cranking), when the starting cannot be succeeded by any reason (for example, deterioration of the spark plug 28), the starting can be attempted also by the normal control. Thus, the reliability of the system can be increased.

The period of the starting time mode is not limited to one cycle. It can be longer or shorter than one cycle. For example, it can be set as follows. When the cylinder counter CKITOU<3, DOP=MDOPb and TAUST=TAUSTb. When the cylinder counter CKITOU≧3, DOP=MDOPa and TAUST=TAUSTa.

The period of the starting time mode can be also regulated by a timer. For example, it can be set as follows; DOP=MDOPb and TAUST=TAUSTb in a period from the start of cranking by a predetermined time, and DOP=MDOPa and TAUST=TAUSTa after the predetermined time.

Thirteenth Embodiment

In a thirteenth embodiment, the duty DOP of the ISC valve 17 in the starting time mode is calculated by correcting a map data of the normal control map MDOPa by a correction coefficient THOSEI2.

Figure 69:
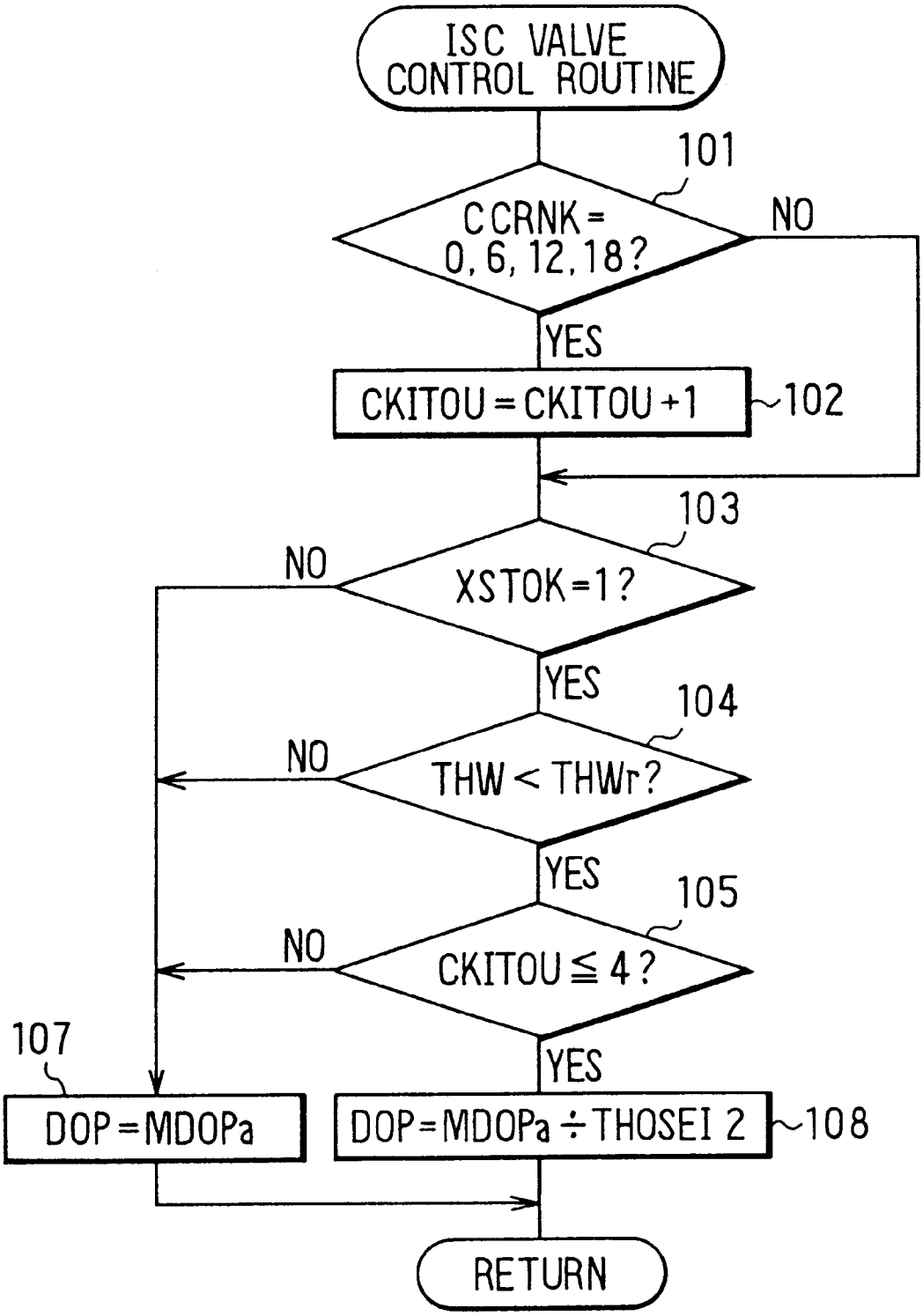
FIG. 69 is a flowchart showing the processing of an ISC valve control routine according to a thirteenth embodiment of the present invention.

That is, in the ISC valve control program of FIG. 69, when the starting time mode control execution conditions are satisfied, the routine advances to step 108 and the duty DOP of the ISC valve 17 is calculated by the following equation.

$$DOP=MDOPa\div THOSEI2$$

Figure 71:
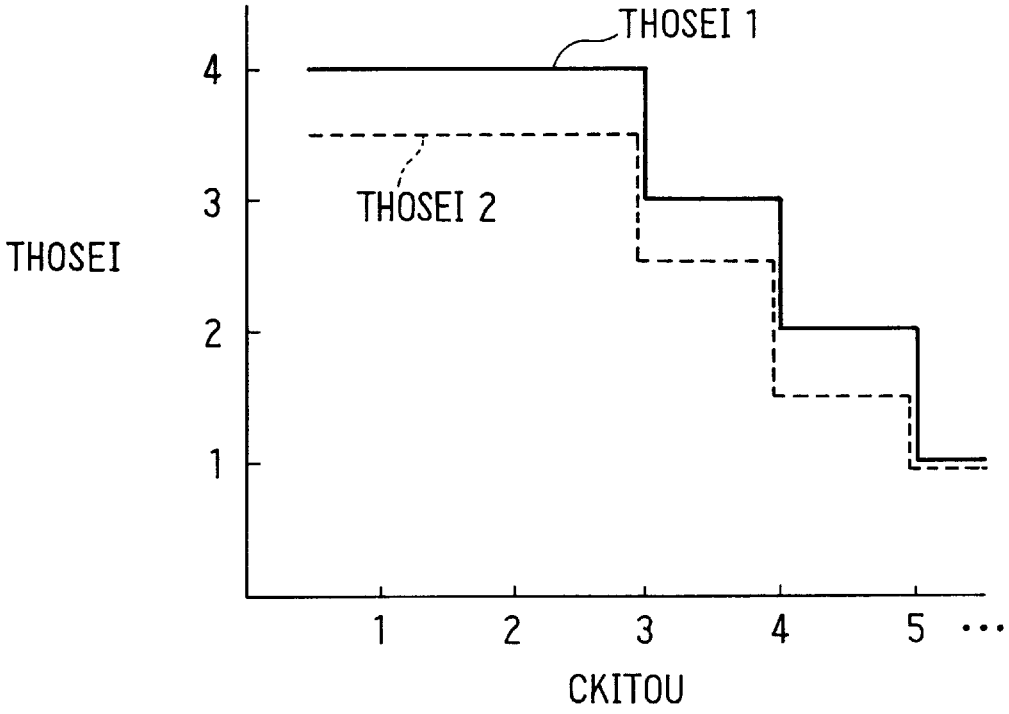
FIG. 71 is a graph showing a map for specifying the relation between a cylinder counter CKITOU and a correction coefficient THOSEI.

MDOPa is a map value of the normal control and is obtained by retrieving the normal control map which is the same as that in FIG. 69 of the twelfth embodiment. THOSEI2 is a correction coefficient and is derived from a map using the cylinder counter CKITOU as a parameter as shown in FIG. 71. The characteristic of the correction coefficient THOSEI2 in FIG. 71 is such that the correction amount of MDOPa is set to the maximum (the ISC flow is set to the minimum) for the first two cylinders from the beginning of the cranking, after that, the correction amount is decreased every cylinder (every 180° CA), the correction coefficient THOSEI2 becomes "1.0" at the fifth cylinder (after elapse of one cycle), and an uncorrected state follows.

Figure 70:
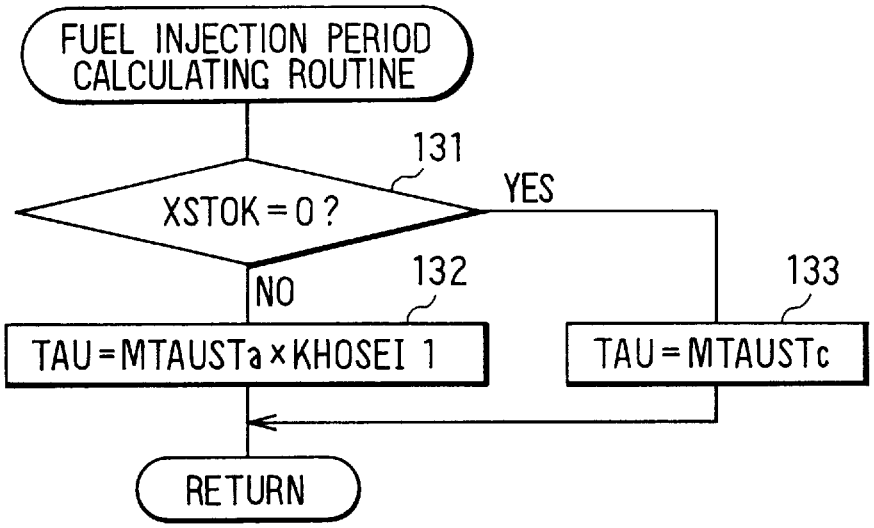
FIG. 70 is a fLowchart showing the processing of a fuel injection period calculating routine.

In a fuel injection period calculating program shown in FIG. 70, first in step 131, whether the starting flag XSTOK=0 (completion of starting) or not is determined. If Yes, the routine advances to step 133. The map data TAUSTc after completion of starting of FIG. 8 (first embodiment) is retrieved, the fuel injection period TAU is calculated according to the cooling water temperature THW from the map TAUSTc, and the program is finished.

On the other hand, when XSTOK=1 (during starting), the routine advances to step 132 and the fuel injection period TAU is calculated by the following equation.

$$TAU=TAUSTa\times THOSEI1$$

TAUSTa is a fuel injection period in the normal control mode and is obtained by the regular control map which is the same as that of FIG. 8 of the first embodiment. Although the correction coefficients THOSEI1 and THOSEI2 are set to "1.0" at the fifth cylinder from the start of cranking (after elapse of one cycle), they can also become "1.0" before or after such a timing. The change patterns of the correction coefficients THOSEI1 and THOSEI2 can be changed according to necessity.

Figure 7:
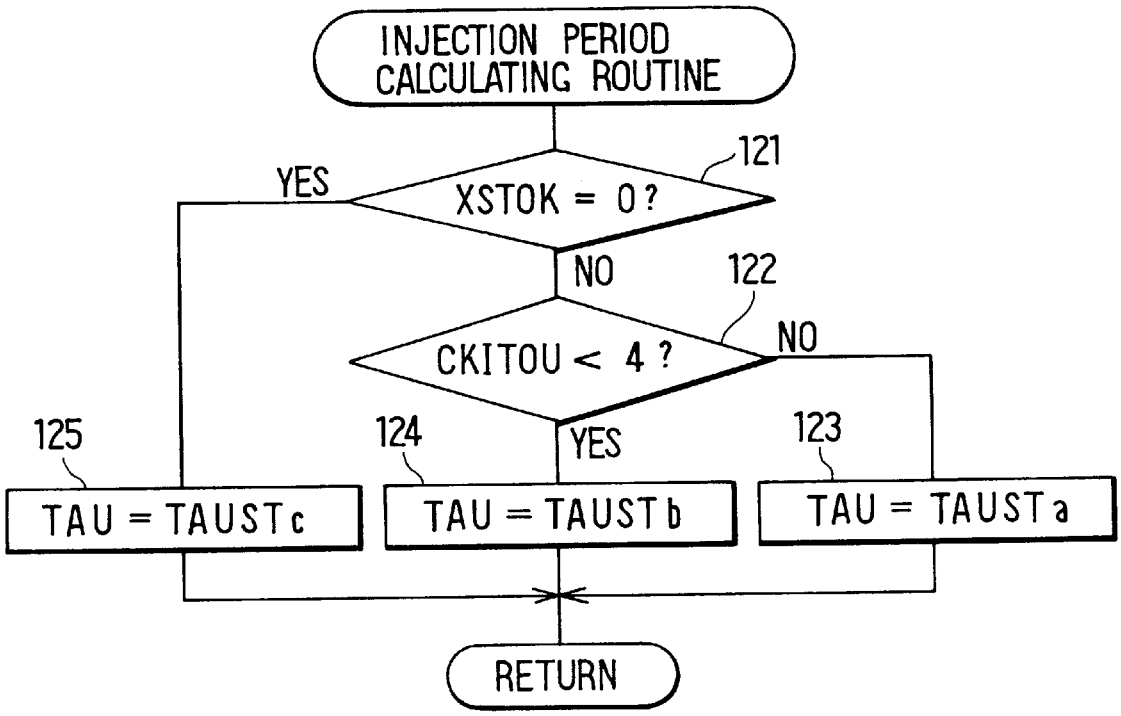
FIG. 7 is a flowchart showing the processing of a fuel injection period calculating routine.

In the thirteenth embodiment as well, the fuel injection period can be calculated by using the fuel injection period calculation program of FIG. 7 described in the first embodiment. Further, in the first embodiment, the fuel injection period can be also calculated by using the fuel injection period calculation program of FIG. 7.

Although the invention has been described by the first to thirteenth embodiments, the invention is not limited by the embodiments. The features of the embodiments can be also combined. Especially, it is more preferable to use the air-assist type fuel injection valve for fuel atomization used in the fourth embodiment for any other embodiments.

What is claimed is:

1. A fuel injection control system of an internal combustion engine having a plurality of cylinders, comprising:

injection timing control means for controlling a fuel injection timing of a fuel injection valve with respect to each of said cylinders so that injected fuiel from each fuel injection valve reaches its respective cylinder of the engine within a suction stroke thereof at a starting time of the internal combustion engine; and atomizing means for atomizing the fuel supplied to the cylinder, wherein the injection timing control means sets fuel injection timing to a retard angle side more than a normal fuel injection timing set post-starting the internal combustion engine.

2. A control system according to claim 1, wherein:

the atomizing means is fuel pressure control means for making a pressure of the fuel to be injected higher than that after the internal combustion engine is started.

3. A control system according to claim 1, further comprising:

valve open period adjusting means for adjusting an open period of an intake valve of the internal combustion engine so as to be extended at the starting time of the internal combustion engine.

4. A control system according to claim 1, further comprising:

starting time combustion limit estimating means for estimating an air-fuel ratio range in which a mixture supplied into a cylinder by a fuel injection of the first time can be burned on the basis of at least a cooling water temperature at the starting time of the internal combustion engine;

leakage fuel intake amount estimating means for estimating an amount of fuel which is leaked from the fuel injection valve during engine stop and is taken into a cylinder; and starting time injection amount calculating means for calculating a fuel injection amount to be injected for the first time on the basis of the leaked fuel intake amount estimating by the leakage fuel intake amount estimating means and the air-fuel ratio range in which the fuel can be burned and which is estimated by the starting time combustion limit estimating means.

5. A control system according to claim 4, further comprising:

combustion state discriminating means for discriminating a combustion state of intake mixture of the first time upon starting; and learning means for learning a correction value used for correcting the fuel injection amount of the first time at the next starting time on the basis of the combustion state of the first time discriminated by the combustion state discriminating means, wherein the starting time injection amount calculating means corrects the fuel injection amount of the first time by using the learned correction value of the learning means.

6. A control system according to claim 4, wherein:

the leakage fuel intake amount estimating means comprises:

means for estimating a total amount of the leaked fuel during an engine stop, and means for estimating a leaked fuel intake amount taken into a cylinder on the basis of the ratio of the intake air volume of one cylinder to an intake pipe volume in which the leaked fuel is spread and the leakage fuel total amount.

7. A control system according to claim 4, wherein:

the starting time injection amount calculating means calculates the fuel injection amount of the first time by using a lean limit of the starting time combustion range in consideration of the leakage fuel intake amount.

8. A control system according to claim 4, wherein:

the learning means learns a correction value for the fuel injection amount at the lean limit of the starting time combustion range every starting, and updates the learned correction value to a value on a rich side only by a predetermined learning dither value when the combustion state of the first time discriminated by combustion state discriminating means is not proper.

9. A control system according to claim 5, wherein:

the learning means switches the learned dither value in accordance with the leaked fuel intake amount.

10. A control system according to claim 4, wherein:

the learning means sets a plurality of learning zones divided according to starting conditions and updates the learned correction value of a learning zone corresponding to the starting condition every starting, and the starting time injection amount calculating means for correcting the fuel injection amount of the first time by using the learned correction value of the learning zone corresponding to the present starting condition.

11. A control system according to claim 4, wherein:

the combustion state discriminating means discriminates the combustion state of the first time on the basis of the increasing degree of the engine speed or the increasing degree of a pressure in a cylinder in the combustion stroke of the first time upon starting.

12. A control system according to claim 1, further comprising:

comparing means for comparing an open period of an intake valve in a next combustion cylinder with the fuel injection period in the next combustion cylinder;

wherein the starting time injection timing setting means has, first setting means for setting the fuel injection timing by the injector to a predetermined timing when the open period of the intake valve is longer as a result of the comparison, and a second setting means fcr shifting the fuel injection timing by the injector to the advanced angle side more than the first setting means when the fuel injection period is longer as a result of the comparison.

13. A control system according to claim 12, wherein:

the open period of the intake valve is calculated from a time of a period during which a valve lift amount is equal to or larger than a predetermined value.

14. A control system according to claim 1, further comprising:

rotational speed detecting means for detecting the engine rotational speed, wherein the starting time injection timing setting means gradually shifts the fuel injection timing to the advanced angle side with an increase in the engine rotational speed.

15. A control system according to claim 1, further comprising:

temperature detecting means for detecting engine temperature, wherein the starting time injection timing setting means gradually shifts the fuel injection timing to the advanced angle side with an increase in the engine temperature.

16. A control system according to claim 1, further comprising:

counting means for counting the number of combustion cycles from the beginning of the engine starting, wherein the starting time injection timing setting means gradually shifts the fuel injecting timing to the advanced angle side with an increase in the number of the combustion cycles.

17. A control system according to claim 1, wherein:

the starting time injection timing setting means calculates each of fuel injection timings in accordance with a plurality of engine operating conditions and selects a value on the most retard angle side among the calculated fuel injection timings.

18. A control system according to claim 1, wherein:

a surplus of the fuel injected and supplied for a time longer than the open period of the intake valve is added to a fuel injection amount in the next combustion cylinder at the engine starting time.

19. A control system according to claim 18, wherein:

a fuel injection is stopped at a time point when the fuel injection by the injector is continued until a predetermined crank angle.

20. A control system according to claim 19, wherein:

an end timing of the fuel injection upon the engine starting is set on the basis of the engine rotational speed.

21. A control system according to claim 1, further comprising:

starting time injection amount calculating means for calculating a fuel in jection amount for a next combustion cylinder at a starting time of the internal combustion engine;

rotational speed increase amount predicting means for predicting an increase amount of the engine rotational speed by a combustion at the starting time of the internal combustion engine;

valve close period injection amount calculating means for calculating a fuel amount injected in a period during which an intake valve is closed out of the fuel injection amount at the time of starting on the basis of the predicted increase amount of the engine rotational speed; and increase amount correcting means for increasing the fuel injection amount at the starting time on the basis of the calculated injection amount during the intake valve closing time.

22. A control system according to claim 21, wherein:

the injection amount correcting means obtains an injection amount correction value on the basis of an inflow ratio of fuel injection into a cylinder when the intake valve is opened and an inflow ratio of fuel injection into a cylinder when the intake valve is closed and corrects the starting time injection amount by using the injection amount correction value.

23. A control system according to claim 21, wherein:

a fuel amount obtained by adding the calculated fuel injection amount when the intake valve is closed and the correction injection amount according to the injection amount when the intake valve is closed is divided and injected at a timing prior to the suction stroke of the combustion cylinder at that time.

24. A control system according to claim 21, further comprising:

a fuel injection timing correction means for correcting a fuel injection timing on the basis of the predicted increase amount of the engine speed so that the end of the starting time fuel injection is not later than the intake valve closing timing.

25. A control system according to claim 21, wherein:

the rotation increase amount predicting means predicts an increase amount of the engine rotational speed from the number of injection periods from the beginning of the engine starting and the engine temperature.

26. A control system according to claim 21, wherein:

the fuel injection amount or the fuel injection timing is not corrected at the fuel injection in the beginning of engine starting.

27. A control system according to claim 21, further comprising:

means for counting the number of combustion cycles from the beginning of the engine starting, each cycle denoting that combustion is performed once in all of cylinders of the internal combustion engine, wherein the starting time injection amount calculating means calculates the starting time injection amount on the basis of the number of combustion cycles from the beginning of the starting operation of the internal combustion engine.

28. A control system according to claim 1, wherein there are a plurality of fuel injection valves, each fuel injection valve being attached near the intake port of a respective cylinder so that the fuel is injected separately for each cylinder.

29. A control system according to claim 1, further comprising:

valve close period injection amount calculating means for calculating a fuel amount injected during a period when an intake valve of the engine is closed and injection amount correcting means for correcting the fuel injection amount at the starting time on the basis of the calculated amount of fuel injected during the valve close period.

30. A control system according to claim 29, wherein a starting time injection amount is increased and corrected on the basis of the valve close period injection amount.

31. A control system according to claim 1, further comprising rotational speed increase amount predicting means for predicting an increase amount of the engine rotational speed by a combustion at the starting time of the internal combustion engine.

32. A control system according to claim 31, further comprising a fuel injection timing correcting means for correcting a fuel injection timing on the basis of the predicted increase amount of the engine speed so that the end of the starting time fuel injection is not later than the intake valve closing timing.

33. A control system applied to an internal combustion engine for injecting and supplying fuel from an injector to an intake port and performs fuel injection by the injector in correspondence with a suction stroke period in association with opening of an intake valve, comprising:

starting injection amount calculating means for calculating a starting injection amount of a next combustion cylinder when the internal combustion is in a starting process before completion of combustion;

rotational speed increase amount predicting means (2509) for predicting an increase amount of the engine rotational speed by combustion when the internal combustion is in the starting state before completion of combustion;

valve closed period time injection amount calculating means for calculating a fuel amount injected when the intake valve is closed out of the starting injection amount on the basis of the predicted increase amount of the engine rotational speed; and injection amount correcting means for increasing the starting injection amount for correction on the basis of the calculated injection amount when the intake valve is closed.

* * * * *